US010631371B2

(12) United States Patent
Aritaki et al.

(10) Patent No.: US 10,631,371 B2
(45) Date of Patent: Apr. 21, 2020

(54) HEATER

(71) Applicant: ROHM CO., LTD., Kyoto-shi, Kyoto (JP)

(72) Inventors: Yasuyuki Aritaki, Kyoto (JP); Tomoharu Horio, Kyoto (JP); Masatoshi Nakanishi, Kyoto (JP); Masashi Takagi, Kyoto (JP); Nobuhito Kinoshita, Kyoto (JP)

(73) Assignee: ROHM CO., LTD., Kyoto (JP)

( * ) Notice: Subject to any disclaimer, the term of this patent is extended or adjusted under 35 U.S.C. 154(b) by 420 days.

(21) Appl. No.: 14/610,320

(22) Filed: Jan. 30, 2015

(65) Prior Publication Data

US 2016/0227607 A1 Aug. 4, 2016

(51) Int. Cl.
*H05B 3/26* (2006.01)

(52) U.S. Cl.
CPC ..... *H05B 3/265* (2013.01); *H05B 2203/013* (2013.01)

(58) Field of Classification Search
CPC ..... H05B 2203/013; H05B 3/265; G03G 15/2042; G03G 15/2046; G03G 15/2053
USPC ..... 219/216; 399/329
See application file for complete search history.

(56) References Cited

U.S. PATENT DOCUMENTS 5,171,696 A * 12/1992 Hagino ..... H01L 29/0834 257/139
6,323,460 B1 * 11/2001 Ohtsuka ..... G03G 15/2064 219/121.69
7,512,370 B2 * 3/2009 Shimizu ..... G03G 15/2064 399/122
9,250,583 B1 * 2/2016 Himeno ..... G03G 15/2053
9,405,243 B2 * 8/2016 Ogura ..... G03G 15/2042
9,417,576 B2 * 8/2016 Minamishima ..... G03G 15/206
2005/0109768 A1 * 5/2005 Aoki ..... H05B 3/265 219/543

(Continued)

FOREIGN PATENT DOCUMENTS

JP 48-76536 U1 12/1971
JP 3-114755 A 5/1991

(Continued)

OTHER PUBLICATIONS

Office Action issued in counterpart Japanese application, dated Aug. 1, 2017, and corresponding English translation.

*Primary Examiner* — Ibrahime A Abraham
*Assistant Examiner* — Frederick F Calvetti
(74) *Attorney, Agent, or Firm* — Hamre, Schumann, Mueller & Larson, P.C.

(57) ABSTRACT

A heater includes an elongated substrate, a heating resistor formed on the substrate, a resistor electrode that is formed and is in contact with the heating resistor, and a heat conducting film. The substrate includes a heat generating section and a non-heat generating section. The heat generating section is a section that is overlapped with, out of the heating resistor and the resistor electrode, only the heating resistor in the lengthwise direction of the substrate. The non-heat generating section is a section that is different from the heat generating section and is adjacent to the heat generating section in the lengthwise direction of the substrate. The heat conducting film is formed so as to extend from the heat generating section into the non-heat generating section on the substrate.

42 Claims, 36 Drawing Sheets

(56) References Cited

U.S. PATENT DOCUMENTS

2010/0032427 A1* 2/2010 Aritaki ..... H05B 3/03 219/546
2012/0248294 A1* 10/2012 Kohama ..... H01L 27/14618 250/214 P
2013/0043234 A1* 2/2013 Tsai ..... H05B 3/20 219/220
2014/0138372 A1* 5/2014 Ogura ..... G03G 15/2042 219/216
2014/0169845 A1* 6/2014 Nakahara ..... G03G 15/2053 399/328
2014/0314456 A1* 10/2014 Kikuchi ..... G03G 15/2042 399/329
2015/0083706 A1* 3/2015 Campbell ..... G03G 15/2057 219/216
2015/0139708 A1* 5/2015 Shimura ..... G03G 15/2042 399/329
2015/0261157 A1* 9/2015 Yamano ..... G03G 15/2053 399/329
2015/0330376 A1* 11/2015 Taniyama ..... F04B 27/1054 417/271
2015/0341986 A1* 11/2015 Nakayama ..... H05B 3/0014 219/216
2016/0062281 A1* 3/2016 Minamishima ..... G03G 15/206 399/33

FOREIGN PATENT DOCUMENTS

JP 7-45357 A 2/1995
JP 11-74065 A 3/1999
JP 2003-17228 A 1/2003
JP 2003007435 * 1/2003
JP 2007-35505 A 2/2007
JP 2009-193844 8/2009
JP 2011-91006 A 5/2011

* cited by examiner

HEATER

BACKGROUND OF THE INVENTION

1. Field of the Invention

The present invention relates to a heater.

2. Description of Related Art

Conventionally, a heater used fox toner fixing in office automation devices (e.g., electronic copying machines, tax machines, and printers) is known. This type of heater includes a plate-shaped substrate and a resistance heating element, for example. In this type of heater, the substrate undergoes thermal expansion when the resistance heating element generates heat. In conventional heaters, there have been cases where cracks appear in the substrate due to thermal expansion of the substrate. For example, JP-A-2009-193844 is known as a document related to heaters.

SUMMARY OF THE INVENTION

The present invention was conceived in light of the above-described circumstances, and a main object thereof is to provide a heater that can prevent cracking of the substrate.

A first aspect of the present invention provides a heater including: an elongated substrate; a heating resistor formed on the substrate; a resistor electrode that is formed on the substrate and is in contact with the heating resistor; and a heat conducting film, wherein the substrate includes a heat generating section and a non-heat generating section, the heat generating section is a section that is overlapped with, out of the heating resistor and the resistor electrode, only the heating resistor in a lengthwise direction of the substrate, the non-heat generating section is a section that is different from the heat generating section and is adjacent to the heat generating section in the lengthwise direction of the substrate, and the heat conducting film is formed so as to extend from the heat generating section into the non-heat generating section on the substrate.

It is preferable that the heat conducting film is formed on end portions, in a widthwise direction of the substrate, of the substrate.

It is preferable that the heat conducting film has portions that are formed more toward widthwise direction end portions of the substrate than the heating resistor is, in a view along a thickness direction of the substrate.

It is preferable that the substrate has a substrate upper surface, a substrate lower surface, a first substrate side surface, and a second substrate side surface, the substrate upper surface and the substrate lower surface are located on mutually opposite sides in a thickness direction of the substrate, the first substrate side surface and the second substrate side surface are located on mutually opposite sides in a widthwise direction of the substrate, and the heating resistor and the resistor electrode are formed on the substrate upper surface side.

It is preferable that a plurality of cutouts are formed in the first substrate side surface and the substrate lower surface, and each of the plurality of cutouts has a semicircular cross-sectional shape taken along a plane orthogonal to the thickness direction of the substrate, and a diameter of the semicircle gradually decreases from the substrate lower surface toward the substrate upper surface.

It is preferable that each of the plurality of cutouts is semi-conical.

It is preferable that the diameter of the semicircle constituting each of the cutouts at the substrate lower surface is in a range of 40 to 70 μm.

It is preferable that the plurality of cutouts are formed by a laser.

It is preferable that the heat conducting film includes a lower surface portion formed on the substrate lower surface.

It is preferable that the heat conducting film includes a first side surface portion formed on the first substrate side surface, and a second side surface portion formed on the second substrate side surface.

It is preferable that the heat conducting film includes an upper surface portion formed on the substrate upper surface.

It is preferable that the upper surface portion, the heating resistor, and the resistor electrode are in contact with the substrate upper surface.

It is preferable that the upper surface portion is in contact with the substrate upper surface, and the upper surface portion has a portion that is overlapped with the heating resistor in a view along the thickness direction of the substrate.

It is preferable that the heater farther includes an insulating layer interposed between the upper surface portion and the heating resistor.

It is preferable that a dimension, in the lengthwise direction of the substrate, of a portion of the heat conducting film formed in the non-heat generating section is greater than or equal to 5 mm.

It is preferable that a dimension, in the lengthwise direction of the substrate, of a portion of the heat conducting film formed in the heat generating section is greater than or equal to 5 mm.

It is preferable that a dimension of the lower surface portion in the widthwise direction of the substrate is greater than or equal to half of a dimension of the substrate in the widthwise direction.

It is preferable that the lower surface portion includes a plurality of lower surface elements that are separated from each other, and each of the plurality of lower surface elements is formed so as to extend from the heat generating section into the non-heat generating section.

It is preferable that the upper surface portion includes a plurality of upper surface elements that are separated from each other, and each of the plurality of upper surface elements is formed so as to extend from the heat generating section into the non-heat generating section.

It is preferable that the heat conducting film is made of a material that has a higher thermal conductivity than the thermal conductivity of a material constituting the substrate.

It is preferable that the heat conducting film is made of a metal.

It is preferable that the metal is one of Ag, AgPt, Au, and Cu.

It is preferable that a thickness of the heat conducting film is in a range of 10 to 20 μm.

It is preferable that the heating resistor includes a first elongated portion and a second elongated portion that each extend along the lengthwise direction of the substrate, and the first elongated portion and the second elongated portion are separated from each other in a widthwise direction of the substrate.

It is preferable that the first elongated portion is located on a first widthwise direction side that is on one side in the widthwise direction of the substrate, a ratio of a separation dimension between the first elongated portion and an edge of the substrate in the first widthwise direction to a dimension of the substrate in the widthwise direction is in a range of 0.054 to 0.109, the second elongated portion is located on a second widthwise direction side that is on another side in the widthwise direction of the substrate, and a ratio of a separation dimension between the second elongated portion and an edge of the substrate in the second widthwise direction to the dimension of the substrate in the widthwise direction is in a range of 0.054 to 0.109.

It is preferable that a thickness of the substrate is in a range of 0.5 to 1.0 mm.

It is preferable that the first elongated portion is located on a first widthwise direction side that is on one side in the widthwise direction of the substrate, a separation dimension between the first elongated portion and an edge of the substrate in the first widthwise direction is in a range of 0.5 to 1.0 mm, the second elongated portion is located on a second widthwise direction side that is on another side in the widthwise direction of the substrate, and a separation dimension between the second elongated portion and an edge of the substrate in the second widthwise direction is in a range of 0.5 to 1.0 mm.

It is preferable that the first elongated portion has a first wide portion and a first narrow portion, a dimension of the first wide portion in the widthwise direction is greater than a dimension of the first narrow portion in the widthwise direction, and the first wide portion is located between the first narrow portion and the resistor electrode.

It is preferable that the second elongated portion has a second wide portion and a second narrow portion, a distension of the second wide portion in the widthwise direction is greater than a dimension of the second narrow portion in the widthwise direction, and the second wide portion is located between the second narrow portion and the resistor electrode.

It is preferable that the heater further includes a protective layer that covers the heating resistor.

It is preferable that, the protective layer covers the first elongated portion, the second elongated portion, and the resistor electrode.

It is preferable that the resistor electrode has a first resistor pad and a second resistor pad, and the first resistor pad and the second resistor pad are exposed from the protective layer.

It is preferable that the resistor electrode has a first resistor connection portion and a second resistor connection portion, the first resistor connection portion is connected to the first resistor pad and is in contact with the first elongated portion, the second resistor connection portion is connected to the second resistor pad and is in contact with the second elongated portion, and the first resistor connection portion and the second resistor connection portion are covered by the protective layer.

It is preferable that the heating resistor is made of one of AgPd, nichrome, and ruthenium oxide.

It is preferable that the substrate is made of a ceramic.

It is preferable that the ceramic is one of alumina, zirconia, and aluminum nitride.

It is preferable that a thickness of the substrate is in a range of 0.4 to 1.1 mm.

It is preferable that a thickness of the substrate is in a range of 0.4 to 0.6 mm.

It is preferable that the protective layer is made of a glass.

A second aspect of the present invention provides a heater that includes: an elongated substrate; a heating resistor formed on the substrate; a resistor electrode that is formed on the substrate and is in contact with the heating resistor; and an auxiliary resistor, wherein the auxiliary resistor has a portion that is located, in a different region from a region occupied by the heating resistor in a widthwise direction of the substrate.

It is preferable that the TCR of a material constituting the auxiliary resistor is lower than the TCR of a material constituting the heating resistor.

It is preferable that a sheet resistance value of a material constituting the auxiliary resistor at 27° C. is greater than a sheet resistance value of a material constituting the heating resistor at 27° C.

It is preferable that the substrate includes a first section, the first section is a section that is overlapped with, out of the heating resistor and the resistor electrode, only the heating resistor in a lengthwise direction of the substrate, and the auxiliary resistor has a portion located in an end port ion of the first section in the lengthwise direction of the substrate.

It is preferable that the substrate has a second section, the second section is a section that is different from the first section and is adjacent to the first section in the lengthwise direction of the substrate, and the auxiliary resistor reaches a boundary between the first section and the second section.

It is preferable that the auxiliary resistor has a portion that is in contact with the heating resistor.

It is preferable that the auxiliary resistor is separated from the heating resistor via a gap.

It is preferable that the auxiliary resistor is electrically connected to the heating resistor in parallel.

It is preferable that one end of the auxiliary resistor is in contact with the heating resistor.

It is preferable that another end of the auxiliary resistor is in contact with the resistor electrode.

It is preferable that the auxiliary resistor is formed on end portions, in the widthwise direction of the substrate, of the substrate.

It is preferable that the heater further includes an auxiliary resistance element, the auxiliary resistance element has a portion that is located in a different region from the region occupied by the heating resistor in the widthwise direction of the substrate, and the auxiliary resistance element is arranged at a position separated from the auxiliary resistor in a lengthwise direction of the substrate.

It is preferable that the heater further includes a connecting electrode that electrically connects portions of the heating resistor that are separated from each other, and the connecting electrode is located on the substrate on a side opposite to a side on which the resistor electrode is located, in a lengthwise direction of the substrate.

It is preferable that the TCR of a material constituting the auxiliary resistance element is lower than the TCR of a material constituting the heating resistor.

It is preferable that a sheet resistance value of a material constituting the auxiliary resistance element at 27° C. is greater than a sheet resistance value of a material constituting the heating resistor at 27° C.

It is preferable that the substrate has a third section, the third section is a section that is different from the first section and is adjacent to the first section in the lengthwise direction of the substrate, the first section is located between the second section and the third section, and the auxiliary resistance element reaches a boundary between the first section and the third section.

It is preferable that the substrate has a substrate upper surface, a substrate lower surface, a first substrate side surface, and a second substrate side surface; the substrate upper surface and the substrate lower surface are located on mutually opposite sides in a thickness direction of the substrate; the first substrate side surface and the second substrate side surface are located on mutually opposite sides in the widthwise direction of the substrate; and the heating resistor and the resistor electrode are formed on the substrate upper surface side.

It is preferable that the heating resistor includes a first elongated portion and a second elongated portion that each extend along a lengthwise direction of the substrate, and the first elongated portion and the second elongated portion are separated in the widthwise direction of the substrate.

It is preferable that the heater further includes a protective layer that covers the heating resistor.

It is preferable that the protective layer covers the heating resistor and the resistor electrode.

It is preferable that the resistor electrode has a first resistor pad and a second resistor pad, and the first resistor pad and the second resistor pad are exposed from the protective layer.

It is preferable that the resistor electrode has a first resistor connection portion and a second resistor connection portion, the first resistor connection portion is connected to the first resistor pad and is in contact with the first elongated portion, the second resistor connection portion is connected to the second resistor pad and is in contact with the second elongated portion, and the first resistor connection portion and the second resistor connection portion are covered by the protective layer.

It is preferable that the heating resistor is made of one of AgPd, nichrome, and ruthenium oxide.

It is preferable that the substrate is made of a ceramic.

It is preferable that the ceramic is one of alumina, zirconia, and aluminum nitride.

It is preferable that a thickness of the substrate is in a range of 0.4 to 1.1 mm.

It is preferable that a thickness of the substrate is in a range of 0.4 to 0.6 mm.

It is preferable that the protective layer is made of a glass.

Other features and advantages of the present invention sill become apparent from, the detailed description given below with reference to the accompanying drawings.

MODES FOR CARRYING OUT THE INVENTION

First Embodiment

A first embodiment of the present invention will be described below with reference to FIGS. 1 to 12.

Figure 1:
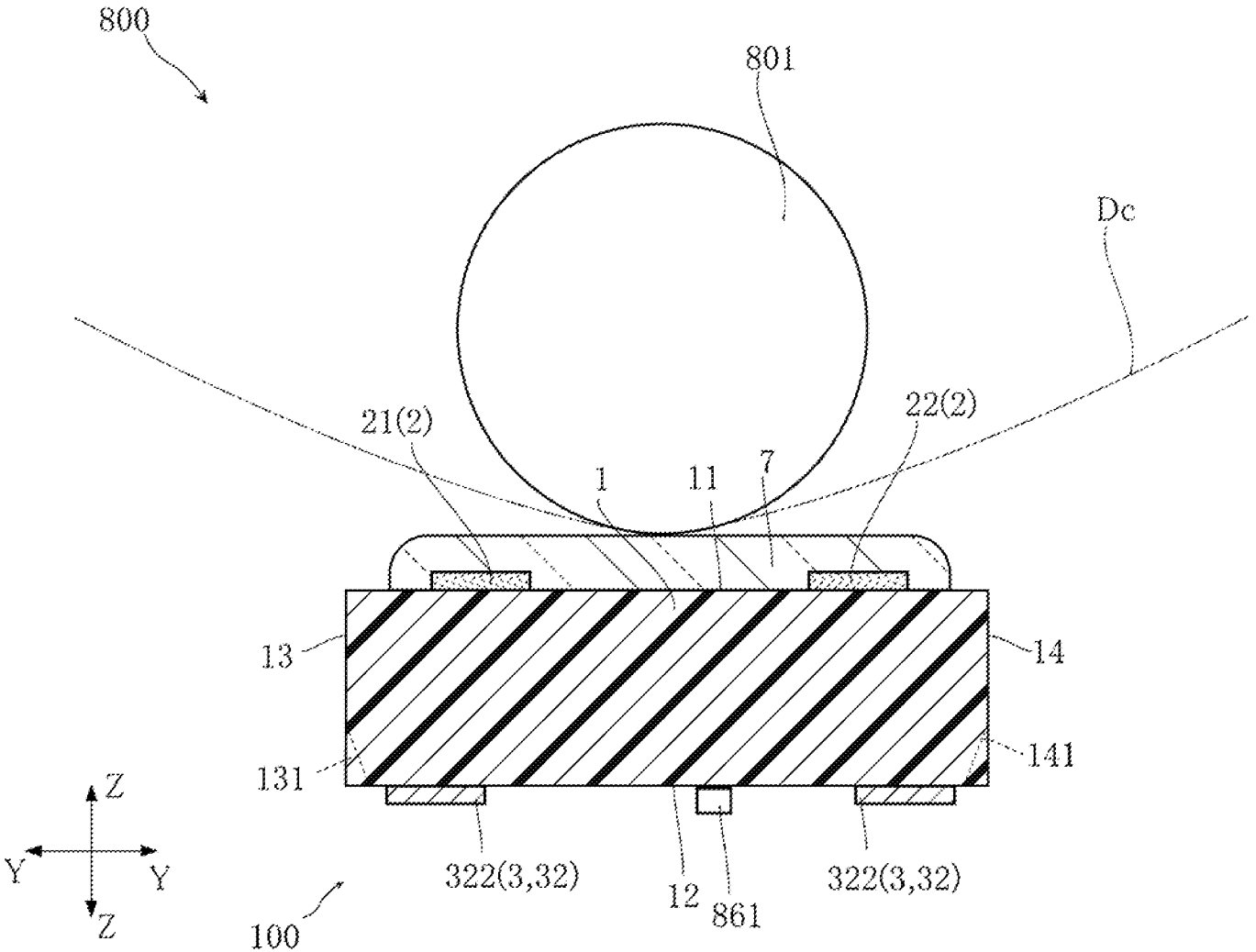
FIG. 1 is a cross-sectional view of an apparatus according to a first embodiment of the present invention.

FIG. 1 is a cross-sectional view of an apparatus according to the first embodiment of the present invention.

An apparatus 800 shown in this figure is used for toner fixing in an office automation device (e.g., an electronic copying machine, a fax machine, or a printer), for example. The apparatus 800 includes a heater 100, a platen roller 801, and a thermistor 861.

The heater 100 opposes the platen roller 801, and toner transferred to a heating target medium Dc is fixed by heat to the heating target medium Dc by the heater 100.

Figure 2:
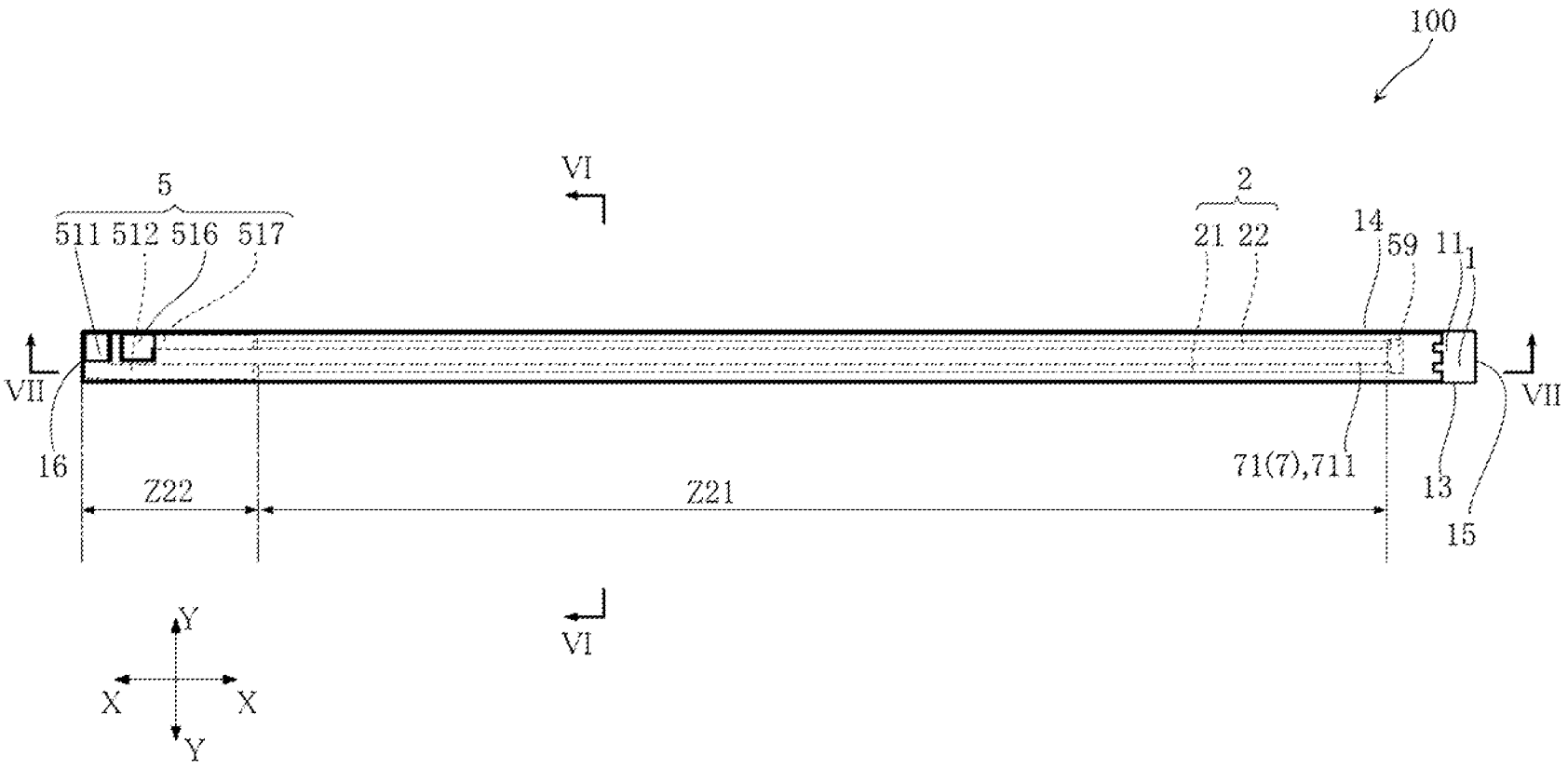
FIG. 2 is a plan view (partially transparent) of a heater according to the first embodiment of the present invention.
Figure 3:
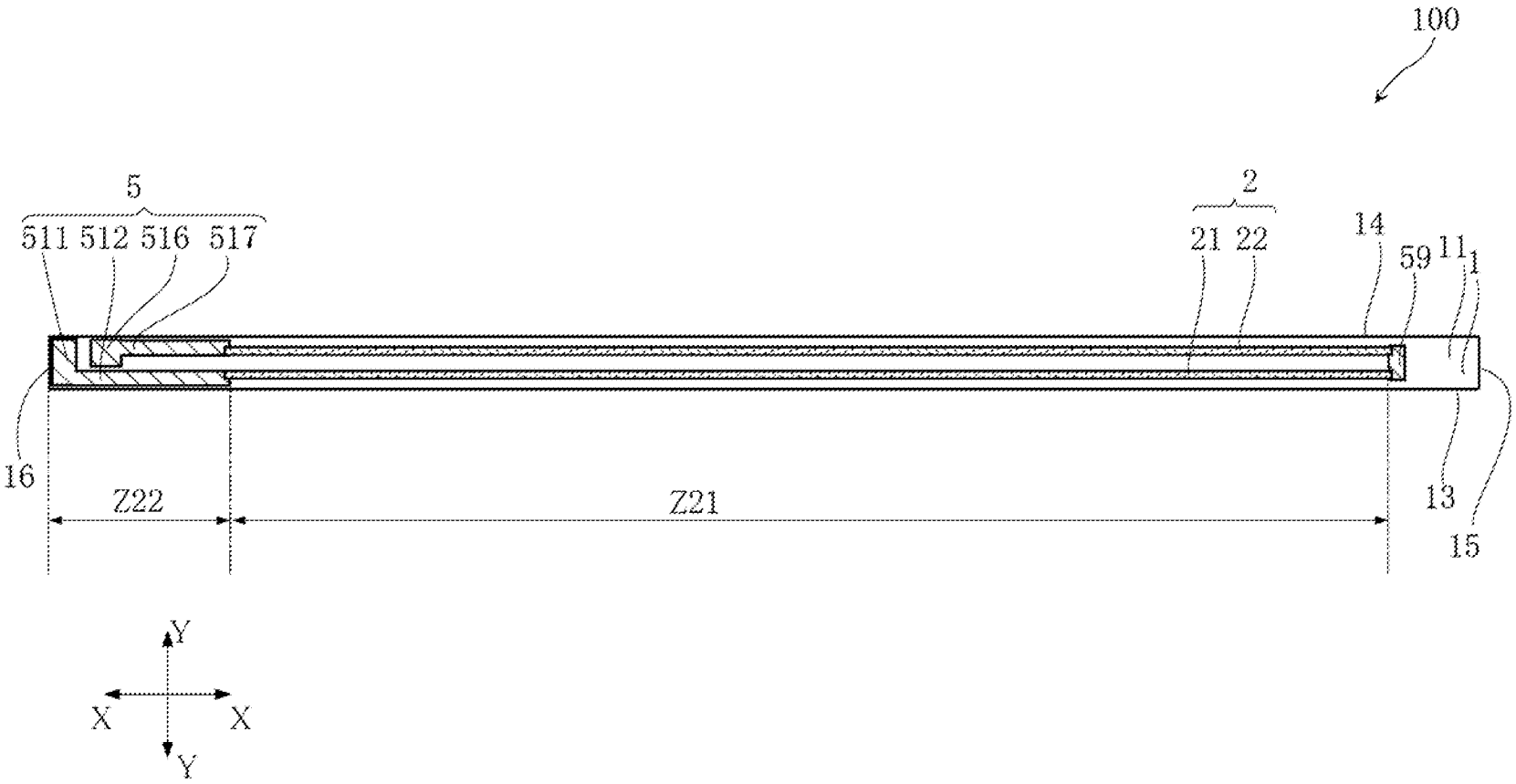
FIG. 3 is a diagram in which a protective layer has been omitted from FIG. 2.
Figure 4:
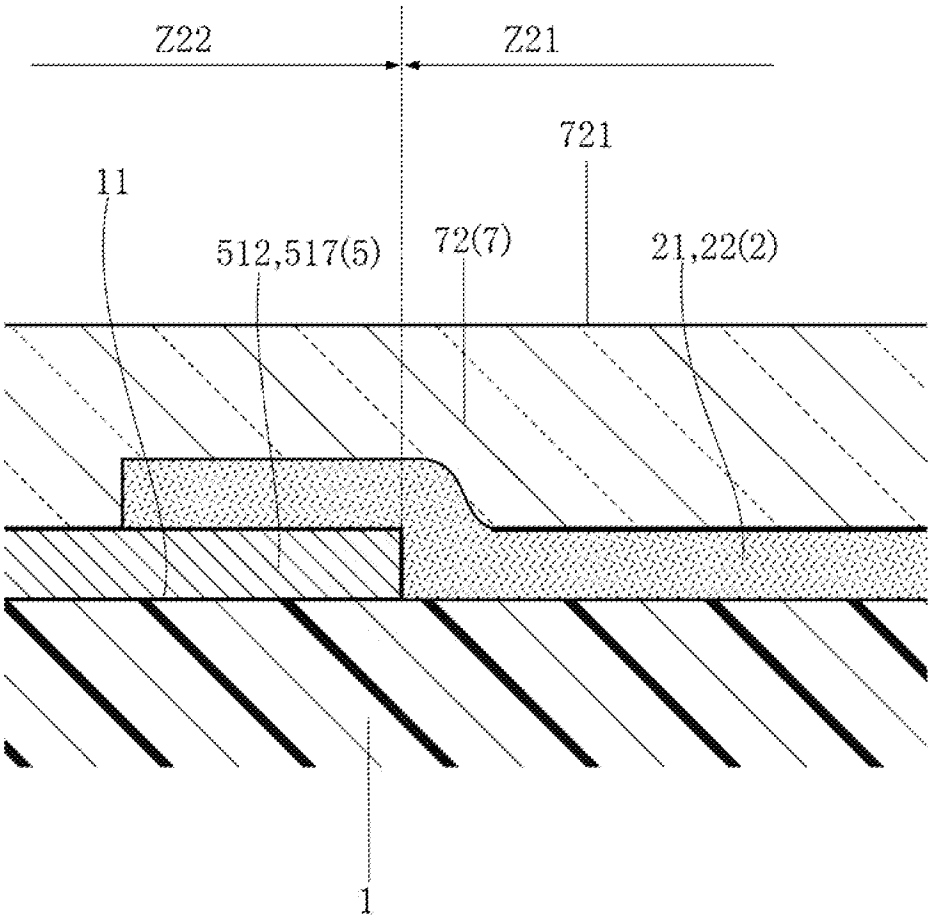
FIG. 4 is a partial enlarged cross-sectional view of the heater shown in FIG. 2.
Figure 5:
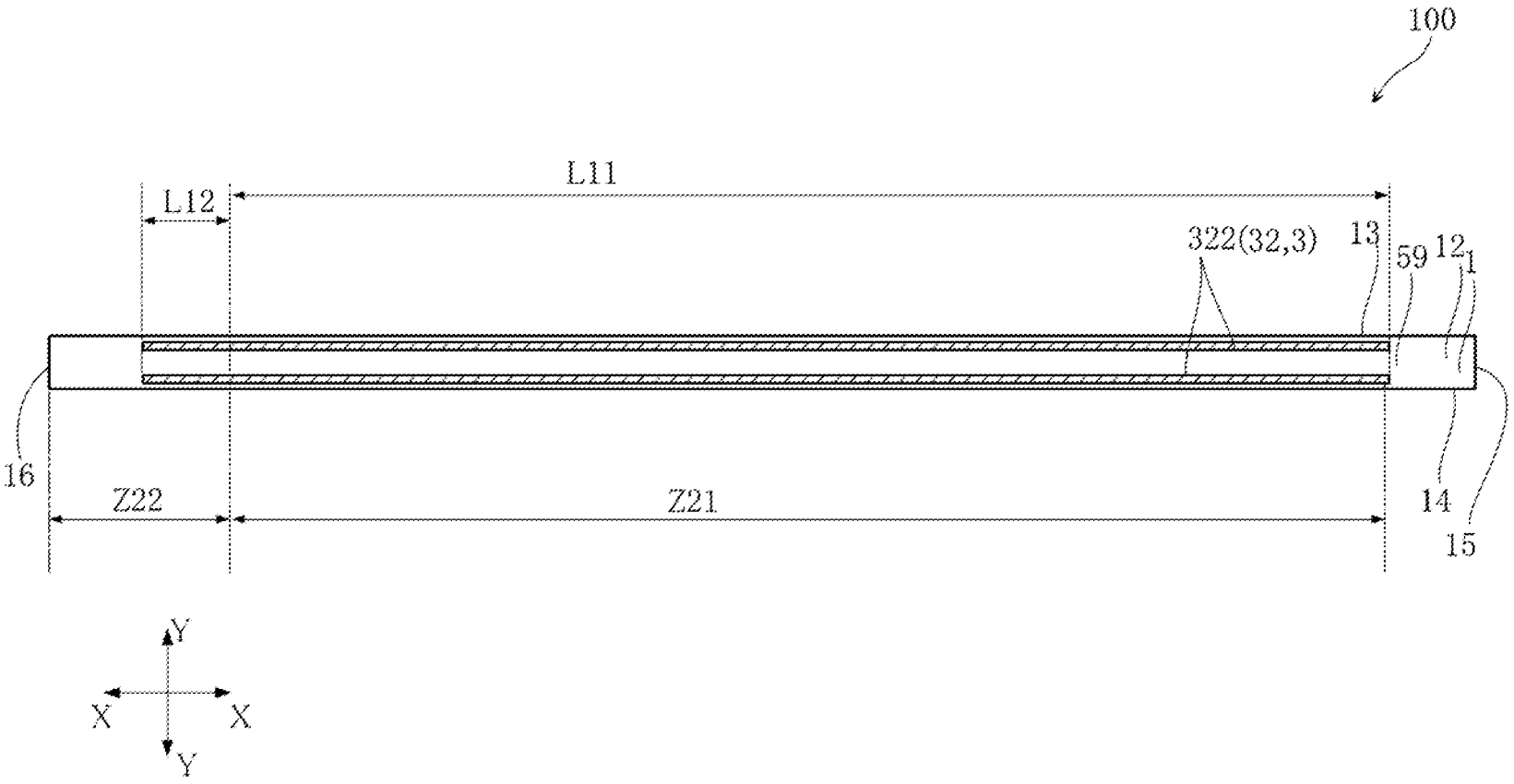
FIG. 5 is a rear view of the heater shown in FIG. 2.
Figure 6:
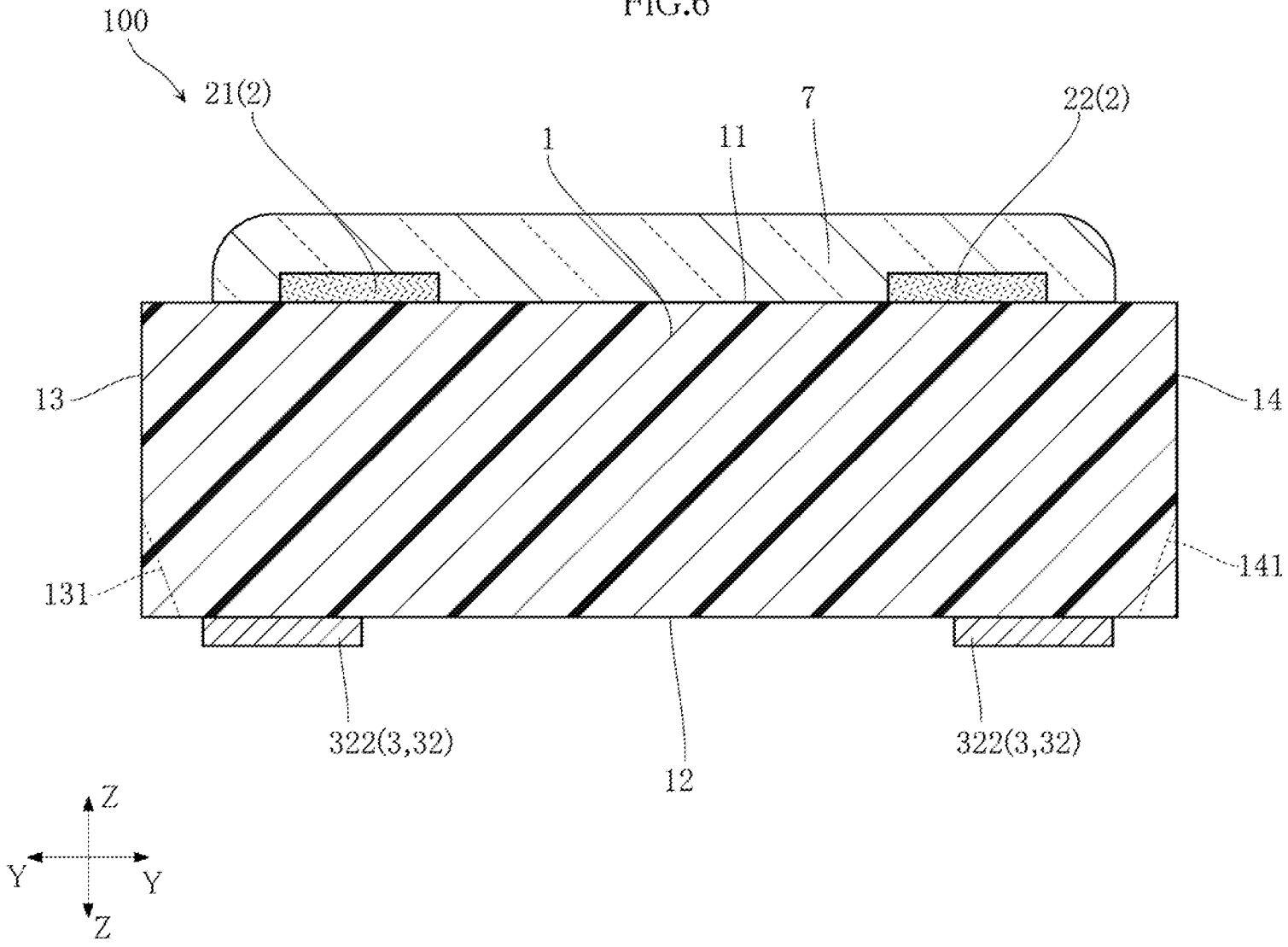
FIG. 6 is a cross-sectional view taken along a line VI-VI in FIG. 2.

FIG. 2 is a plan view (partially transparent) of the heater according to the first embodiment of the present invention. FIG. 3 is a diagram in which a protective layer has been omitted from FIG. 2. FIG. 4 is a partial enlarged cross-sectional view of the heater shown in FIG. 2. FIG. 5 is a rear view of the heater shown in FIG. 2. FIG. 6 is a cross-sectional view taken along a line VI-VI in FIG. 2. FIG. is a cross-sectional view taken along a line VII-VII in FIG. 2.

The heater 100 includes a substrate 1, a heating resistor 2, a heat conducting film 3, a resistor electrode 5, and a protective layer 7.

The substrate 1 shown in FIGS. 1 to 7 is shaped as an elongated plate. The lengthwise direction of the substrate 1 is a lengthwise direction X, the widthwise direction of the substrate 1 is a widthwise direction Y, and the thickness direction of the substrate 1 is a thickness direction Z.

In the present embodiment, the substrate 1 is made of an insulating material. In the present embodiment, the insulating material constituting the substrate 1 is a ceramic. Examples of this ceramic include alumina, zirconia, and aluminum nitride.

It is preferable that the thickness of the substrate 1 is in the range of 0.4 to 1.1 mm, for example. It is further preferable that the thickness of the substrate 1 is in the range of 0.4 to 0.6 mm, for example. If the substrate 1 is made of a material having a low thermal conductivity (e.g., alumina), a low thickness is preferable for the substrate 1.

The substrate 1 has a substrate upper surface 11, a substrate lower surface 12, a first substrate side surface 13, a second substrate side surface 14, a first substrate end surface 15, and a second substrate end surface 16. The substrate upper surface 11, the substrate lower surface 12, the first substrate side surface 13, the second substrate side surface 14, the first substrate end surface 15, and the second substrate end surface 16 are all flat surfaces.

As shown in FIG. 6, the substrate upper surface 11 and the substrate lower surface 12 are located on mutually opposite sides in the thickness direction Z, and face mutually opposite directions. The substrate upper surface 11 faces one side in the thickness direction Z. The substrate lower surface 12 faces the other side in the thickness direction Z. The substrate upper surface 11 and the substrate lower surface 12 are both shaped as elongated rectangles.

Figure 7:
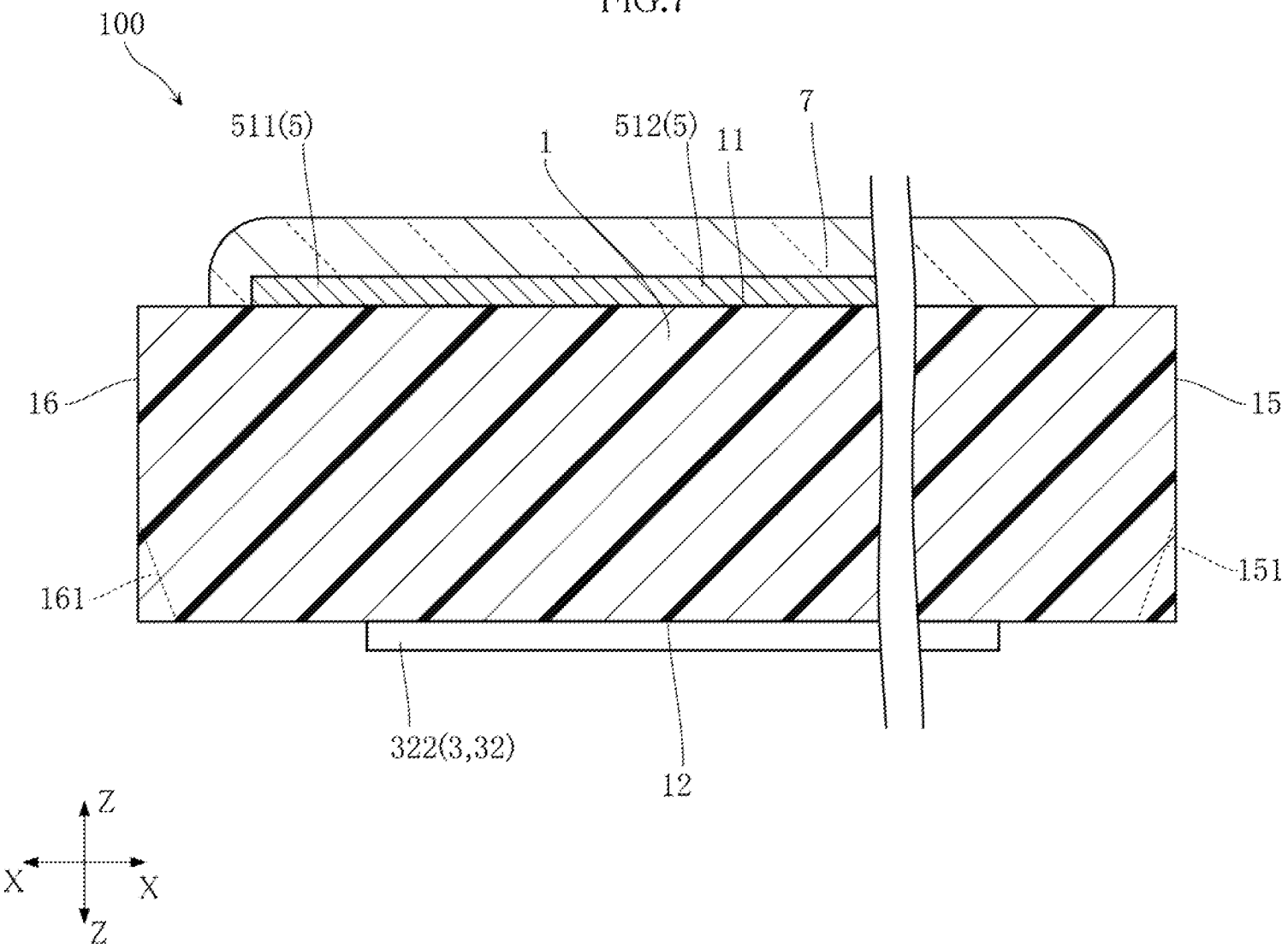
FIG. 7 is a cross-sectional view taken along a line VII-VII in FIG. 2.

The first substrate side surface 13, the second substrate side surface 14, the first substrate end surface 15, and the second substrate end surface 16 shown in FIGS. 2, 6, 7, and the like all face directions that intersect the thickness direction Z of the substrate 1. The first substrate side surface 13, the second substrate side surface 14, the first substrate end surface 15, and the second substrate end surface 16 are all connected to the substrate upper surface 11 and the substrate lower surface 12. The first substrate side surface 13 and the second substrate side surface 14 each extend in an elongated manner, and are located on mutually opposite sides in the widthwise direction Y of the substrate 1. The first substrate side surface 13 is located at one end in the width wise direction Y of the substrate 1. The second substrate side surface 14 is located at the other end in the widthwise direction Y of the substrate 1. The first substrate end surface 15 and the second substrate end surface 16 are located on mutually opposite sides in the lengthwise direction X of the substrate 1. The first substrate end surface 15 is located at one end in the lengthwise direction X of the substrate 1. The second substrate end surface 16 is located at the other end in the lengthwise direction X of the substrate 1.

As shown in FIGS. 6 to 11B, in the present embodiment, multiple cutouts are formed in the substrate 1. These cutouts will be described in detail below.

Figure 8A:
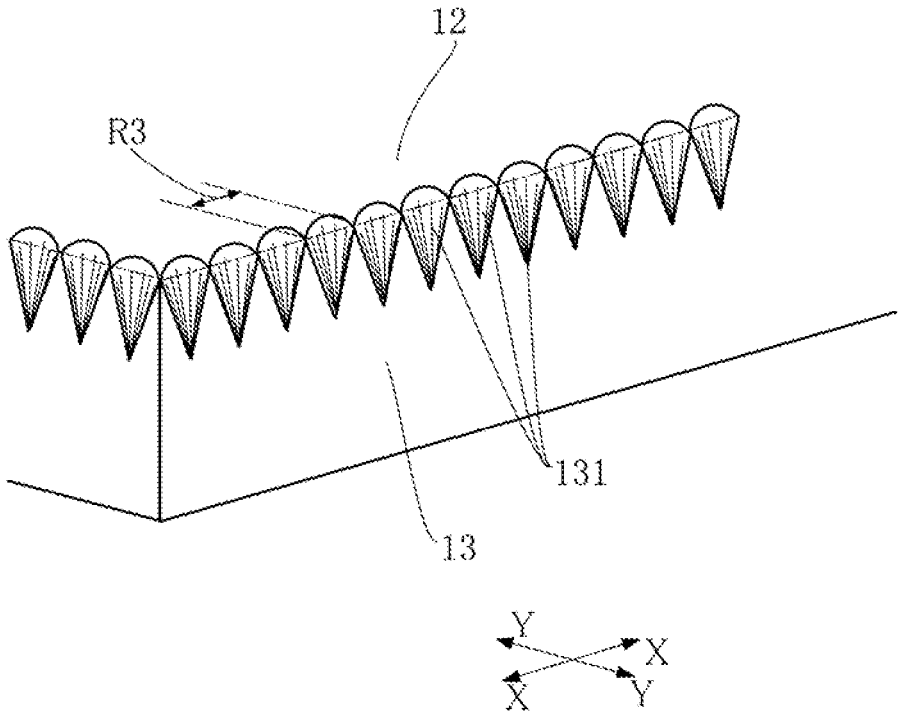
FIG. 8A is a perspective view of only a substrate.
Figure 8B:
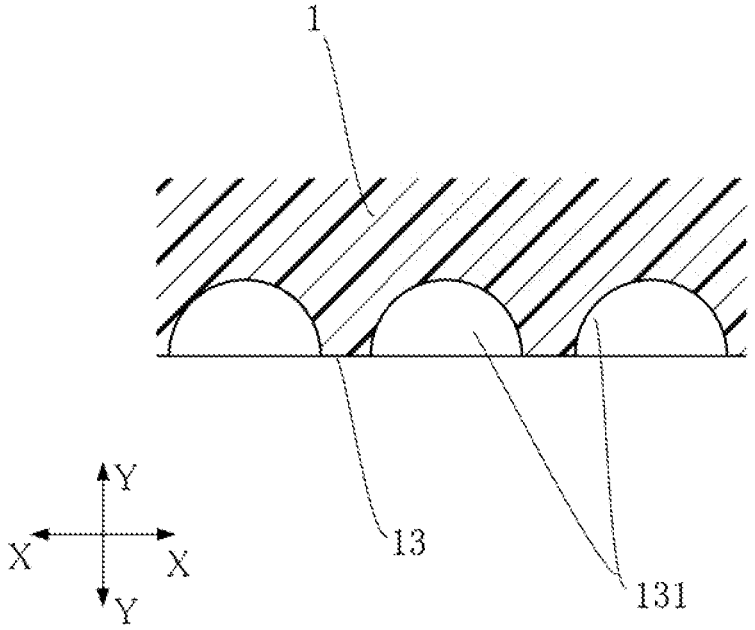
FIG. 8B is a diagram showing the cross-sectional shape of the substrate along a plane orthogonal to the thickness direction of the substrate.

As shown in FIGS. 6, 8A, and 8B, multiple cutouts 131 are formed in the substrate lower surface 12 and the first substrate side surface 13. The cutouts 131 are recessed from the substrate lower surface 12 and the first substrate side surface 13. The cutouts 131 are arranged in a line along the lengthwise direction X. The cutouts 131 each have a semi-circular cross-sectional shape taken along a plane orthogonal to the thickness direction Z, and the diameter of the semi-circle gradually decreases from the substrate lower surface 12 toward the substrate upper surface 11. In other words, the cutouts 131 are each semi-conical. At the substrate lower surface 12, diameters R3 (see FIGS. 8A and 8B) of the semicircles constituting the cutouts 131 are in the range of 40 to 70 μm, for example.

Figure 9A:
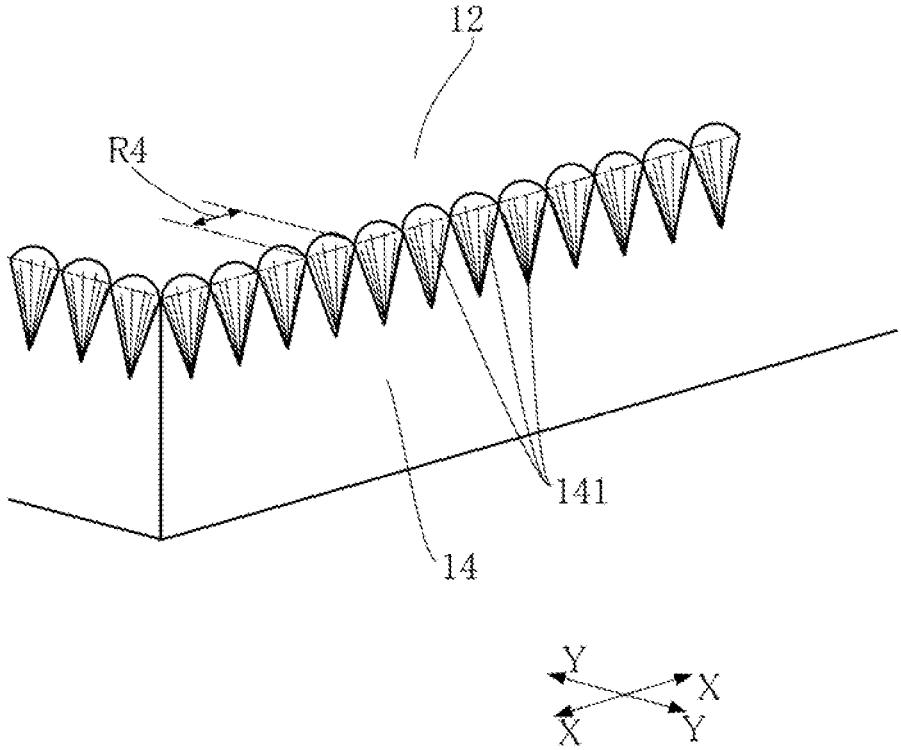
FIG. 9A is a perspective view of only the substrate.
Figure 9B:
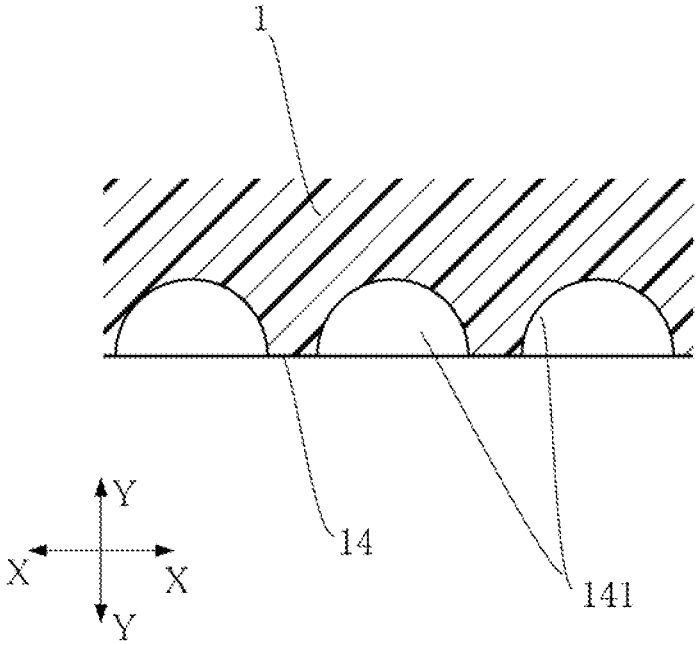
FIG. 9B is a diagram showing the cross-sectional shape of the substrate along a plane orthogonal to the thickness direction of the substrate.

As shown in FIGS. 6, 9A, and 9B, multiple cutouts 141 are formed in the substrate lower surface 12 and the second substrate side surface 14. The cutouts 141 are recessed, from the substrate lower surface 12 and the second substrate side surface 14. The cutouts 141 are arranged in a line along the lengthwise direction X. The cutouts 141 each have a semi-circular cross-sectional shape taken along a plane orthogonal to the thickness direction 2, and the diameter of the semi-circle gradually decreases from the substrate lower surface 12 toward the substrate upper surface 11. In other words, the cutouts 141 are each semi-conical. At the substrate lower surface 12, diameters R4 (see FIGS. 9A and 9B) of the semicircles constituting the cutouts 141 are in the range of 40 to 70 μm, for example.

Figure 10A:
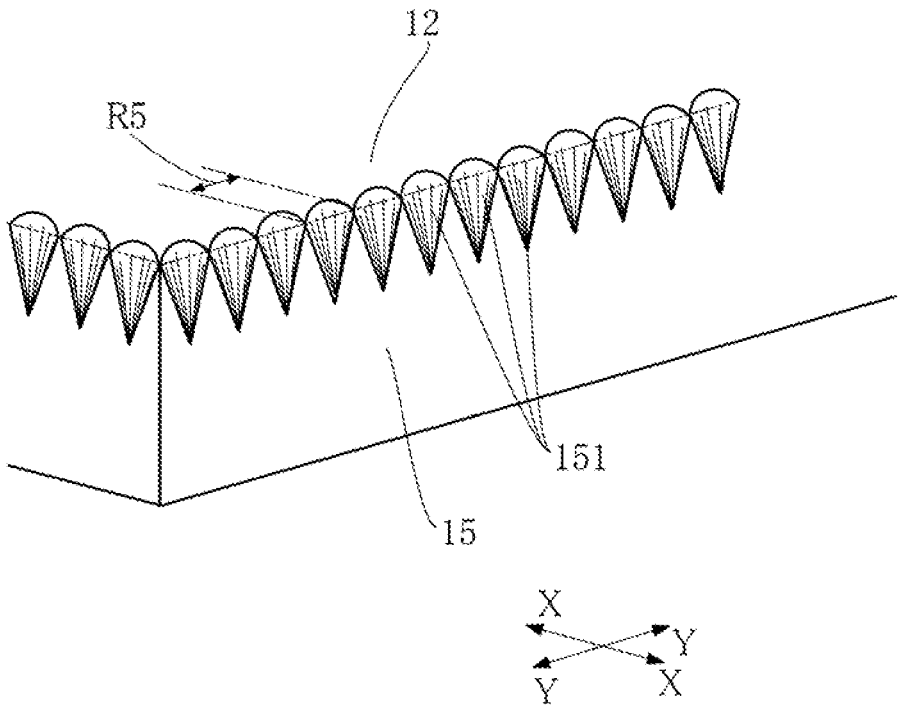
FIG. 10A is a perspective view of only the substrate.
Figure 10B:
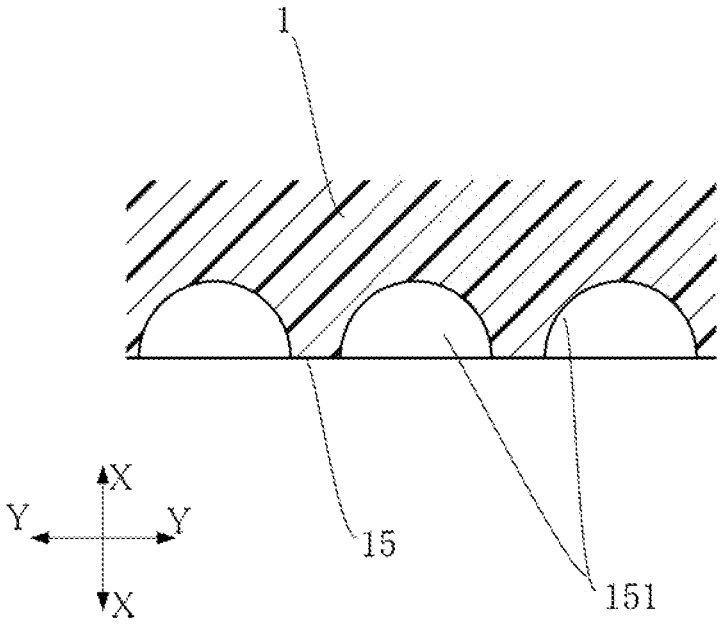
FIG. 10B is a diagram showing the cross-sectional shape of the substrate along a plane orthogonal to the thickness direction of the substrate.

As shown in FIGS. 7, 10A, and 10B, multiple cutouts 151 are formed in the substrate lower surface 12 and the first substrate end surface 15. The cutouts 151 are recessed from the substrate lower surface 12 and the first substrate end surface 15. The cutouts 151 are arranged in a line along the widthwise direction Y. The cutouts 151 each have a semi circular cross-sectional shape taken along a plane orthogonal to the thickness direction Z, and the diameter of the semi-circle gradually decreases from the substrate lower surface 12 toward the substrate upper surface 11. In other words, the cutouts 151 are each semi-conical. At the substrate lower surface 12, diameters R5 (see FIGS. 10A and 10B) of the semicircles constituting the cutouts 151 are in the range of 40 to 70 μm, for example.

Figure 11A:
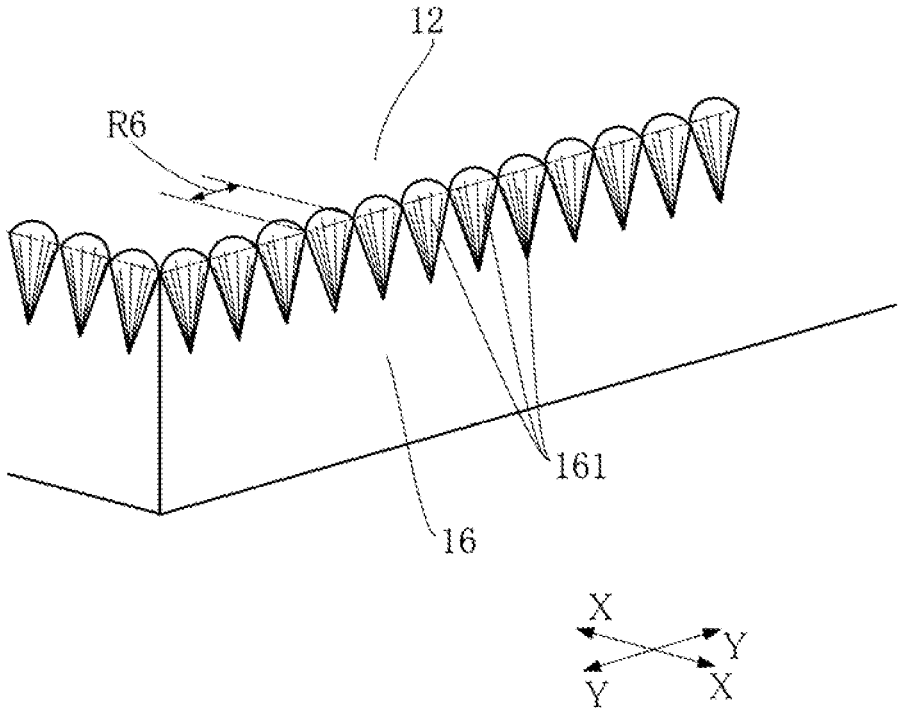
FIG. 11A is a perspective view of only the substrate.
Figure 11B:
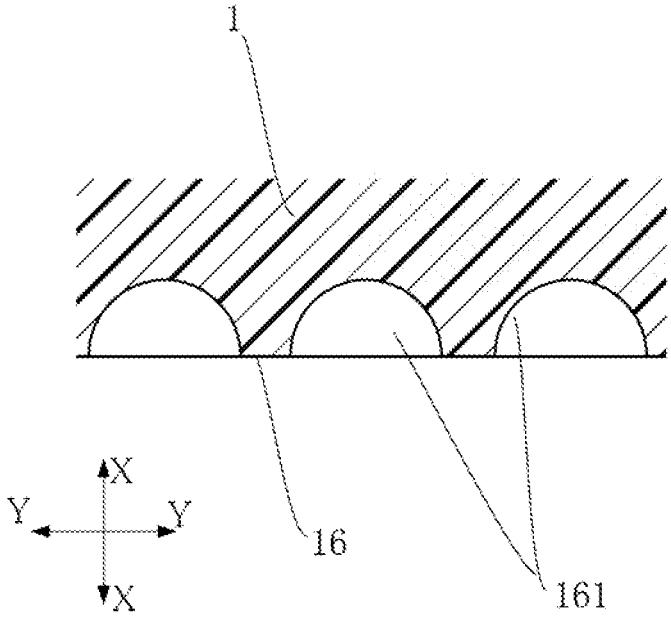
FIG. 11B is a diagram showing the cross-sectional shape of the substrate along a plane orthogonal to the thickness direction of the substrate.

As shown in FIGS. 7, 11A, and 11B, multiple cutouts 161 are formed in the substrate lower surface 12 and the second substrate end surface 16, The cutouts 161 are recessed from the substrate lower surface 12 and the second substrate end surface 16. The cutouts 161 are arranged, in a line along the widthwise direction Y. The cutouts 161 each, have a semicircular cross-sectional shape taken along a plane orthogonal to the thickness direction Z, and the diameter of the semicircle gradually decreases from the substrate lower surface 12 toward the substrate upper surface 11. In other words, the cutouts 161 are each semi-conical. At the substrate lower surface 12, diameters R6 (see FIGS. 11A and 11B) of the semicircles constituting the cutouts 161 are in the range of 40 to 70 μm, for example.

These cutouts (cutouts 131, 141, 151, and 161) are formed in the first, substrate side surface 13, the second substrate side surface 14, the first substrate end surface 15, and the second substrate end surface 16 due to using a laser (YAG laser) when cutting the substrate 1. When cutting the substrate 1, a laser slit is formed by irradiation with a laser beam from the substrate lower surface 12 side. This slit remains as the cutouts in the substrate 1. Note chat the laser diameter of the laser used in the present embodiment is very small. For this reason, the diameters R3 to R6 are very small, that is to say in the range of 40 to 70 μm as described above.

Note that if, in contrast to the present embodiment, a laser is not used when cutting the substrate 1, for example, cutouts do not need to be formed in the first substrate side surface 13, the second substrate side surface 14, the first-substrate end surface 15, and the second substrate end surface 16.

As shown in FIGS. 2 and 3, the substrate 1 includes a heat generating section Z21 and a non-heat generating section Z22. The heat generating section Z21 and the non-heat generating section Z22 will be described later.

The heating resistor 2 shown in FIGS. 1 to 6 is formed on the substrate 1. The heating resistor 2 is in contact with the substrate 1, Note that the phrase "one object is formed on another object" in this specification encompasses not only "the one object is in contact with the other object", but also "the one object is not in contact with the other object". The heating resistor 2 generates heat by the flow of a current therein. The heating resistor 2 is made of a resistor material. One example of the resistor material constituting the heating resistor 2 is AgPd. Other examples of the resistor material constituting the heating resistor 2 include nichrome and ruthenium oxide. The thickness of the heating resistor 2 (dimension in the thickness direction Z) is in the range of 5 to 15 μm, for example. The heating resistor 2 is formed by printing, for example. The heating resistor 2 is formed on the substrate upper surface 11 side of the substrate 1. In the present embodiment, the heating resistor 2 is in contact with the substrate upper surface 11.

As shown in FIGS. 2, 3, and 6, the heating resistor 2 has a first elongated portion 21 and a second elongated portion 22.

The first elongated portion 21 extends in an elongated manner along the lengthwise direction X of the substrate 1. The first elongated portion 21 is formed on one end side of the substrate 1 in the widthwise direction Y (i.e., is formed on the lower side in FIG. 3). The first elongated portion 21 is formed extending from one end to the other end in the lengthwise direction X of the substrate 1. The length of the first elongated portion 21 is greater than or equal to 50%, preferably greater than or equal to 70%, and more preferably greater than or equal to 80% of the dimension of the substrate 1 in the lengthwise direction X. The first elongated portion 21 is in contact with the substrate 1, and is in contact with the substrate upper surface 11 in the present embodiment.

The second elongated portion 22 extends in an elongated manner along the lengthwise direction X of the substrate 1. The second elongated portion 22 is formed on the other end side of the substrate 1 in the widthwise direction Y (i.e., is formed on the upper side in FIG. 3). The second elongated portion 22 is formed extending from one end to the other end in the lengthwise direction X of the substrate 1, The length of the second elongated portion 22 is greater than or equal to 50%, preferably greater than or equal to 70%, and more preferably greater than or equal to 80% of the dimension of the substrate 1 in the lengthwise direction X. The second elongated portion 22 is in contact with the substrate 1, and is in contact with the substrate upper surface 11 in the present embodiment. The second elongated portion 22 and the first elongated portion 21 are separated from each other in the widthwise direction Y of the substrate 1. The second elongated portion 22 and the first elongated portion 21 are parallel to each other.

The resistor electrode 5 shown in FIGS. 2, 3, and the like is formed on the substrate 1. The resistor electrode 5 is in contact with the substrate 1. The resistor electrode 5 is for supplying the heating resistor 2 with electrical power from outside the heater 100. The resistor electrode 5 is made of a conductive material. One example of the conductive material constituting the resistor electrode 5 is Ag. The thickness of the resistor electrode 5 (dimension in the thickness direction Z) is in the range of 5 to 15 μm, for example. The resistor electrode 5 is formed by printing, for example. In the present embodiment, the resistor electrode 5 is formed on the substrate upper surface 11 side of the substrate 1. The resistor electrode 5 is in contact with the substrate upper surface 11. As shown in FIG. 4, a portion of the resistor electrode 5 is overlapped with and in contact with a portion of the heating resistor 2, in the present embodiment, a portion of the resistor electrode 5 is interposed between the heating resistor 2 and the substrate 1. In contrast to the present embodiment, a portion of the heating resistor 2 may be interposed between the resistor electrode 5 and the substrate 1.

As shown in FIGS. 2 and 3, the resistor electrode 5 includes a first resistor pad 511, a first resistor connection portion 512, a second resistor pad 516, and a second resistor connection portion 517.

The first resistor pad 511 is a rectangular portion. Electrical power is supplied to the first resistor pad 511 from outside the heater 100. The first resistor connection portion 512 is connected to the first resistor pad 511, The first resistor connection portion 512 is overlapped with a portion of the heating resistor 2, and is in contact with the heating resistor 2. More specifically, the first resistor connection portion 512 is overlapped with the first elongated portion 21 of the heating resistor 2, and is in contact with the first elongated portion 21 of the heating resistor 2. The first resistor connection portion 512 is shaped as a strip that extends along the lengthwise direction X of the substrate 1.

The second resistor pad 516 is a rectangular portion. Electrical power is supplied to the second resistor pad 516 from outside the heater 100. The second resistor connection portion 517 is connected to the second resistor pad 516. The second resistor connection portion 517 is overlapped with a portion of the heating resistor 2, and is in contact with the heating resistor 2. More specifically, the second resistor connection portion 517 is overlapped with the second, elongated portion 22 of the heating resistor 2, and is in contact with the second elongated port ion 22 of the heating resistor 2. The second resistor connection portion 517 is shaped as a strip that extends along the lengthwise direction X of the substrate 1. The second resistor connection portion 517 is formed so as to be separated from the second resistor pad 516 in the widthwise direction Y of the substrate 1.

Note that a connecting portion 59 that connects the first elongated portion 21 and the second elongated portion 22 is formed in the heater 100. The connecting portion 59 extends along the widthwise direction Y of the substrate 1. The connecting portion 59 connects one end portion of the first elongated portion 21 and one end portion of the second elongated portion 22. The connecting portion 59 is in contact with both the first elongated port ion 21 and the second elongated portion 22. The connecting portion 59 is formed, on the side of the heating resistor 2 opposite to the first resistor pad 511.

As described above, the substrate 1 includes the heat generating section Z21 and the non-heat, generating section Z22 (see FIGS. 2 to 5 for example).

The heat generating section Z21 is a section that is overlapped with, out of the heating resistor 2 and the resistor electrode 5, only the heating resistor 2 in the lengthwise direction X of the substrate 1. In the present embodiment, as shown in FIG. one end portion of the first resistor connection portion 512 is located at the boundary between the heat generating section Z21 and the non-heat generating section Z22. Similarly, one end portion of the second resistor connection portion 517 is located at the boundary between the heat generating section Z21 and the non-heat generating section Z22.

The non-heat generating section Z22 is a section that is different from the heat generating section Z21. The non-heat generating section Z22 is adjacent to the heat generating section Z21 in the lengthwise direction X. In the present embodiment, the first resistor pad 511, the first resistor connection portion 512, the second resistor pad 516, and the second resistor connection portion 517 are located in the non-heat generating section Z22.

As shown in FIG. 5, the heat conducting film 3 is formed on the substrate 1. Specifically, the heat conducting film 3 is formed on the substrate 1 so as to extend from the heat generating section Z21 into the non-heat generating section Z22. In the present embodiment, the heat conducting film 3 is formed on end portions, in the widthwise direction Y of the substrate 1, of the substrate 1. As shown in FIG. 6, the heat conducting film 3 has portions that are formed more toward the end portions in the widthwise direction Y of the substrate 1 than the heating resistor 2 is, in a view along the thickness direction Z of the substrate 1. It is preferable that a dimension L11 (see FIG. 5), in the lengthwise direction X, of the portion of the heat conducting film 3 that is formed in the heat generating section Z21 is greater than or equal to 5 mm. Similarly, it is preferable that a dimension L12 (see FIG. 5), in the lengthwise direction X, of the portion of the heat conducting film 3 that is formed in the non-heat generating section Z22 is greater than or equal to 5 mm.

The heat conducting film 3 is made of a material that has a higher thermal conductivity than the thermal conductivity of the material constituting the substrate 1. In the present embodiment, the heat conducting film 3 is made of a metal. Examples of the metal constituting the heat conducting film 3 include Ag, AgPt, Au, and Cu. The thickness of the heat conducting film 3 is in the range of 10 to 20 μm, for example.

In the present embodiment, the heat conducting film 3 has a lower surface portion 32.

The lower surface portion 32 is formed on the substrate lower surface 12 of the substrate 1. In the present embodiment, the lower surface portion 32 is in contact with the substrate lower surface 12 of the substrate 1. In the present embodiment the lower surface portion 32 has multiple lower surface elements 322. These lower surface elements 322 are separated from each other. The lower surface elements 322 are each formed so as to extend from the heat generating section Z21 into the non-heat generating section Z22. In the present embodiment, the lower surface elements 322 are each shaped as a strip that extends along the lengthwise direction X.

The protective layer 7 shown in FIGS. 1, 2, 6, 7, and the like covers the heating resistor 2. Also, the protective layer 7 is in contact with the heating resistor 2. Furthermore, the protective layer 7 covers a portion of the resistor electrode 5. Specifically, the protective layer 7 covers the first resistor connection portion 512 and the second resistor connection portion 517. The resistor electrode 5 is partially exposed from the protective layer 7. Specifically, the first resistor pad 511 and the second resistor pad 516 are exposed from the protective layer 7. The protective layer 7 is made of a glass or a polyimide, for example.

As shown in FIG. 1, in the apparatus 800, the substrate upper surface 11 side of the substrate 1 is located adjacent to the platen roller 801. For this reason, the heating resistor 2 is located between the substrate 1 and the platen roller 801. On the other hand, the thermistor 861 is arranged on the substrate lower surface 12, and detects the temperature of the substrate 1.

Next, operation effects of the present embodiment will be described.

Figure 12:
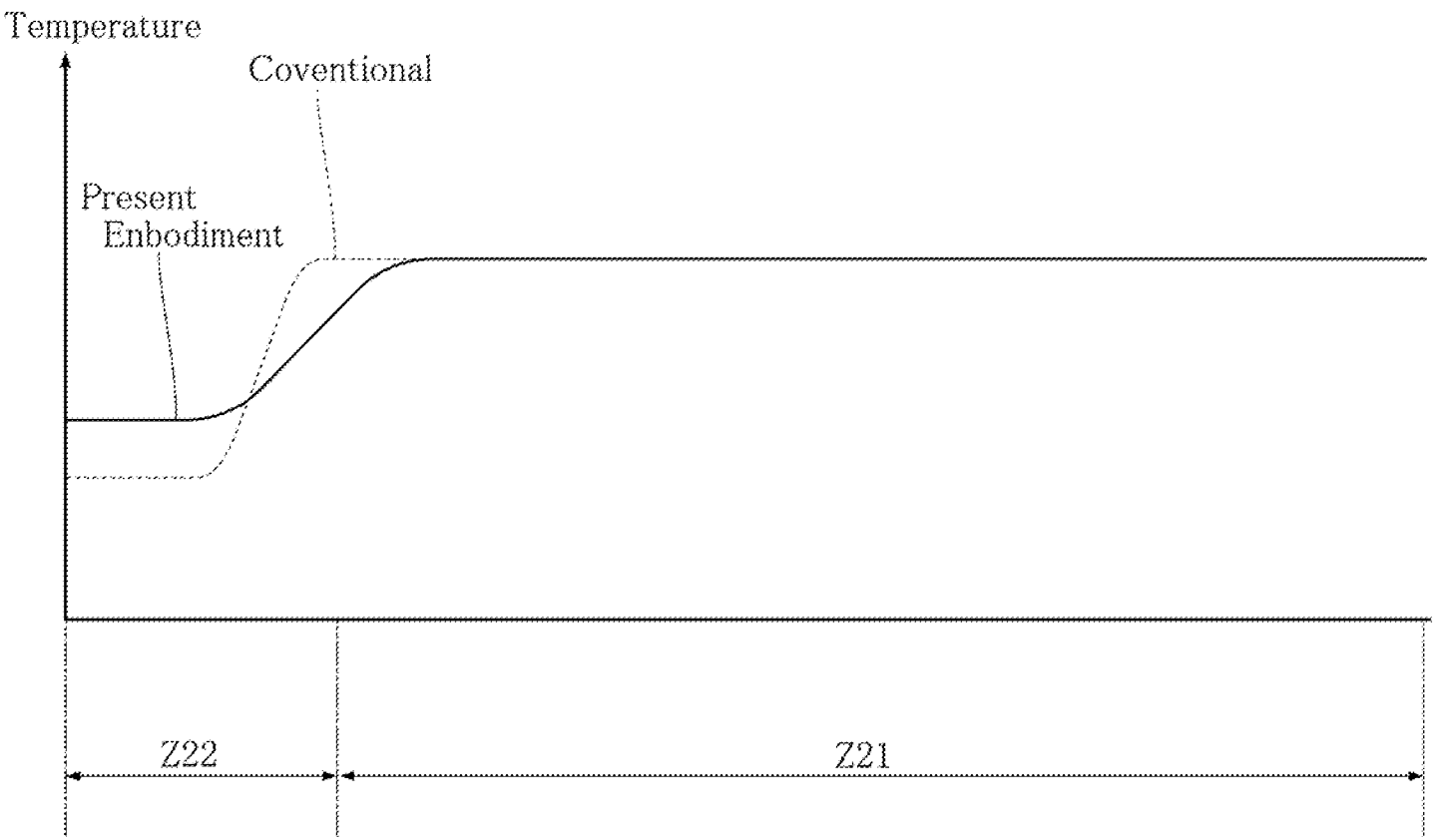
FIG. 12 is a graph showing a temperature distribution of the heater shown in FIG. 2 and a temperature distribution of a conventional heater.

FIG. 12 is a graph showing the temperature distribution of the heater according to the present embodiment, and the temperature distribution of a conventional heater. In this graph, the vertical axis indicates the temperature, and the horizontal axis indicates the position in the lengthwise direction X.

In FIG. 12, the temperature during use of the conventional heater is schematically illustrated using a dashed line. The temperature gradient from the heat generating section Z21 to the non-heat generating section Z22 is very high in this figure. If the temperature gradient from the heat generating section Z21 to the non-heat generating section Z22 is very high, the extent of thermal expansion in the widthwise direction Y tends to be greatly different, between the heat generating section Z21 and the non-heat generating section Z22. Accordingly, there is a risk of the substrate 1 cracking in the vicinity of the boundary between the heat generating section Z21 and the non-heat generating section Z22.

However, in the present embodiment, the heater 100 includes the heat conducting film 3. The heat conducting film 3 is formed on the substrate 1 so as to extend from the heat generating section Z21 into the non-heat generating section Z22. According to this configuration, heat in the heat generating section Z21 is easily transmitted to the non-heat generating section Z22. This makes it possible to reduce the temperature gradient from the heat generating section Z21 to the non-heat generating section Z22. As shown by the solid line in FIG. 12, the temperature gradient between the heat generating section Z21 and the non-heat generating section Z22 is smaller than in the conventional heater. Reducing the temperature gradient between the heat generating section Z21 and the non-heat generating section Z22 in this way reduces the difference in thermal expansion in the widthwise direction Y between the heat generating section Z21 and the non-heat generating section Z22. This makes it possible to prevent cracking of the substrate 1 in the vicinity of the boundary between the heat generating section Z21 and the non-heat generating section Z22.

In particular, in the case where the substrate 1 is made of a material that has a low thermal conductivity (e.g., alumina), the temperature gradient between the heat generating section Z21 and the non-beat generating section Z22 tends to foe high if the heat conducting film 3 is not formed. For this reason, the configuration of the present embodiment is particularly useful in the case where the substrate 1 is made of a material that has a low thermal conductivity (e.g., alumina).

When the heater 100 is used, the end portions of the substrate 1 in the widthwise direction Y are easily influenced by thermal expansion. In the present embodiment, the heat conducting film 3 is formed on end portions, in the widthwise direction Y of the substrate 1, of the substrate 1. This makes it possible to more effectively prevent cracking of the substrate 1 in the vicinity of the boundary between the heat generating section Z21 and the non-heat generating section Z22.

In the present, embodiment, the heat, conducting film 3 has portions that are formed more toward the end portions in the widthwise direction X of the substrate 1 than the heating resistor 2 is, in a view along the thickness direction of the substrate 1. With this configuration as well, it is possible to more effectively prevent cracking of the substrate 1 in the vicinity of the boundary between the heat generating section Z21 and the non-heat generating section Z22.

In the present embodiment, the diameters R3 to R6 of the semicircles constituting the cutouts 131, 141, 151, and 161 at the substrate lower surface 12 are in the range of 40 to 70 μm, which is very small. This configuration is obtained as a result of cutting the substrate 1 with a YAG laser. According to this configuration, reducing the size of the groove formed by laser processing makes it possible to disperse thermal stress that arises during high-temperature heating, and thus resistance to heat is improved. Also, cracking of the substrate 1 can be prevented with this configuration as well.

When the heater 100 is used, the heating resistor 2 undergoes thermal expansion in addition to the substrate 1. The resistance to stress is low at the locations where cutouts (the cutouts 131 and the cutouts 141) are formed. For this reason, if the heating resistor 2 is formed on the substrate lower surface 12, there is a risk of formation of a crack in the substrate 1, starting at a cutout, due to stress arising from thermal expansion. However, in the present embodiment, the heating resistor 2 is formed on the substrate upper surface 11. According to this configuration, the heating resistor 2 can foe separated a farther distance from cutouts (the cutouts 131 and the cutouts 141), thus making it possible to prevent cracking of the substrate 1 caused by thermal expansion.

Although the platen roller 801 is arranged on the substrate upper surface 11 side of the substrate 1 in the apparatus 800 in the above description, the platen roller 801 may be arranged on the substrate lower surface 12 side. In other words, the heater 100 may be used in the state of being turned upside down relative to the state shown in FIG. 1. In this case, it is sufficient for the thermistor 861 to be arranged on the protective layer 7, for example.

First Variation of First Embodiment

Figure 13:
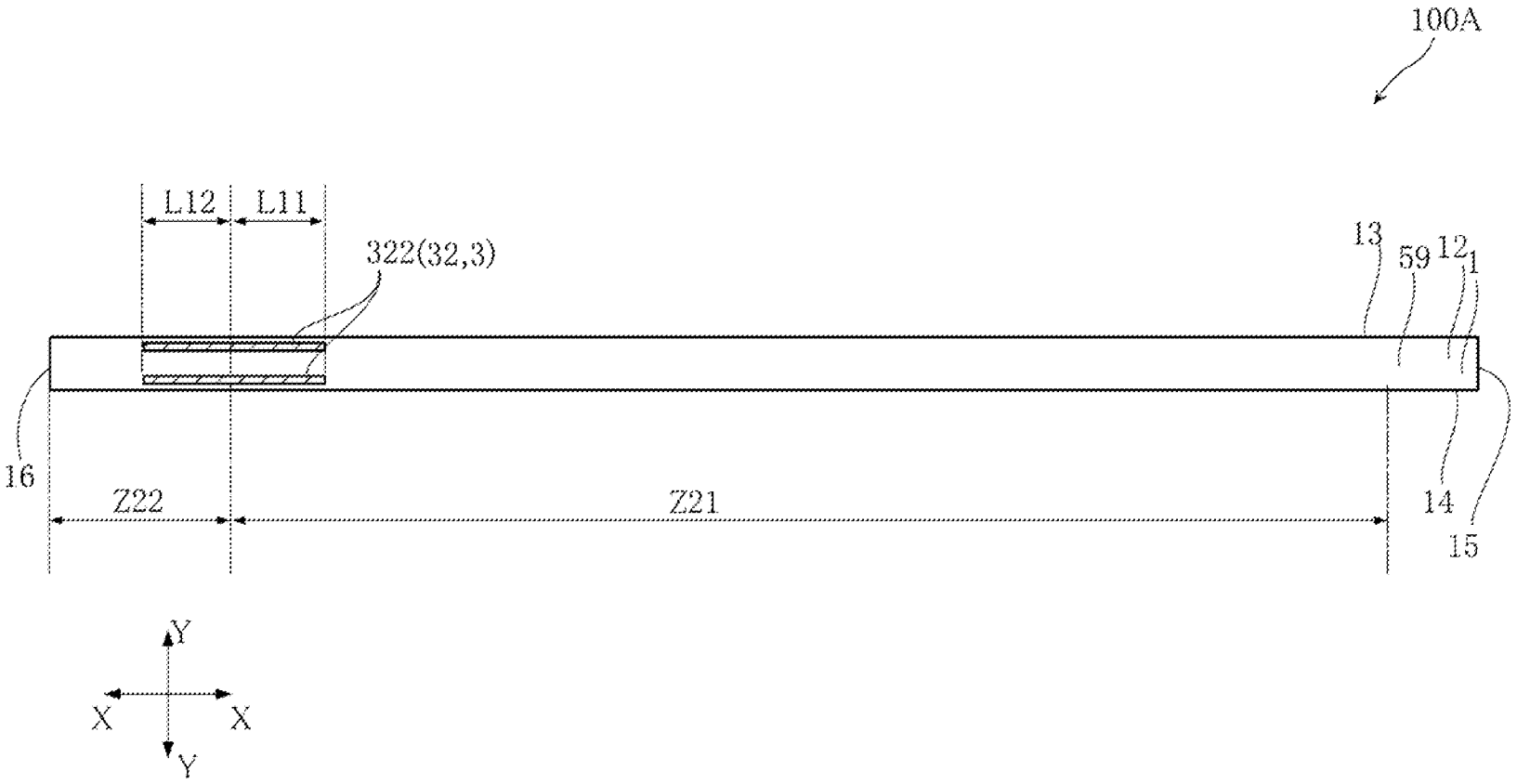
FIG. 13 is a rear view of a heater according to a first variation of the first embodiment of the present invention.

The following describes a first variation of the first embodiment of the present invention with reference to FIG. 13.

FIG. 13 is a rear view of a heater according to the first variation of the first embodiment of the present invention.

Note that in the following description, configurations that are the same as or similar to configurations in the above description will be denoted by the same reference numbers as above, and descriptions thereof will be omitted as appropriate.

In a heater 100A shown in this figure, the shape of the heat conducting film 3 (specifically, the shape of the lower surface portion 32) is different from the shape in the heater 100, but other aspects are similar to the neater 100.

In the present variation, the dimension, in the lengthwise direction X, of the lower surface portion 32 of the heat conducting film 3 is shorter than in the heater 100. Note that in the present variation as well, it is preferable that the dimension L11, in the lengthwise direction X, of the portion of the heat conducting film 3 that is formed in the heat generating section Z21 is greater than or equal to 5 mm.

Operation effects similar to the operation effects of the heater 100 are achieved with this configuration as well.

Second Variation of First Embodiment

Figure 14:
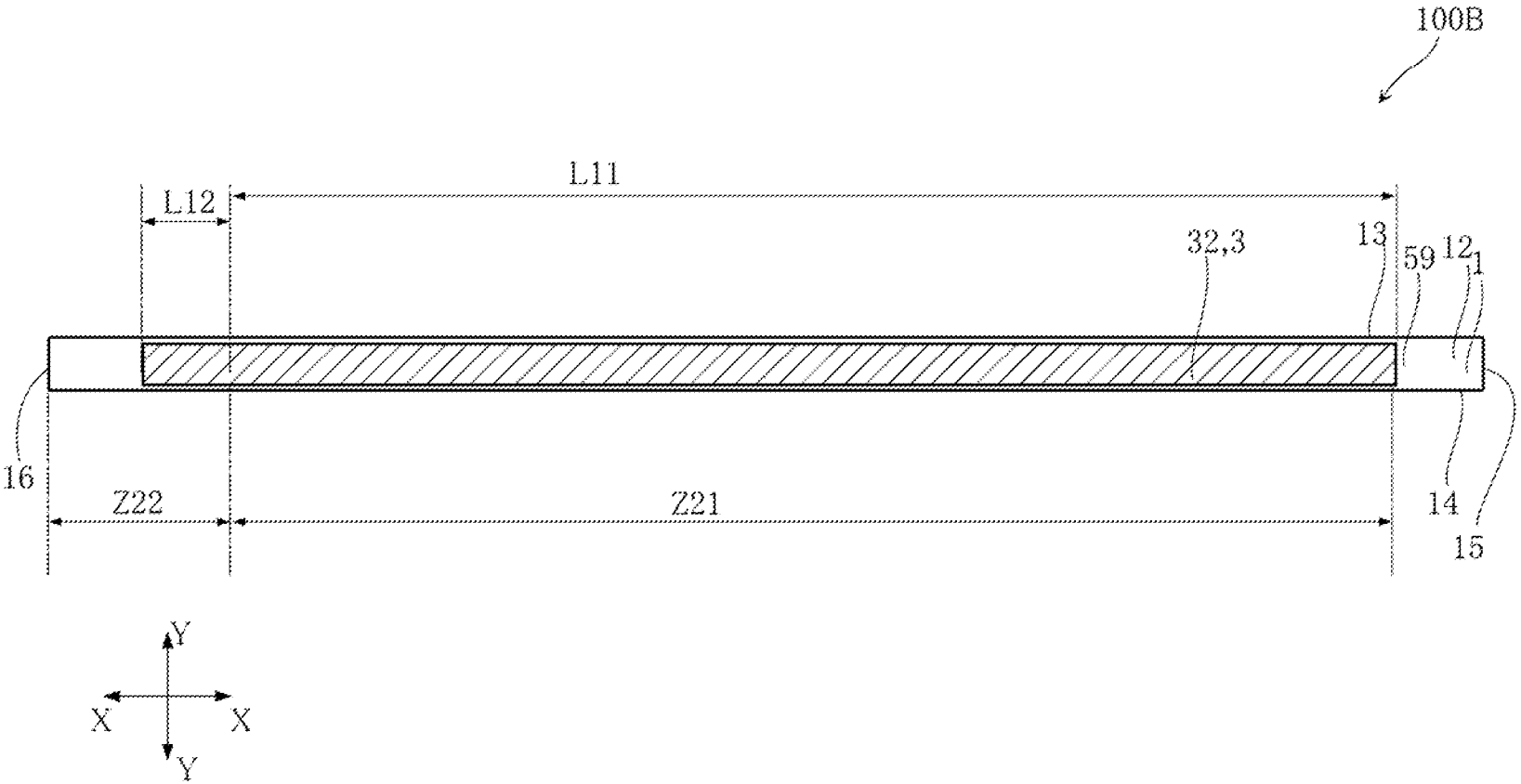
FIG. 14 is a rear view of a heater according to a second variation of the first embodiment of the present invention.

The following describes a second variation of the first embodiment of the present invention with reference to FIG. 14.

FIG. 14 is a rear view of a heater according to the second variation of the first embodiment of the present invention.

In a heater 100B shown in this figure, the shape of the heat conducting film 3 (specifically, the shape of the lower surface portion 32) is different from the shape in the heater 100, but other aspects are similar to the heater 100.

In the present variation, the heater 100B is different from the heater 100 in that the lower surface portion 32 does not have multiple lower surface elements 322, and instead is shaped as one sheet, but other aspects are similar to the heater 100. In the present variation, the dimension of the lower surface portion 32 in the widthwise direction Y is greater than or equal to half of the dimension of the substrate 1 in the widthwise direction Y.

Operation effects similar to the operation effects of the heater 100 are achieved with this configuration as well.

Second Embodiment

Figure 15:
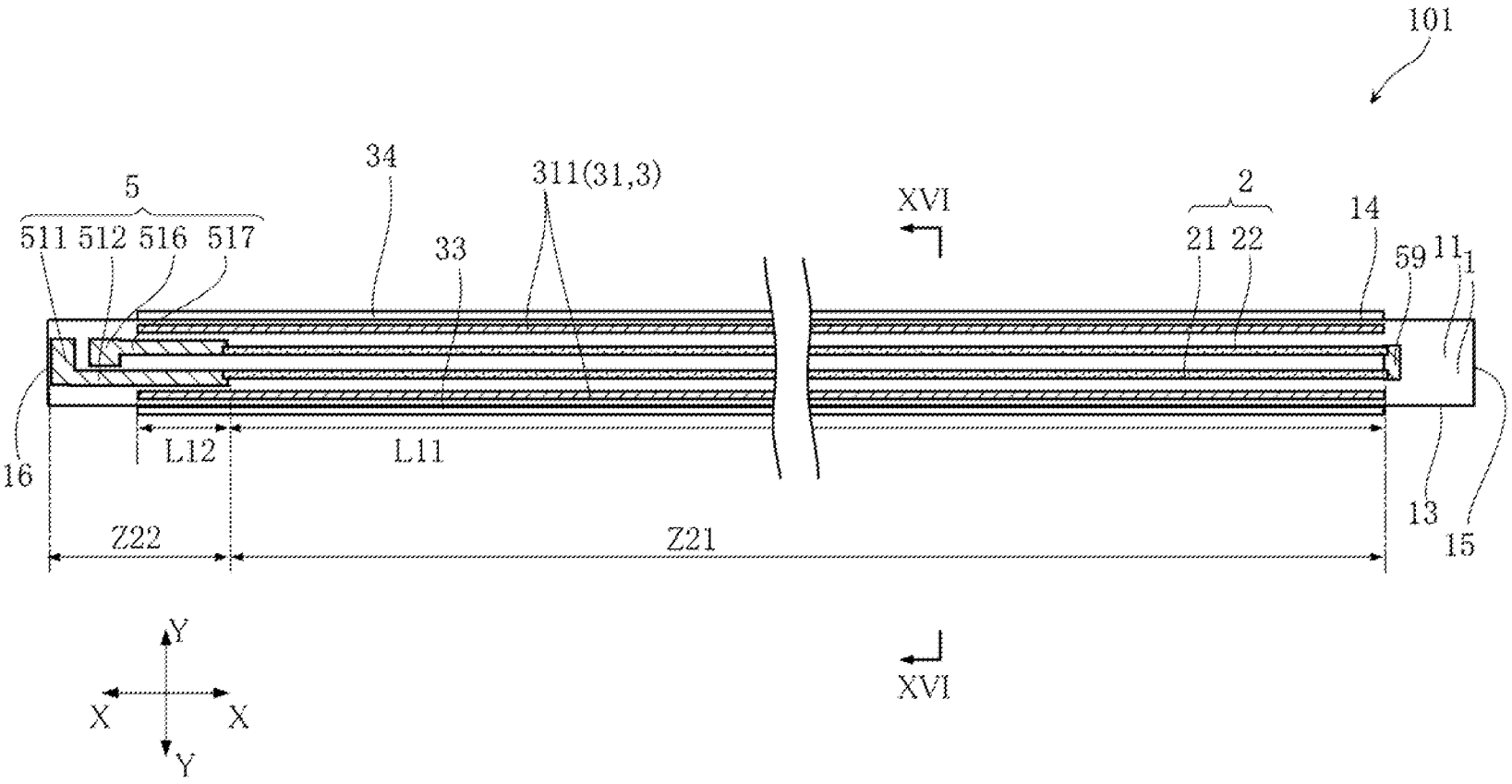
FIG. 15 is a plan view (without the protective layer) of a heater according to a second embodiment of the present invention.
Figure 16:
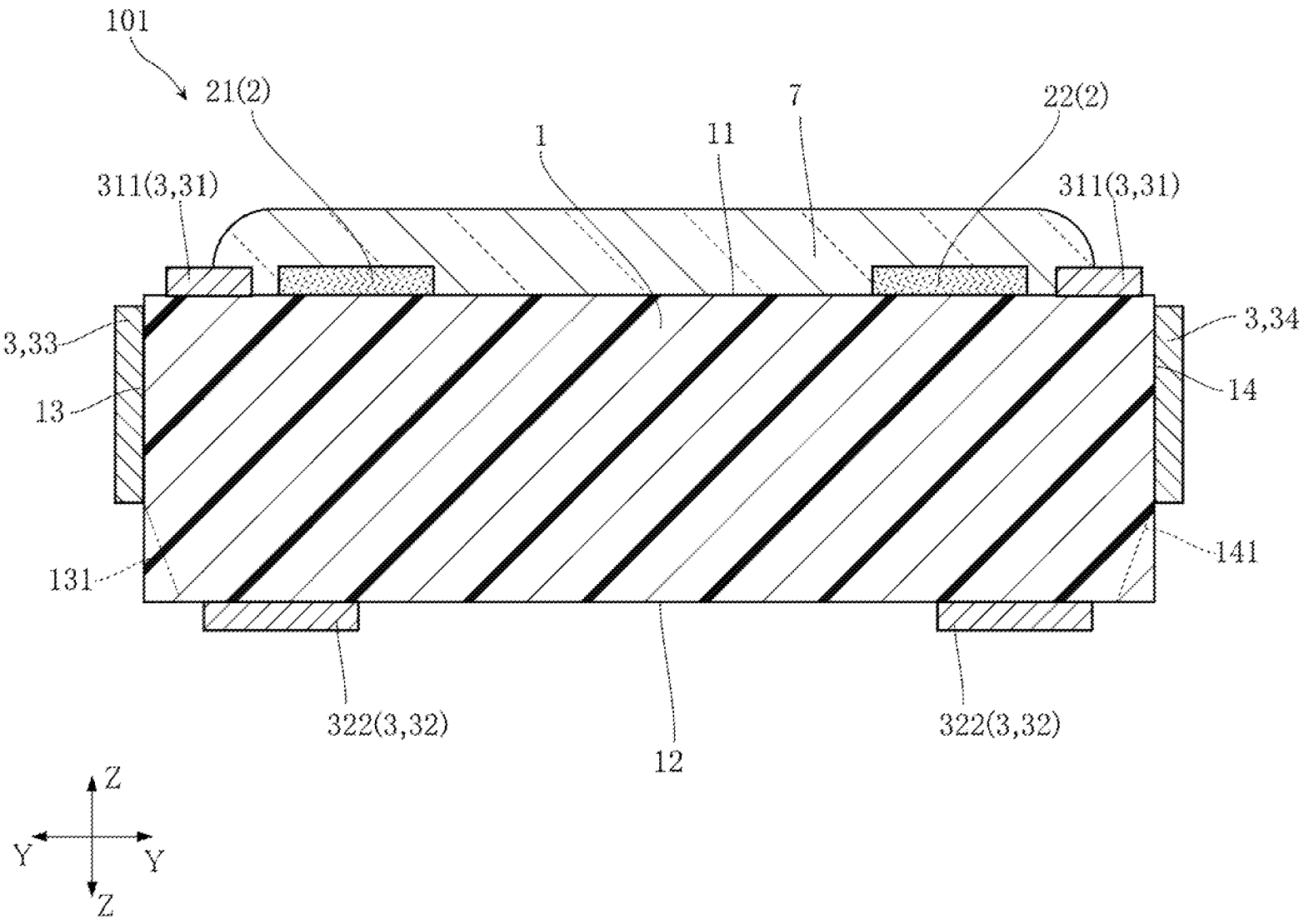
FIG. 16 is a cross-sectional view taken along a line XVI-XVI in FIG. 15.

The following describes a second embodiment of the present invention with reference to FIGS. 15 and 16.

FIG. 15 is a plan view (without the protective layer) of a heater according to the second embodiment of the present invention. FIG. 16 is a cross-sectional view taken along a line XVI-XVI in FIG. 15.

A heater 101 shown in these figures is different from the heater 100 in that the heat conducting film 3 further includes an upper surface portion 31, a first side surface portion 33, and a second side surface portion 34. The lower surface portion 32 will not be described, due to being similar to that in the heater 100.

The upper surface portion 31 is formed on the substrate upper surface 11 of the substrate 1. In the present embodiment, the upper surface portion 31 is in contact with the substrate upper surface 11 of the substrate 1. The upper surface portion 31 is formed at a different position from the heating resistor 2 on the substrate upper surface 11. In the present embodiment, the upper surface portion 31 has multiple upper surface elements 311. These upper surface elements 311 are separated from each other. The upper surface elements 311 are each formed so as to extend from the heat generating section Z21 into the non-heat generating section Z22. In the present embodiment, the upper surface elements 311 are each shaped as a strip that extends along the lengthwise direction X. In the present embodiment, the upper surface element 311 located on the lower side in FIG. 15 is located between the first elongated portion 21 and the first substrate side surface 13, and the upper surface element 311 located on the upper side in FIG. 15 is located between the second elongated portion 22 and the second substrate side surface 14.

Note that in contrast to the present embodiment, the upper surface portion 31 may be relatively short, as with the lower surface portion 32 in the heater 100A. Also, the upper surface portion 31 does not need to have multiple upper surface elements 311. For example, the shape of the upper surface portion 31 in a plan view may be a shape similar to that of the lower surface portion 32 in the heater 100B.

The first side surface portion 33 is formed on the first substrate side surface 13. The first side surface portion 33 is in contact with the first substrate side surface 13. The first side surface portion 33 has a shape extending along the lengthwise direction X. The first side surface portion 33 is formed so as to extend from the heat generating section Z21 into the non-heat generating section Z22. The first side surface portion 33 is not connected to the upper surface portion 31 or the lower surface portion 32. In contrast to the present embodiment, the first side surface portion 33 may be connected to the upper surface portion 31 and/or the lower surface portion 32.

The second side surface portion 34 is formed on the second substrate side surface 14. The second side surface portion 34 is in contact with the second substrate side surface 14. The second side surface portion 34 has a shape extending along the lengthwise direction X. The second side surface portion 34 is formed so as to extend from, the neat generating section Z21 into the non-heat generating section Z22. The second side surface portion 34 is not connected to the upper surface portion 31 or the lower surface portion 32. In contrast to the present embodiment, the second side surface portion 34 may be connected to the upper surface portion 31 and/or the lower surface portion 32.

Operation effects similar to the operation effects of the heater 100 are achieved with the present embodiment as well.

Third Embodiment

Figure 17:
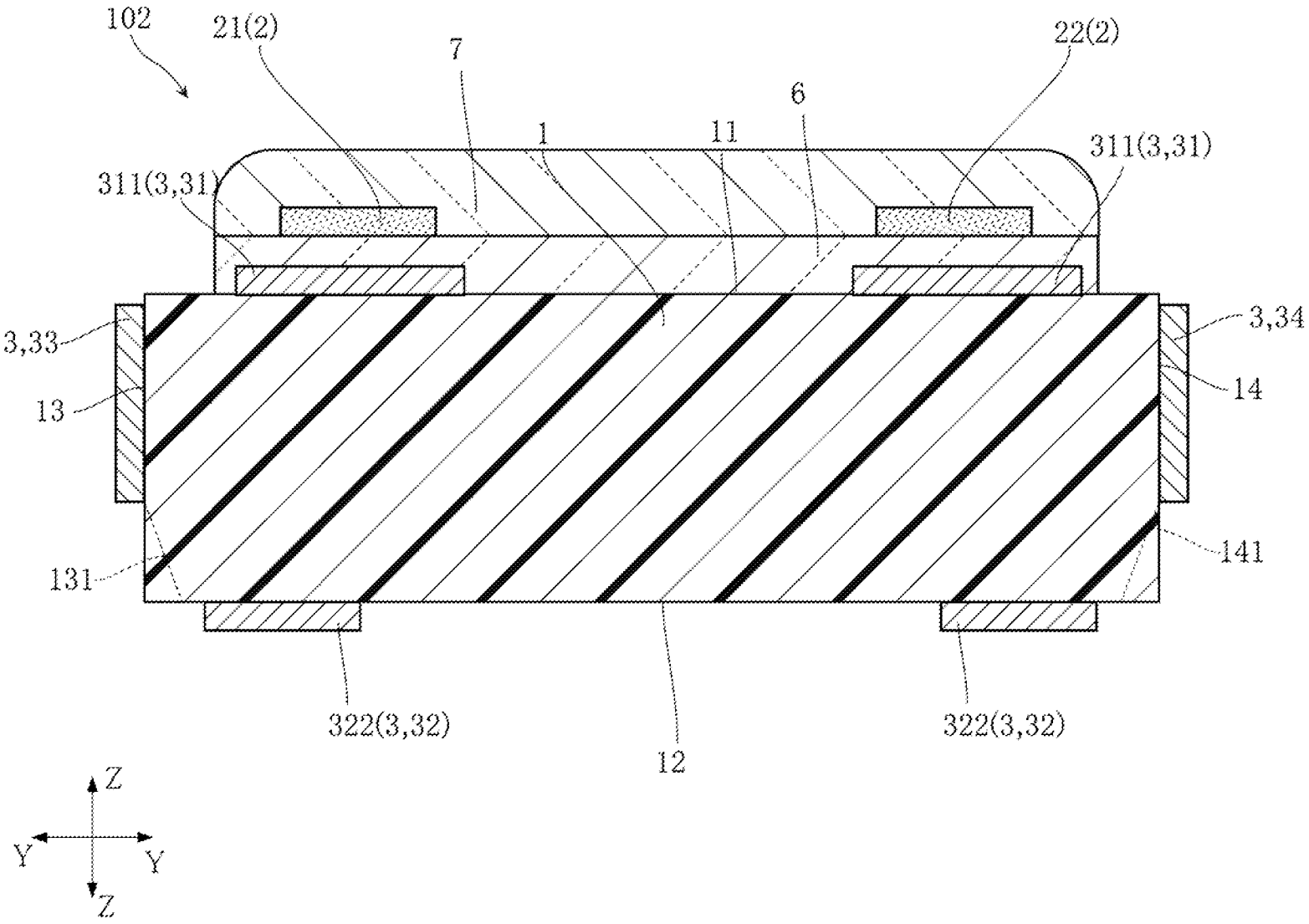
FIG. 17 is a cross-sectional view of a heater according to a third embodiment of the present invention.

The following describes a third embodiment of the present invention with reference to FIGS. 17 and 13.

Figure 18:
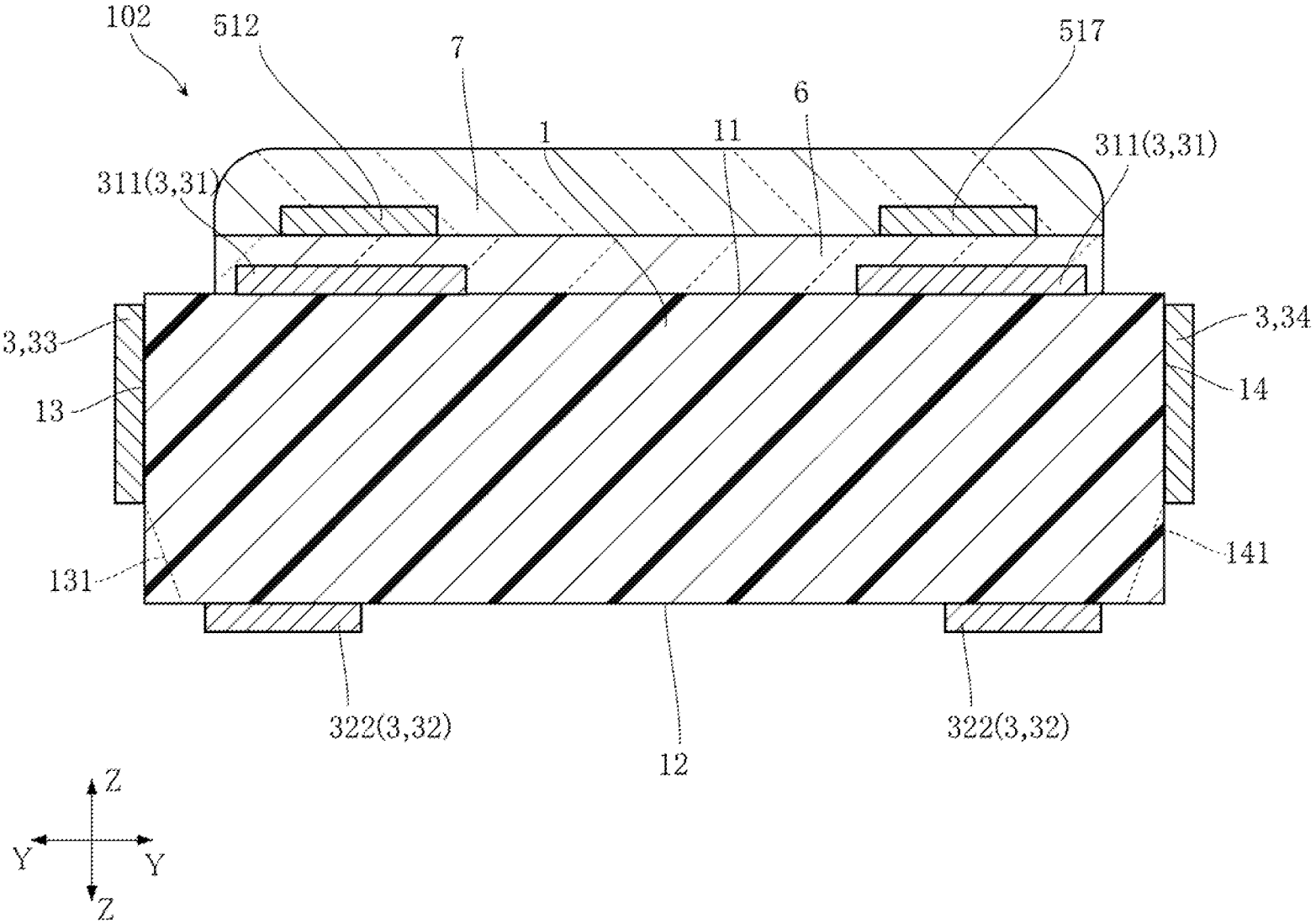
FIG. 18 is a cross-sectional view of the heater according to the third embodiment of the present invention.

FIGS. 17 and 18 are cross-sectional views of a heater according to the third embodiment of the present invention.

A heater 102 shown in these figures is different from the heater 101 in that the heating resistor 2 and the resistor electrode 5 are formed at positions separated from the substrate upper surface 11.

The heater 102 includes an insulating layer 6. The insulating layer 6 is made of a glass, for example. The insulating layer 6 is formed on the substrate upper surface 11, and covers the upper surface portion 31. The heating resistor 2 and the resistor electrode 5 are located on the insulating layer 6. The insulating layer 6 is interposed between the upper surface portion 31 and the heating resistor 2, and between the upper surface portion 31 and the resistor electrodes. Also, in the present embodiment, the upper surface portion 31 has a portion that is overlapped with the heating resistor 2 in a view along the thickness direction Z.

The present embodiment achieves operation effects such as those described below, in addition to the operation effects of the heater 100.

Heat generated by the heating resistor 2 is likely to be transmitted to the heat conducting film 3 (upper surface portion 31) before being transmitted to the substrate 1. This makes it possible to prevent an increase in the temperature of the substrate 1, and reduce the temperature gradient between the heat generating section Z21 and the non-heat generating section Z22. With this configuration as well, cracking of the substrate 1 can be prevented more effectively.

Fourth Embodiment

Figure 19:
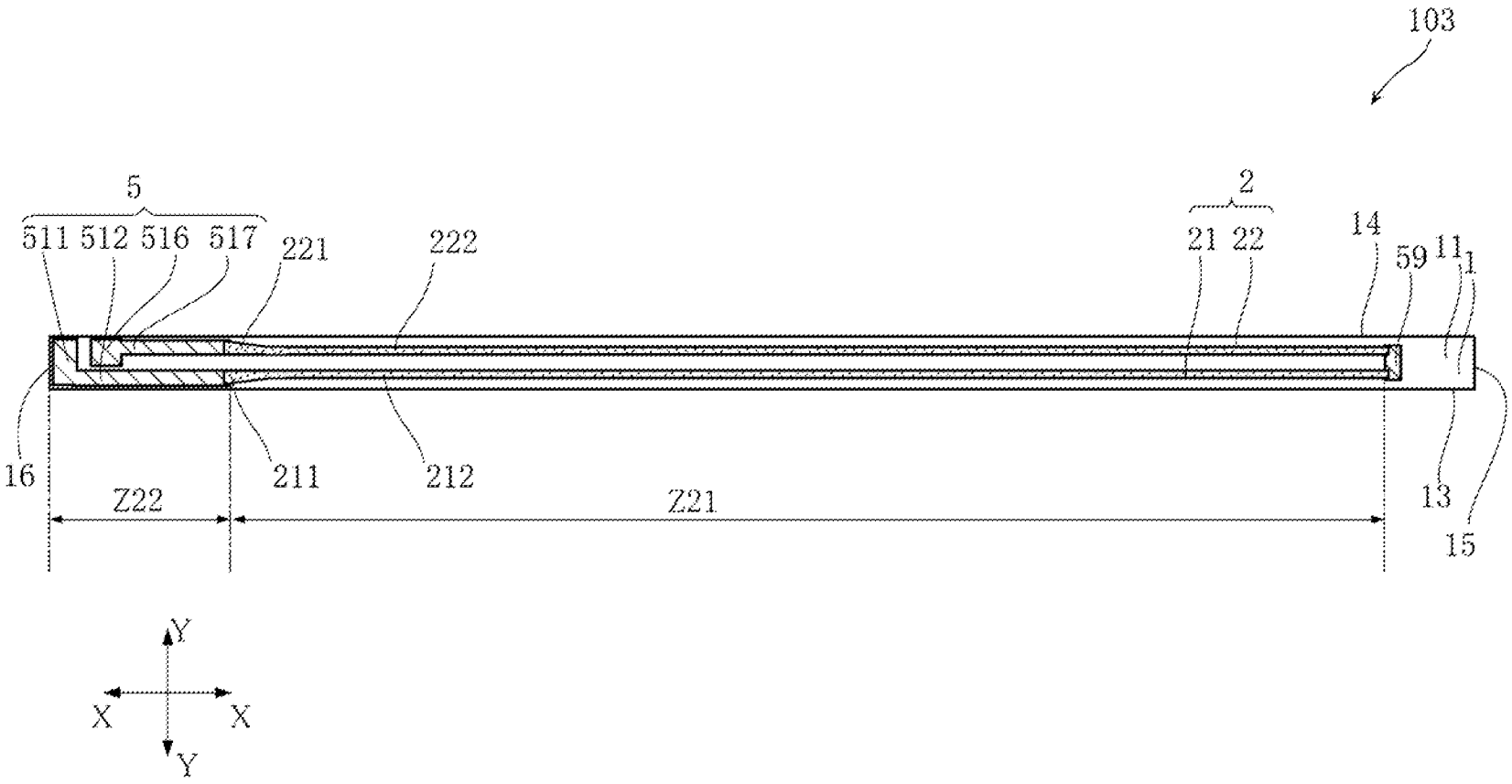
FIG. 19 is a plan view (without the protective layer) of a heater according to a fourth embodiment of the present invention.

The following describes a fourth embodiment of the present invention with reference to FIG. 19.

FIG. 19 is a plan view (without the protective layer) of a heater according to the fourth embodiment of the present invention.

The shapes of the first elongated portion 21 and the second elongated portion 22 in a heater 103 shown in this figure are different from those in the heater 100.

The first elongated portion 21 has a first wide portion 211 and a first narrow portion 212.

The width (dimension in the widthwise direction Y) of the first wide portion 211 is larger than the width (dimension in the widthwise direction Y) of the first narrow portion 212. In the present embodiment, the width of the first wide portion 211 gradually decreases toward the first narrow portion 212. The first wide portion 211 is located between the first narrow portion 212 and the resistor electrode 5. The width of the first narrow portion 212 is uniform in the lengthwise direction X.

The width (dimension in the widthwise direction Y) of a second wide portion 221 is larger than the width (dimension in the widthwise direction Y) of a second narrow portion 222. In the present embodiment, the width of the second wide portion 221 gradually decreases toward the second narrow portion 222. The second wide portion 221 is located between the second narrow portion 222 and the resistor electrode 5. The width of the second narrow portion 222 is uniform in the lengthwise direction X.

The present embodiment achieves operation effects such as those described below, in addition to the operation effects of the heater 100.

According to this configuration, the first wide portion 211 and the second wide portion 221 have decreased resistance, and thus less easily generate heat. This makes it possible to suppress a rise in the temperature of the substrate 1 at the locations where the first wide portion 211 and the second wide portion 221 are formed in the heat generating section Z21. Accordingly, it is possible to prevent an increase in the temperature of the substrate 1, and reduce the temperature gradient between the heat generating section Z21 and the non-heat generating section Z22. With this configuration as well, cracking of the substrate 1 can be prevented more effectively.

Fifth Embodiment

Figure 20:
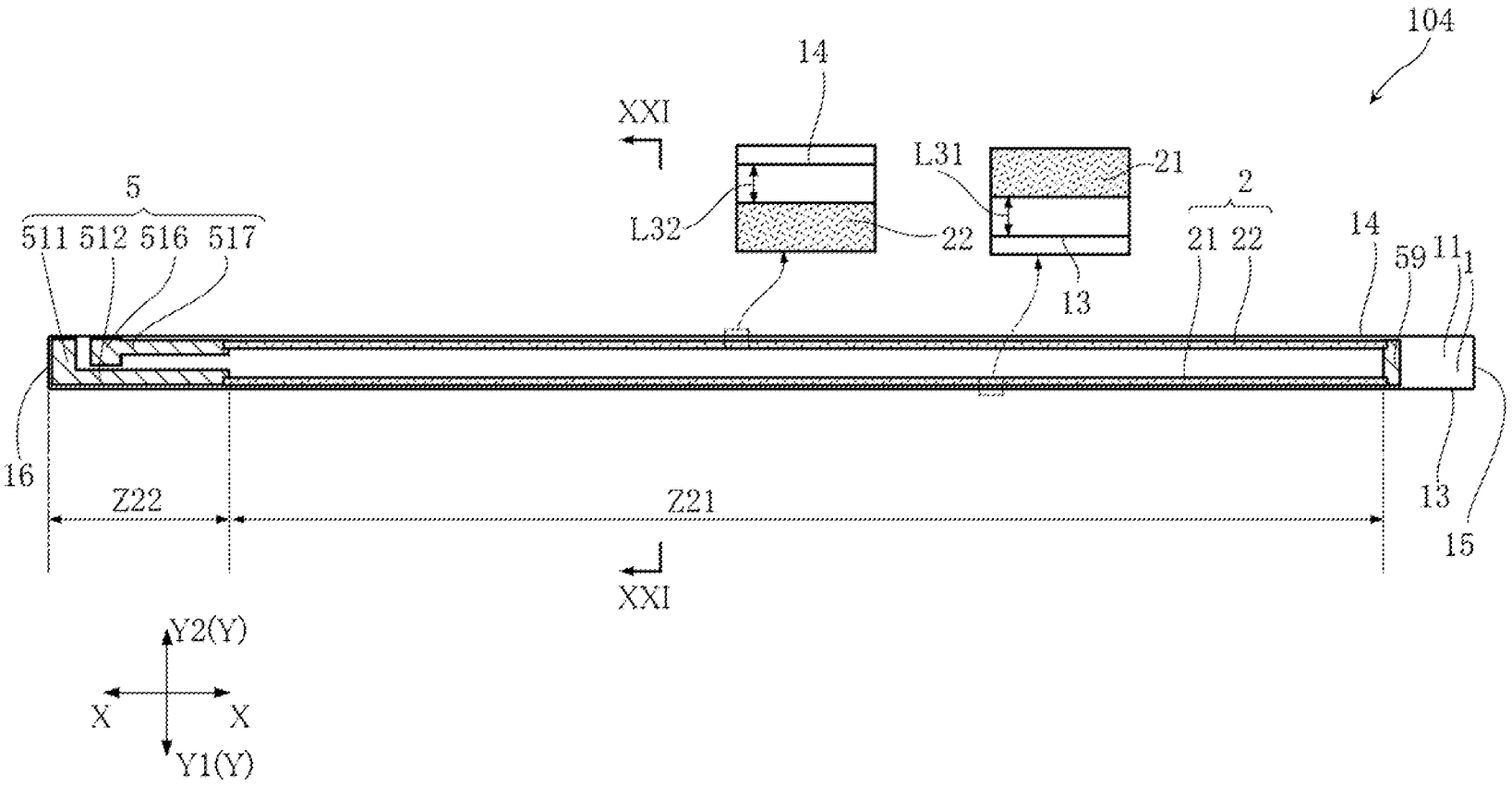
FIG. 20 is a plan view without the protective layer) of a heater according to a fifth embodiment of the present invention.
Figure 21:
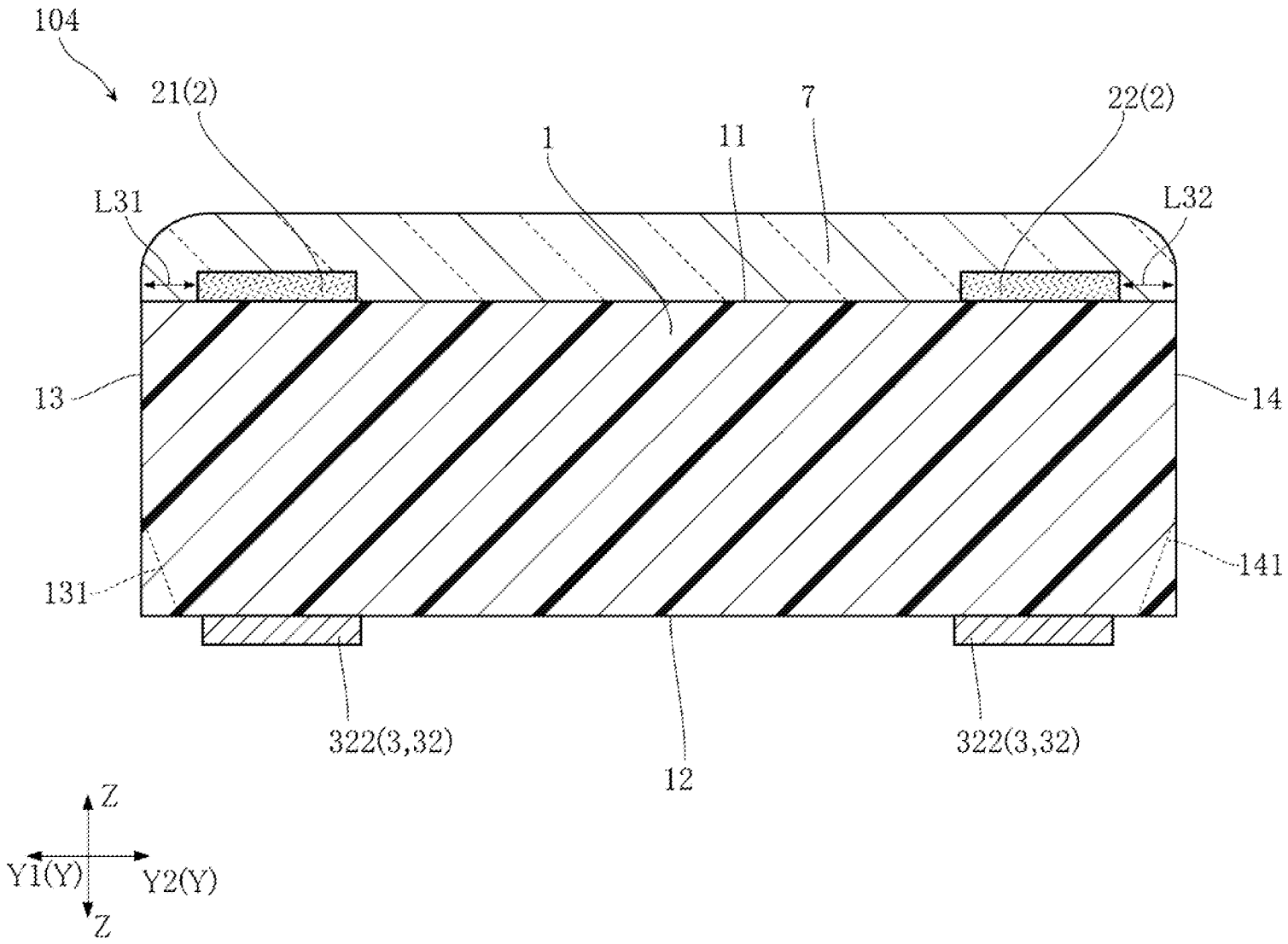
FIG. 21 is a cross-sectional view taken along a line XXI-XXI in FIG. 20.

The following describes a fifth embodiment of the present invention with reference to FIGS. 20 and 21.

FIG. 20 is a plan view (without the protective layer) of a heater according to the fifth embodiment of the present invention. FIG. 21 is a cross-sectional view taken along a line XXI-XXI in FIG. 20.

A heater 104 of the present embodiment is different from the above-described heater 100 in that the first elongated portion 21 and the second elongated portion 22 are located more toward respective end portions of the substrate 1 in the widthwise direction Y.

In the present embodiment, it is preferable that the thickness of the substrate 1 is in the range of 0.5 to 1.0 mm. It is preferable that the dimension of the substrate 1 in the widthwise direction Y is in the range of 7 to 10 mm.

The first elongated portion 21 is located on a first widthwise direction Y1 side, which is on one side in the widthwise direction Y of the substrate 1. A separation dimension L31 between the first elongated portion 21 and the edge of the substrate 1 in the first widthwise direction Y1 is in the range of 0.5 to 1.0 mm. Note that the lower limit of the separation dimension L31 is 0.5 mm due to limitations in the manufacturing of the first elongated portion 21 and the protective layer 7. In the present embodiment, the separation dimension L31 is in the range of 0.5 to 1.0 mm over the entire length of the first elongated portion 21 in the lengthwise direction X. The second elongated portion 22 is located on a second widthwise direction 12 side, which is on the other side in the widthwise direction Y of the substrate 1. A separation dimension L32 between the second elongated portion 22 and the edge of the substrate 1 in the second widthwise direction Y2 is in the range of 0.5 to 1.0 mm. In the present embodiment, the separation dimension L32 is in the range of 0.5 to 1.0 mm over the entire length of the second elongated portion 22 in the lengthwise direction X. Note that the lower limit of the separation dimension L32 is 0.5 mm due to limitations in the manufacturing of the second elongated portion 22 and the protective layer 7.

Also, it is preferable that the ratio of the separation dimension L31 between the first elongated portion 21 and the edge of the substrate 1 in the first widthwise direction Y1 to the dimension of the substrate 1 in the widthwise direction Y is in the range of 0.054 to 0.109 (i.e., 0.5/9.2 to 1.0/9.2). Similarly, it is preferable that the separation dimension L32 between the second elongated portion 22 and the edge of the substrate 1 in the second widthwise direction Y2 to the dimension of the substrate 1 in the widthwise direction Y is in the range of 0.054 to 0.109.

Aspects other than those described above will not be described in the present embodiment since the description of the heater 100 can be applied.

The present embodiment achieves operation effects such as those described below, in addition to the operation effects of the heater 100.

In the present embodiment, the first elongated portion 21 and the second elongated portion 22 are located more toward respective end portions of the substrate 1 in the widthwise direction Y. It was found by the inventor that this configuration enables preventing cracking of the substrate 1 caused by thermal stress. Accordingly, the present embodiment enables more effectively preventing cracking of the substrate 1.

The present invention is not limited to the embodiments described above. Various design modifications can be made no the specific configurations of the units of the present invention.

Sixth Embodiment

The following describes a sixth embodiment of the present invention with reference to FIGS. 22 to 35B.

Figure 22:
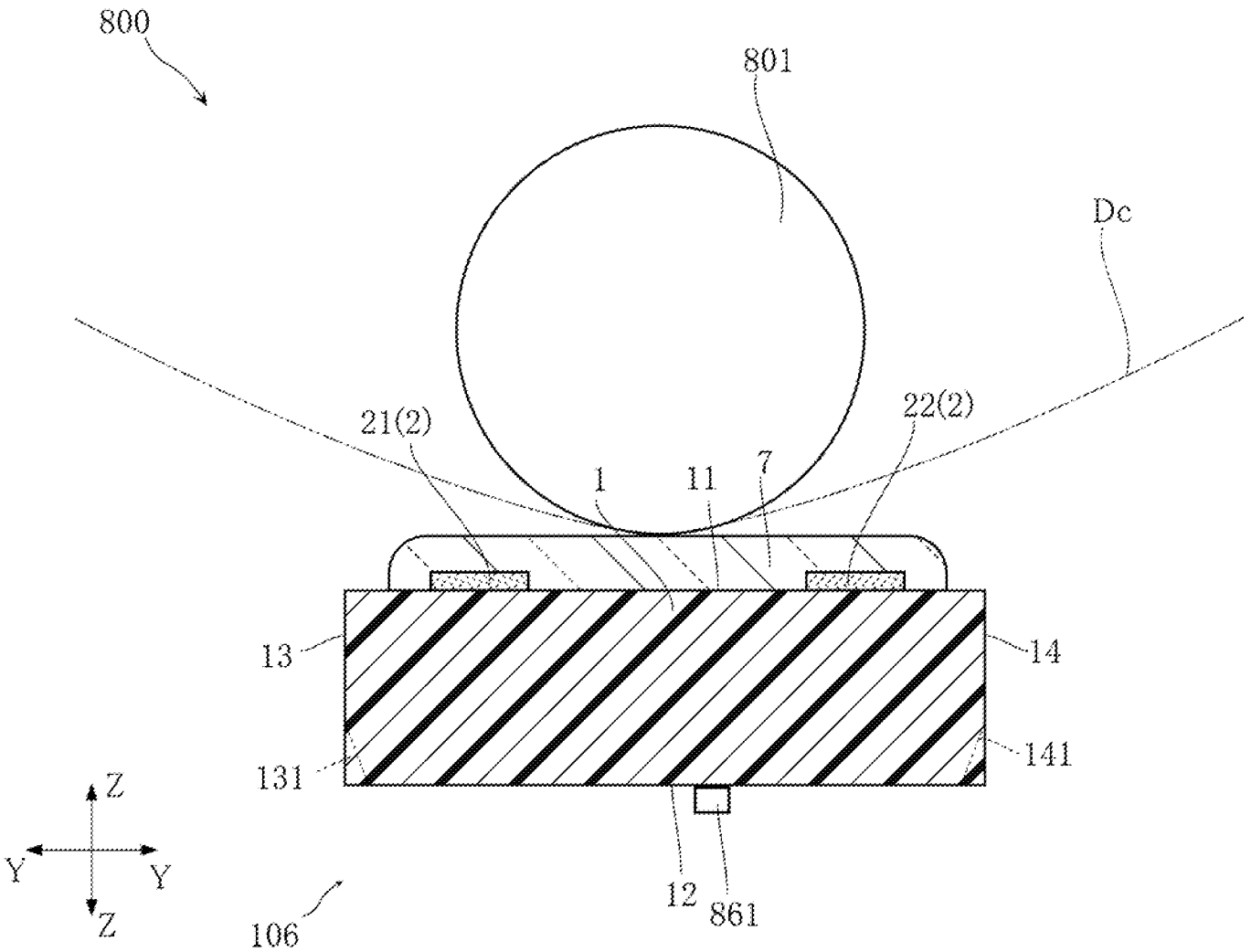
FIG. 22 is a cross-sectional view of an apparatus according to a sixth embodiment of the present invention.

FIG. 22 is a cross-sectional view of an apparatus according to the sixth embodiment of the present invention.

An apparatus 800 shown in this figure is used for toner fixing in an office automation device (e.g., an electronic copying machine, a fax machine, or a printer), for example. The apparatus 800 includes a heater 106, a platen roller 801, and a thermistor 861.

The heater 106 opposes the platen roller 801, and toner transferred to a heating target medium Dc is fixed by heat to the heating target medium Dc by the heater 106.

Figure 23:
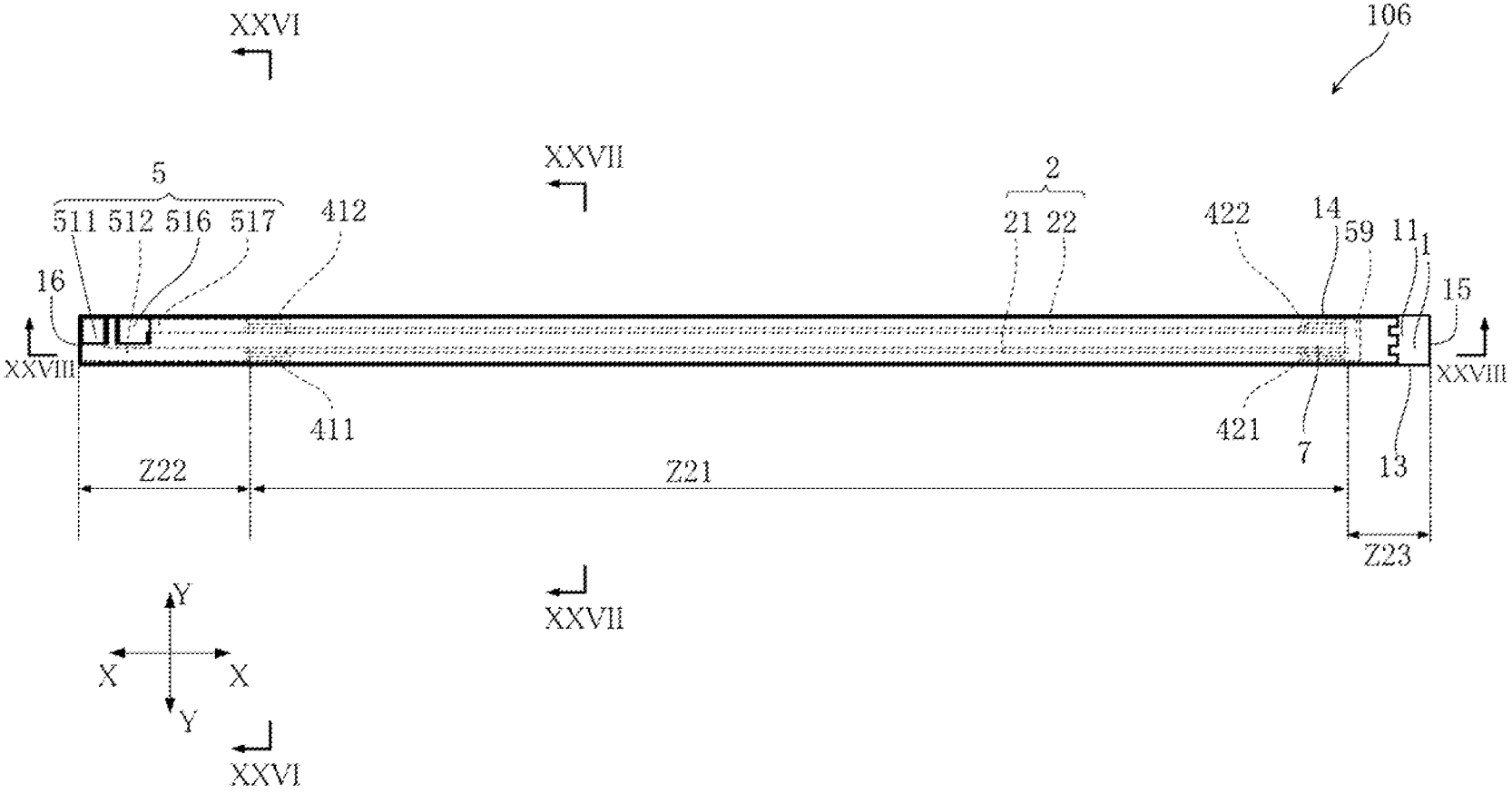
FIG. 23 is a plan view (partially transparent) of the heater according to the sixth embodiment of the present invention.
Figure 24:
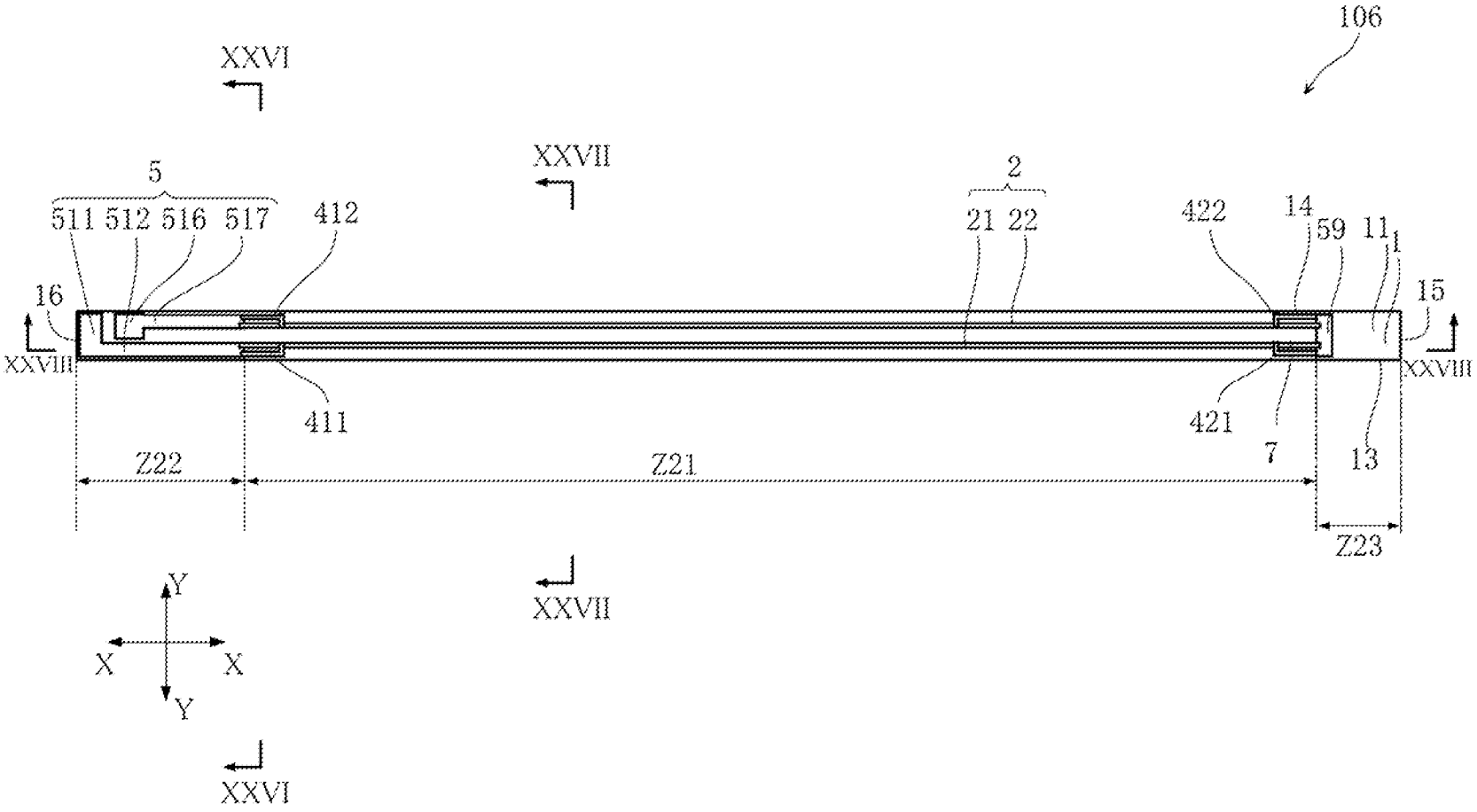
FIG. 24 is a diagram in which a protective layer has been omitted from FIG. 23.
Figure 25:
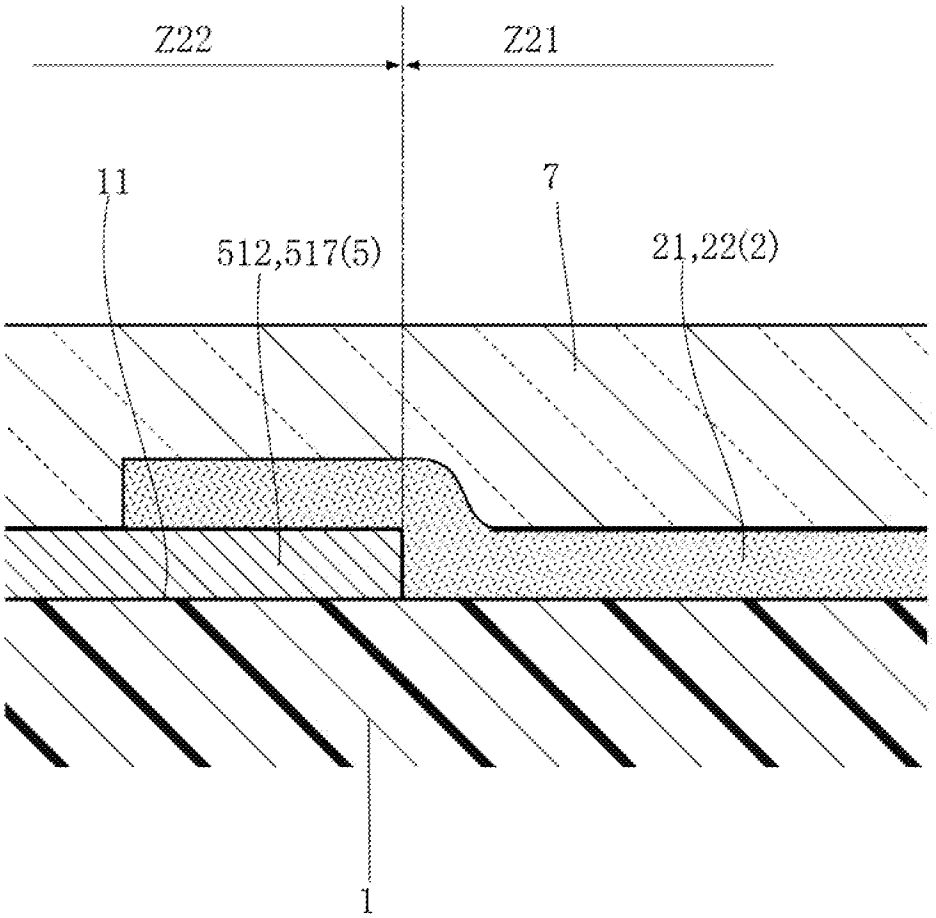
FIG. 25 is a partial enlarged cross-sectional view of the heater shown in FIG. 23.
Figure 26:
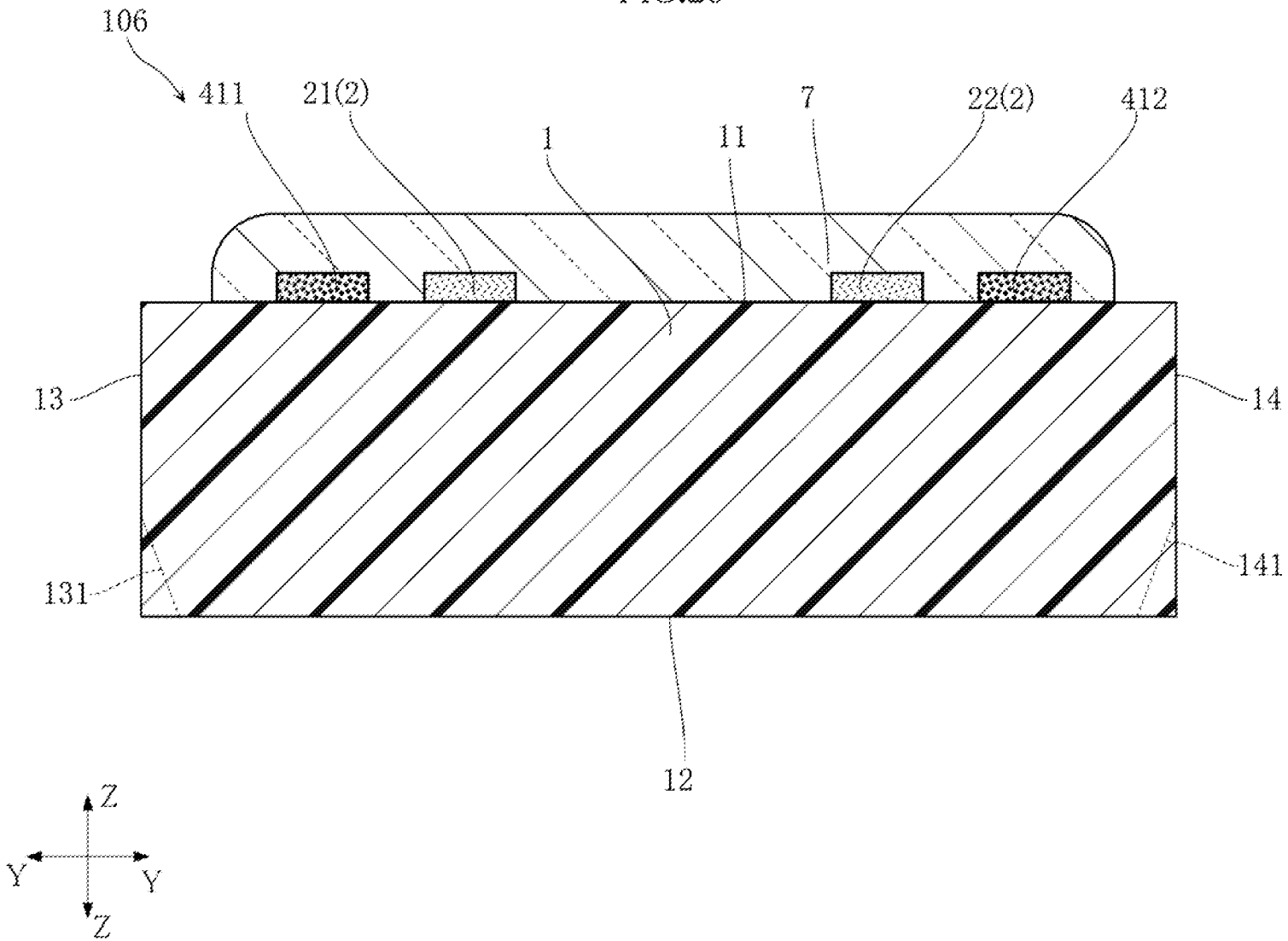
FIG. 26 is a cross-sectional view taken along a line XXVI-XXVI in FIG. 23.
Figure 28:
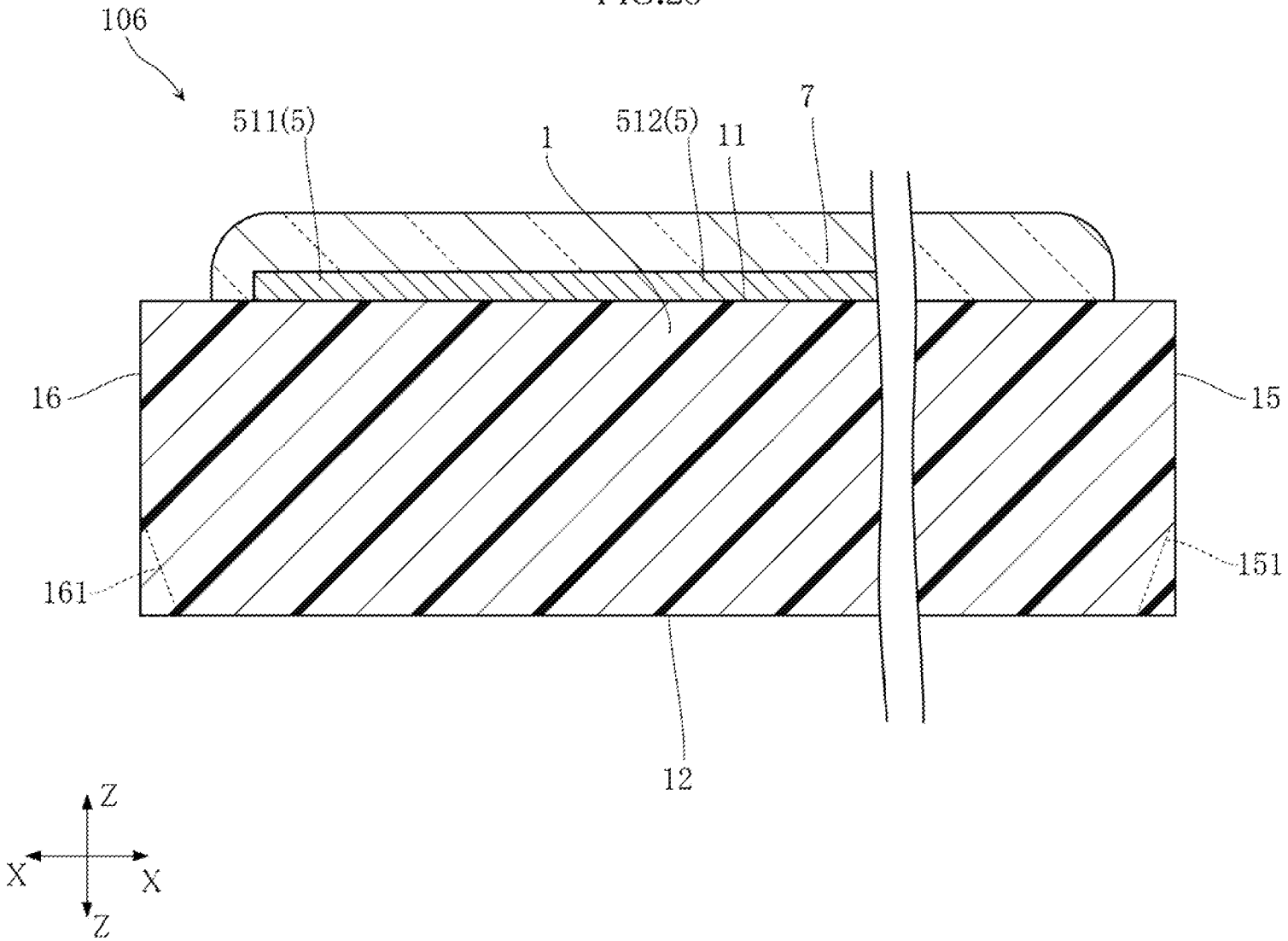
FIG. 28 is a cross-sectional, view taken along a line XXVIII-XXVIII in FIG. 23.
Figure 29A:
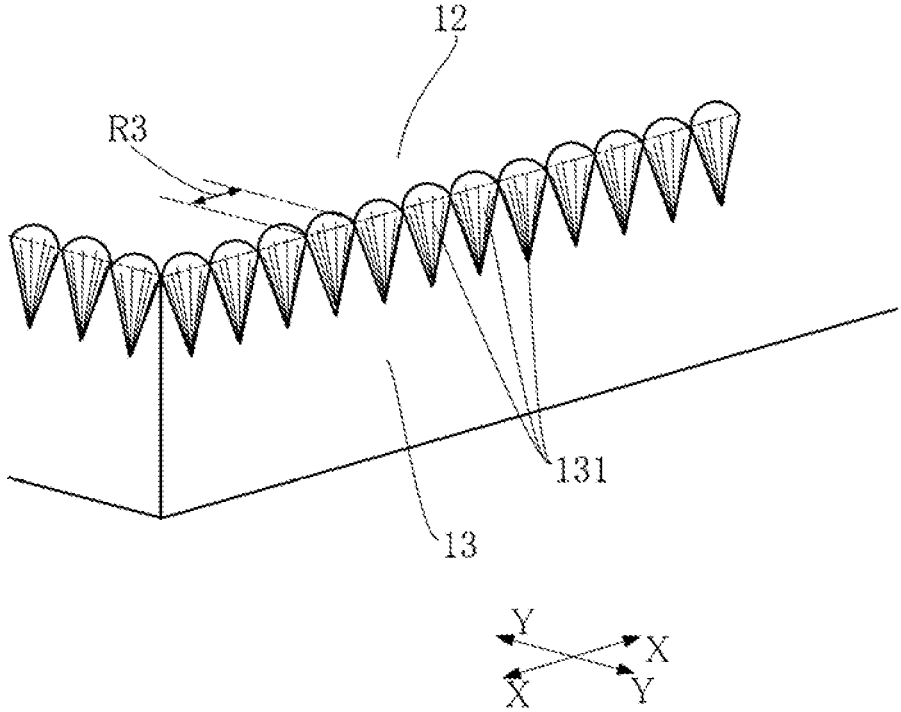
FIG. 29A is a perspective view of only the substrate.
Figure 29B:
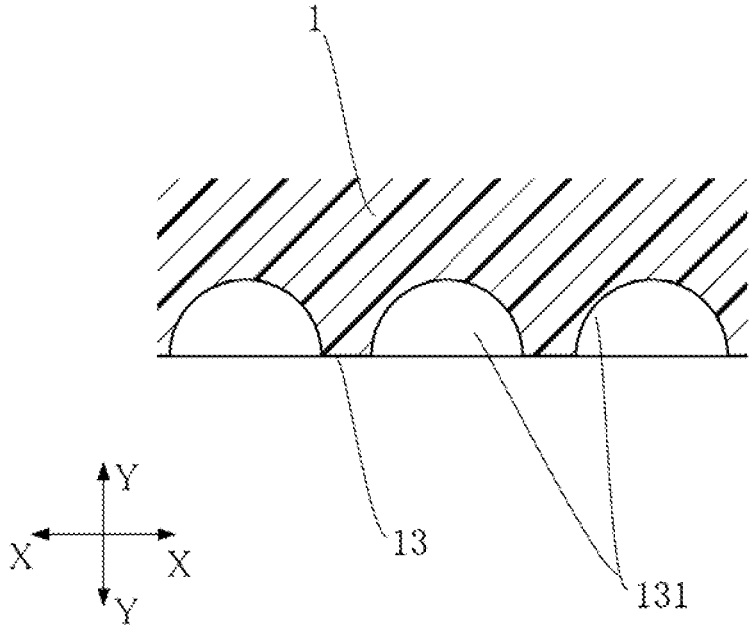
FIG. 29B is a diagram showing the cross-sectional shape of the substrate along a plane orthogonal to the thickness direction of the substrate.
Figure 30A:
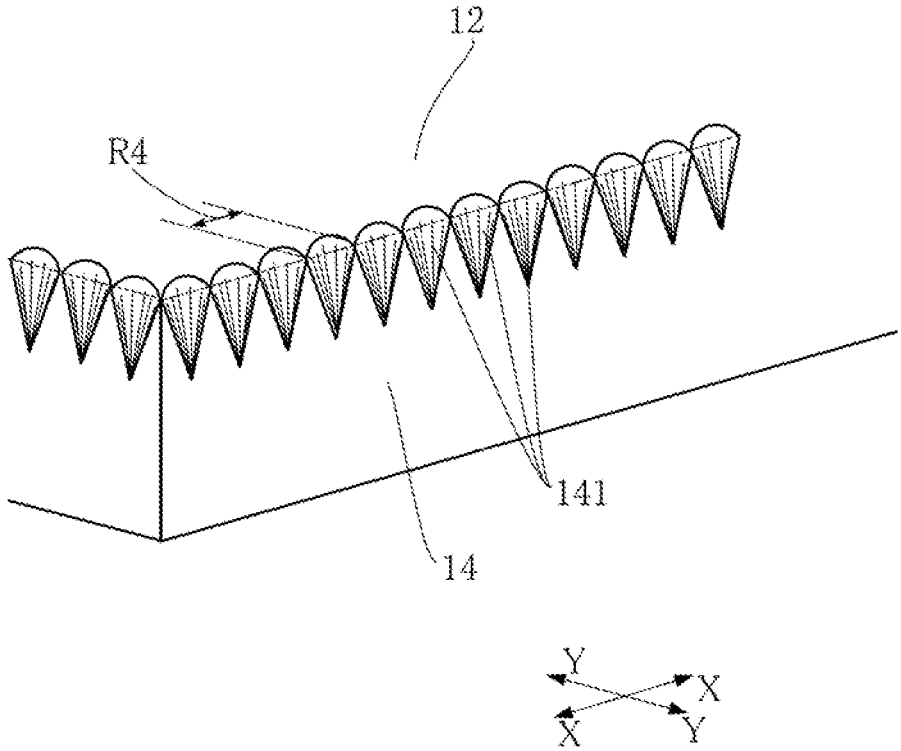
FIG. 30A is a perspective view of only the substrate.
Figure 30B:
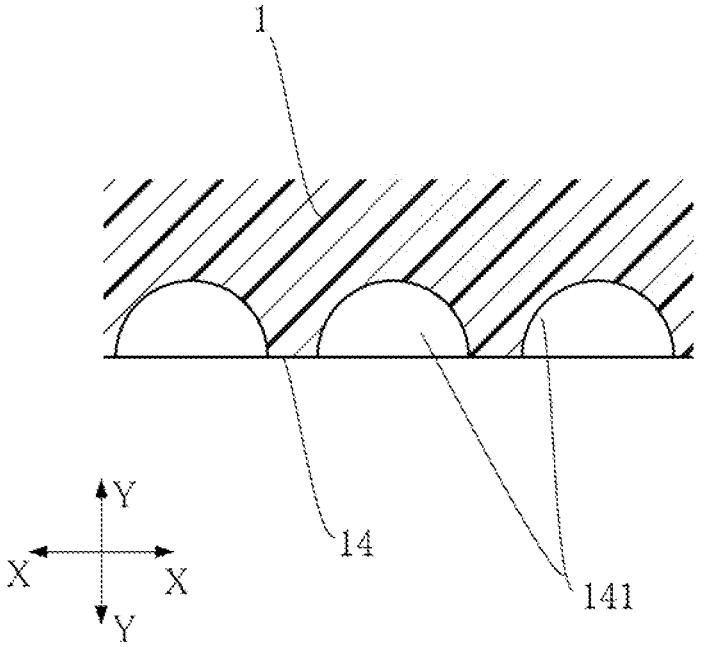
FIG. 30B is a diagram showing the cross sectional shape of the substrate along a plane orthogonal to the thickness direction of the substrate.

FIG. 23 is a plan view (partially transparent) of the heater according to the sixth embodiment of the present invention. FIG. 24 is a diagram in which the protective layer has been omitted from FIG. 23. FIG. 25 is a partial enlarged cross-sectional view of the heater shown in FIG. 23. FIG. 26 is a cross-sectional view taken along a line XXVI-XXVI in FIG. 23. FIG. 21 is a cross-sectional view taken along a line XXVII-XXVII in FIG. 23. FIG. 28 is a cross-sectional view taken along a line XXVIII-XXVIII in FIG. 23.

The heater 106 includes a substrate 1, a heating resistor 2, a first auxiliary resistor 411, a second auxiliary resistor 412, a first auxiliary resistance element 421, a second auxiliary resistance element 422, a resistor electrode 5, and a protective layer 7.

The substrate 1 shown in FIGS. 22 to 28 is shaped as an elongated plate. The lengthwise direction of the substrate 1 is a lengthwise direction X, the widthwise direction of the substrate 1 is a widthwise direction Y, and the thickness direction of the substrate 1 is a thickness direction Z.

In the present embodiment, the substrate 1 is made of an insulating material. In the present embodiment, the insulating material constituting the substrate 1 is a ceramic. Examples of this ceramic include alumina, zirconia, and aluminum nitride.

It is preferable that the thickness of the substrate 1 is in the range of 0.4 to 1.1 mm, for example. It is further preferable that the thickness of the substrate 1 is in the range of 0.4 to 0.6 mm, for example. If the substrate 1 is made of a material having a low thermal conductivity (e.g., alumina), a low thickness is preferable for the substrate 1.

The substrate 1 has a substrate upper surface 11, a substrate lower surface 12, a first substrate side surface 13, a second substrate side surface 14, a first substrate end surface 15, and a second substrate end surface 16. The substrate upper surface 11, the substrate lower surface 12, the first substrate side surface 13, the second substrate side surface 14, the first substrate end surface 15, and the second substrate end surface 16 are all flat surfaces.

Figure 27:
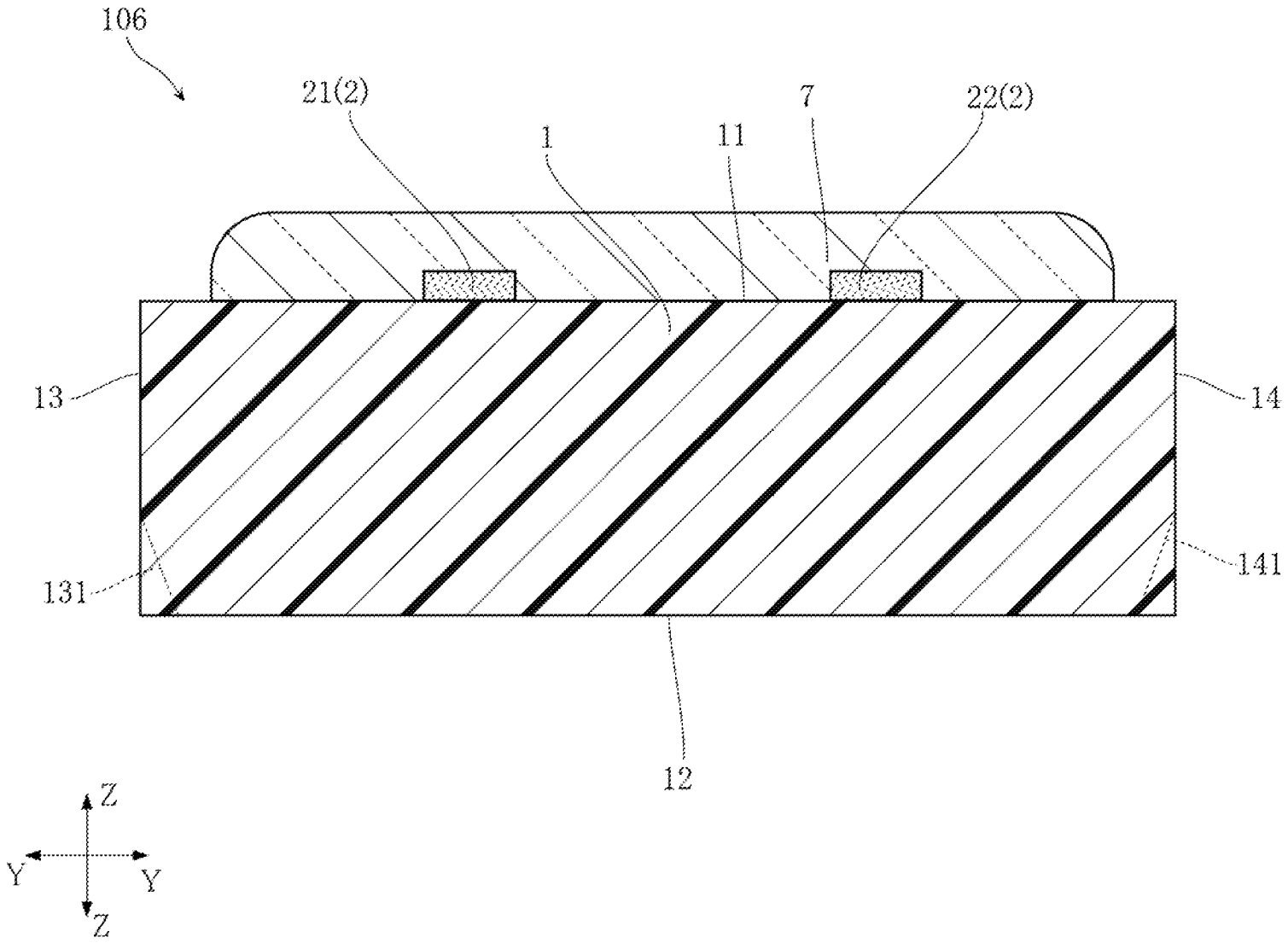
FIG. 27 is a cross-sectional view taken along a line XXVII-XXVII in FIG. 23.

As shown in FIG. 27, the substrate upper surface 11 and the substrate lower surface 12 are located on mutually opposite sides in the thickness direction Z, and face mutually opposite directions. The substrate upper surface 11 faces one side in the thickness direction Z. The substrate lower surface 12 faces the other side in the thickness direction Z. The substrate upper surface 11 and the substrate lower surface 12 are both shaped as elongated rectangles.

The first substrate side surface 13, the second substrate side surface 14, the first substrate end surface 15, and the second substrate end surface 16 shown in FIGS. 23, 27, 28, and the like ail face directions that intersect the thickness direction Z of the substrate 1. The first substrate side surface 13, the second substrate side surface 14, the first substrate end surface 15, and the second substrate end surface 16 are all connected to the substrate upper surface 11 and the substrate lower surface 12. The first substrate side surface 13 and the second substrate side surface 14 each extend in an elongated manner, and are located on mutually opposite sides in the widthwise direction Y of the substrate 1. The first substrate side surface 13 is located at one end in the widthwise direction Y of the substrate 1. The second substrate side surface 14 is located at the other end in the widthwise direction Y of the substrate 1. The first substrate end surface 15 and the second substrate end surface 16 are located on mutually opposite sides in the lengthwise direction X of the substrate 1. The first substrate end surface 15 is located at one end in the lengthwise direction X of the substrate 1. The second substrate end surface 16 is located at the other end in the lengthwise direction X of the substrate 1.

As shown in FIGS. 26 to 32B, in the present embodiment, multiple cutouts are formed in the substrate 1. These cutouts will be described in detail below.

As shown in FIGS. 26, 27, 29A, and 29B, multiple cutouts 131 are formed in the substrate lower surface 12 and the first substrate side surface 13. The cutouts 131 are recessed from the substrate lower surface 12 and the first substrate side surface 13. The cutouts 131 are arranged in a line along the lengthwise direction X. The cutouts 131 each have a semicircular cross-sectional shape taken along a plane orthogonal to the thickness direction Z, and the diameter of the semicircle gradually decreases from the substrate lower surface 12 toward the substrate upper surface 11. In other words, the cutouts 131 are each semi-conical. At the substrate lower surface 12, diameters R3 (see FIGS. 28A and 29B) of the semicircles constituting the cutouts 131 are in the range of 40 to 70 μm, for example.

As shown in FIGS. 26, 27, 30A, and 30B, multiple cutouts 141 are formed in the substrate lower surface 12 and the second substrate side surface 14. The cutouts 141 are recessed from the substrate lower surface 12 and the second substrate side surface 14. The cutouts 141 are arranged in a line along the lengthwise direction X. The cutouts 141 each have a semicircular cross-sectional shape taken along a plane orthogonal to the thickness direction Z, and the diameter of the semicircle gradually decreases from the substrate lower surface 12 toward the substrate upper surface 11. In other words, the cutouts 141 are each semi-conical. At the substrate lower surface 12, diameters R4 (see FIGS. 30A and 30B) of the semicircles constituting the cutouts 141 are in the range of 40 to 70 μm, for example.

Figure 31A:
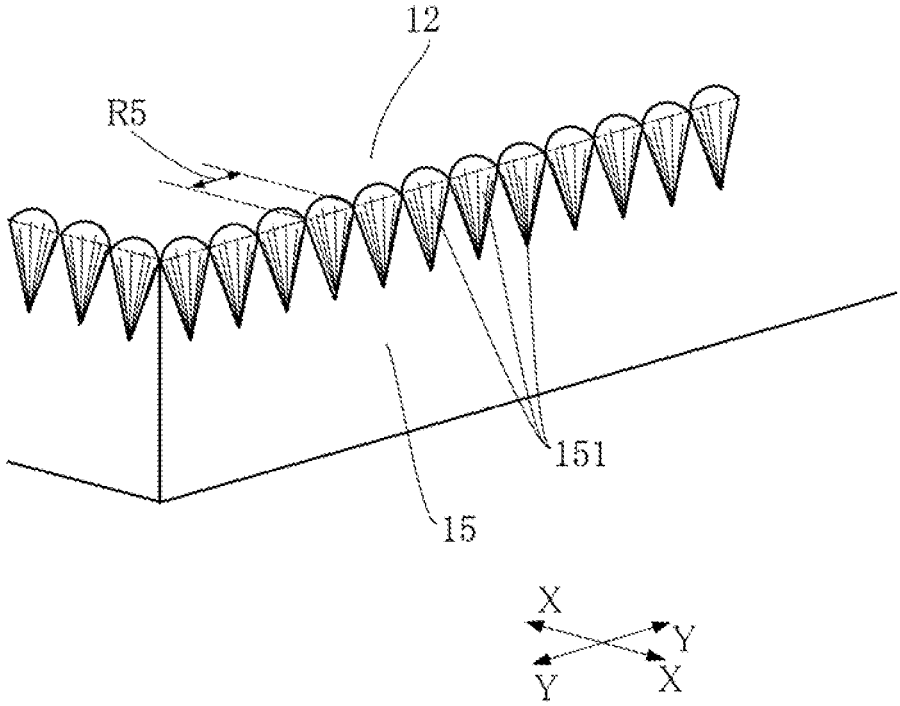
FIG. 31A is a perspective view of only the substrate.
Figure 31B:
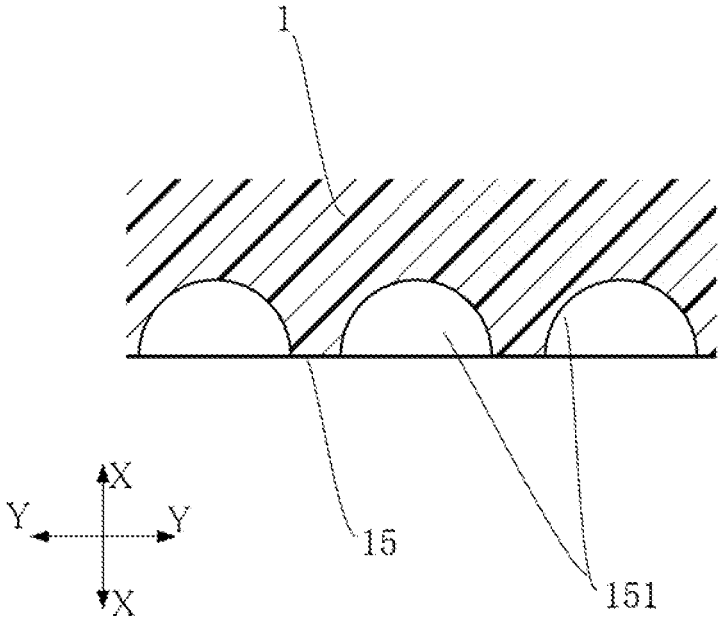
FIG. 31B is a diagram showing the cross-sectional shape of the substrate along a plane orthogonal to the thickness direction of the substrate.

As shown in FIGS. 28, 31A, and 31B, multiple cutouts 151 are formed in the substrate lower surface 12 and the first substrate end surface 15. The cutouts 151 are recessed from the substrate lower surface 12 and the first substrate end surface 15. The cutouts 151 are arranged in a line along the widthwise direction Y. The cutouts 151 each have a semicircular cross-sectional shape taken along a plane orthogonal to the thickness direction Z, and the diameter of the semicircle gradually decreases from the substrate lower surface 12 toward the substrate upper surface 11. In other words, the cutouts 151 are each semi-conical. At the substrate lower surface 12, diameters R5 (see FIGS. 31A and 31B) of the semicircles constituting the cutouts 151 are in the range of 40 to 70 μm, for example.

Figure 32A:
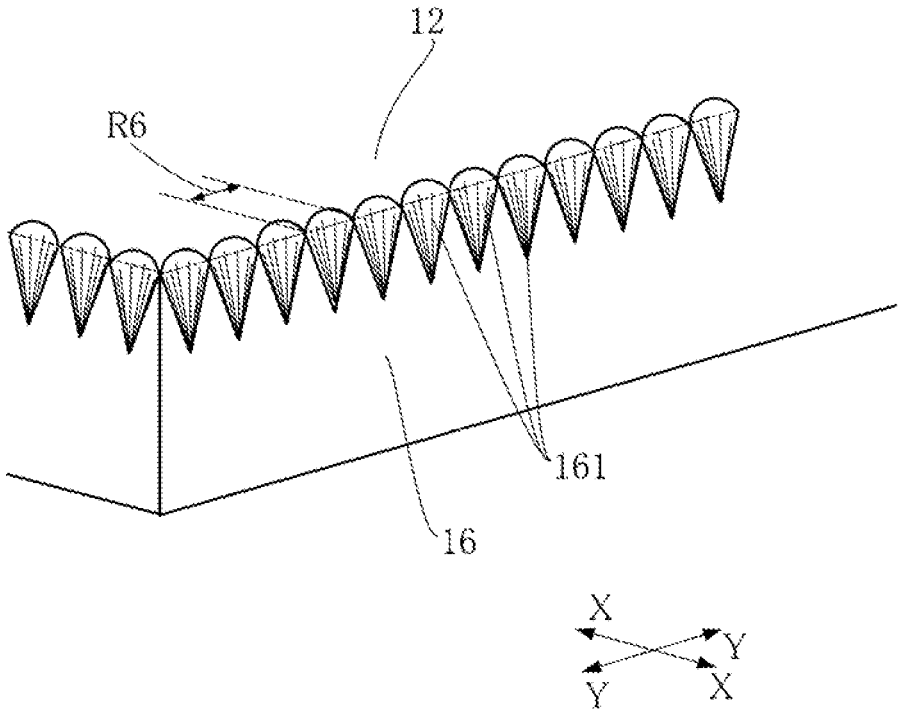
FIG. 32A is a perspective view of only the substrate.
Figure 32B:
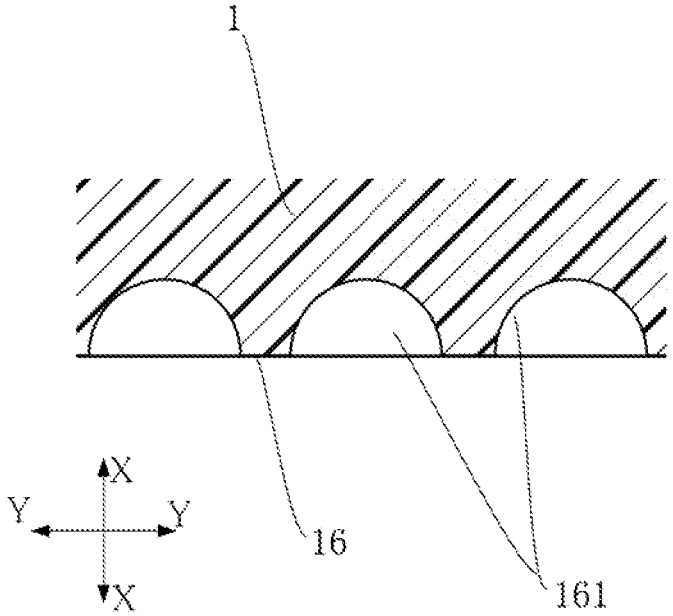
FIG. 32B is a diagram showing the cross-sectional shape of the substrate along a plane orthogonal to the thickness direction of the substrate.

As shown in FIGS. 28, 32A, and 32B, multiple cutouts 161 are formed in the substrate lower surface 12 and the second substrate end surface 16. The cutouts 161 are recessed from the substrate lower surface 12 and the second substrate end surface 16. The cutouts 161 are arranged in a line along the widthwise direction Y. The cutouts 161 each have a semicircular cross-sectional shape taken along a plane orthogonal to the thickness direction Z, and the diameter of the semicircle gradually decreases from the substrate lower surface 12 toward the substrate upper surface 11. In other words, the cutouts 161 are each semi-conical. At the substrate lower surface 12, diameters R6 (see FIGS. 32A and 32B) of the semicircles constituting the cutouts 161 are in the range of 40 to 70 μm, for example.

These cutouts (cutouts 131, 141, 151, and 161) are formed in the first substrate side surface 13, the second substrate side surface 14, the first substrate end surface 15, and the second substrate end surface 16 due to using a laser (YAG laser) when cutting the substrate 1. When cutting the substrate 1, a laser slit is formed by irradiation with a laser beam from the substrate lower surface 12 side. This slit remains as the cutouts in the substrate 1. Note that the laser diameter of the laser used in the present embodiment is very small. For this reason, the diameters R3 to R6 are very small, that is to say in the range of 40 to 70 μm as described above.

Note that if, in contrast to the present embodiment, a laser is not used when cutting the substrate 1, for example, cutouts do not need to be formed in the first substrate side surface 13, the second substrate side surface 14, the first substrate end surface 15, and the second substrate end surface 16.

As shown in FIGS. 23 and 24, the substrate 1 includes a first section Z21, a second section Z22, and a third section Z23. The first section Z21, the second section Z22, and the third section Z23 will be described later.

The heating resistor 2 shown in FIGS. 22 to 27 is formed on the substrate 1. The heating resistor 2 is in contact with the substrate 1. Note that the phrase "one object is formed on another object" in this specification encompasses not only "one object is in contact with the other object", but also "one object is not in contact with the other object". The heating resistor 2 generates heat by the flow of a current therein. The heating resistor 2 is made of a resistor material. One example of the resistor material constituting the heating resistor 2 is AgPd. Other examples of the resistor material constituting the heating resistor 2 include nichrome and ruthenium oxide. The thickness of the heating resistor 2 (dimension in the thickness direction Z) is in the range of 5 to 15 μm, for example. The heating resistor 2 is formed by printing, for example. The heating resistor 2 is formed, on the substrate upper surface 11 side of the substrate 1. In the present embodiment, the heating resistor 2 is in contact with the substrate upper surface 11.

As shown in FIGS. 23, 24, and 27, the heating resistor 2 has a first elongated portion 21 and a second elongated portion 22.

The first elongated portion 21 extends in an elongated manner along the lengthwise direction X of the substrate 1. The first elongated portion 21 is formed on one end side of the substrate 1 in the widthwise direction Y (i.e., is formed on the lower side in FIG. 24). The first elongated portion 21 is formed extending from one end to the other end in the lengthwise direction X of the substrate 1. The length of the first elongated portion 21 is greater than or equal to 50%, preferably greater than or equal to 70%, and more preferably greater than or equal to 80% of the dimension of the substrate 1 in the lengthwise direction X. The first elongated portion 21 is in contact with the substrate 1, and is in contact with the substrate upper surface 11 in the present embodiment.

The second elongated portion 22 extends in an elongated manner along the lengthwise direction X of the substrate 1. The second elongated portion 22 is formed on the other end side of the substrate 1 in the widthwise direction Y (i.e., is formed on the upper side in FIG. 24). The second elongated portion 22 is formed extending from one end to the other end in the lengthwise direction X of the substrate 1. The length of the second elongated portion 22 is greater than or equal to 50%, preferably greater than or equal to 70%, and more preferably greater than or equal to 80% of the dimension of the substrate 1 in the lengthwise direction X. The second elongated portion 22 is in contact with the substrate 1, and is in contact with the substrate upper surface 11 in the present embodiment. The second elongated portion 22 and the first elongated portion 21 are separated from each other in the widthwise direction Y of the substrate 1. The second elongated portion 22 and the first elongated portion 21 are parallel to each other.

The resistor electrode 5 shown in FIGS. 23, 24, and the like is formed on the substrate 1. The resistor electrode 5 is in contact with the substrate 1. The resistor electrode 5 is for supplying the heating resistor 2 with electrical power from outside the heater 106. The resistor electrode 5 is made of a conductive material. One example of the conductive material constituting the resistor electrode 5 is Ag. The thickness of the resistor electrode 5 (dimension in the thickness direction Z) is in the range of 5 to 15 μm, for example. The resistor electrode 5 is formed by printing, for example. In the present embodiment, the resistor electrode 5 is formed on the substrate upper surface 11 side of the substrate 1. The resistor electrode 5 is in contact with the substrate upper surface 11. As shown in FIG. 25, a portion of the resistor electrode 5 is overlapped with and in contact with a portion of the heating resistor 2. In the present embodiment, a portion of the resistor electrode 5 is interposed between the heating resistor 2 and the substrate 1. In contrast to the present embodiment, a port ion of the heating resistor 2 may be interposed between the resistor electrode 5 and the substrate 1.

As shown in FIGS. 23 and 24, the resistor electrode 5 includes a first resistor pad 511, a first resistor connection portion 512, a second resistor pad 516, and a second resistor connection portion 517.

The first resistor pad 511 is a rectangular portion. Electrical power is supplied to the first resistor pad 511 from outside the heater 106. The first resistor connection portion 512 is connected to the first resistor pad 511. The first resistor connection portion 512 is overlapped with a portion of the heating resistor 2, and is in contact with the heating resistor 2. More specifically, the first resistor connection portion 512 is overlapped with the first elongated portion 21 of the heating resistor 2, and is in contact with the first elongated portion 21 of the heating resistor 2. The first resistor connection portion 512 is shaped as a strip that extends along the lengthwise direction X of the substrate 1.

The second resistor pad 516 is a rectangular portion. Electrical power is supplied to the second resistor pad 516 from outside the heater 106. The second resistor connection portion 517 is connected to the second resistor pad 516. The second resistor connection portion 517 is overlapped with a portion of the heating resistor 2, and is in contact with the heating resistor 2. More specifically, the second resistor connection portion 517 is overlapped with the second elongated portion 22 of the heating resistor 2, and is in contact with the second elongated portion 22 of the heating resistor 2. The second resistor connection portion 517 is shaped as a strip that extends along the lengthwise direction X of the substrate 1. The second resistor connection portion 517 is formed so as to be separated from the first resistor connection portion 512 in the widthwise direction Y of the substrate 1.

A connecting electrode 59 is formed in the heater 106. The connecting electrode 59 electrically connects portions of the heating resistor 2 that are separated from each other. In the present embodiment, the connecting electrode 59 connects the first elongated portion 21 and the second elongated portion 22. The connecting electrode 59 extends along the widthwise direction Y of the substrate 1. The connecting electrode 59 connects one end portion of the first elongated portion 21 and one end portion of the second elongated portion 22. The connecting electrode 59 is in contact with both the first elongated portion 21 and the second elongated portion 22. The connecting electrode 59 is formed on the side of the heating resistor 2 opposite to the first resistor pad 511.

As described above, the substrate 1 includes the first section Z21, the second section Z22, and the third section Z23 (see FIGS. 23 to 25, for example).

The first section Z21 is a section that is overlapped with, out of the heating resistor 2 and the resistor electrode 5, only the heating resistor 2 in the lengthwise direction X of the substrate 1. In the present embodiment, as shown in FIG. 25, one end port ion of the first resistor connection portion 512 is located at the boundary between the first section Z21 and the second section Z22. Similarly, one end portion of the second resistor connection portion 517 is located at the boundary between the first section Z21 and the second section Z22.

The second section Z22 is a section that is different from the first section Z21. The second section Z22 is adjacent to the first section Z21 in the lengthwise direction X. In the present embodiment, the first resistor pad 511, the first resistor connection portion 512, the second resistor pad 516, and the second resistor connection portion 517 are located in the second section Z22.

The third section Z23 is a section that is different from both the first section Z21 and the second section Z22. The third section Z23 is adjacent to the first section Z21 in the lengthwise direction X. In the present embodiment, the heating resistor 2 is not formed in the third section Z23. As shown in FIGS. 23 and 24, one end portion of the connecting electrode 59 is located at the boundary between the first section Z21 and the third section Z23. Similarly, one end portion of the connecting electrode 59 is located at the boundary between, the first section Z21 and the third section Z23.

Figure 33:
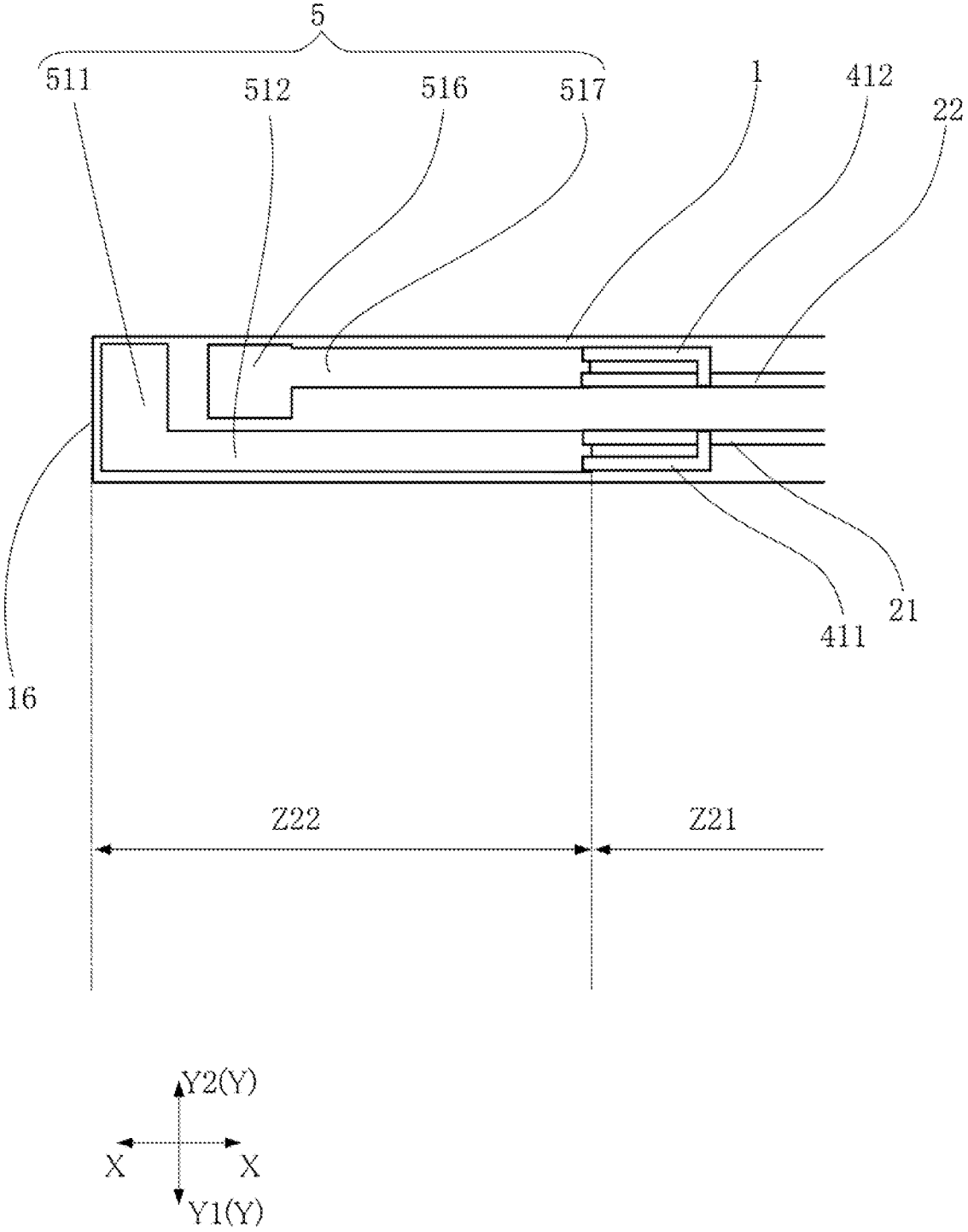
FIG. 33 is a partial enlarged diagram showing an enlargement of a portion of FIG. 24.

FIG. 33 is a partial, enlarged diagram showing an enlargement of a portion of FIG. 24.

The first auxiliary resistor 411 has a portion that is located in a different region from the region occupied by the heating resistor 2 in the widthwise direction Y of the substrate 1. The TCR (Temperature Coefficient of Resistance) of the material constituting the first auxiliary resistor 411 is lower than the TCR of the material constituting the heating resistor 2. The sheet resistance value of the material constituting the first auxiliary resistor 411 at room temperature (27° C.) is higher than the sheet resistance value of the material constituting the heating resistor 2 at room temperature (27° C.). The first auxiliary resistor 411 has a portion that is located in one end portion of the first section Z21 in the lengthwise direction X of the substrate 1. The first auxiliary resistor 411 reaches the boundary between the first section Z21 and the second section Z22. The first auxiliary resistor 411 has a portion that is in contact with the heating resistor 2. In the present embodiment, the first auxiliary resistor 411 is in contact with the first elongated portion 21. The first-auxiliary resistor 411 is separated from the heating resistor 2 via a gap. One end of the first auxiliary resistor 411 is in contact with the heating resistor 2, and the other end of the first auxiliary resistor 411 is in contact with the resistor electrode 5 (first resistor connection portion 512). Also, the first auxiliary resistor 411 is electrically connected to the heating resistor 2 in parallel. The first auxiliary resistor 411 is formed on an end portion of the substrate 1 in the widthwise direction Y of the substrate 1 (end portion on the first widthwise direction Y1 side).

The second auxiliary resistor 412 has a portion that is located in a different region from the region occupied by the heating resistor 2 in the widthwise direction X of the substrate 1. The TCR of the material constituting the second auxiliary resistor 412 is lower than the TCR of the material constituting the heating resistor 2. The sheet resistance value of the material constituting the second auxiliary resistor 412 at room temperature (27° C.) is higher than the sheet resistance value of the material constituting the heating resistor 2 at room temperature (27° C.). The second auxiliary resistor 412 has a portion that is located in one end portion of the first section Z21 in the lengthwise direction X of the substrate 1. The second auxiliary resistor 412 reaches the boundary between the first section Z21 and the second section Z22. The second auxiliary resistor 412 has a portion that is in contact with the heating resistor 2. In the present embodiment, the second auxiliary resistor 412 is in contact with the second elongated portion 22. The second auxiliary resistor 412 is separated from the heating resistor 2 via a gap. One end of the second auxiliary resistor 412 is in contact with the heating resistor 2, and the other end of the second auxiliary resistor 412 is in contact with the resistor electrode 5 (second resistor connection portion 517). Also, the second auxiliary resistor 412 is electrically connected to the heating resistor 2 in parallel. The second auxiliary resistor 412 is formed on an end portion of the substrate 1 in the widthwise direction Y of the substrate 1 (end portion on the second widthwise direction Y2 side).

Figure 34:
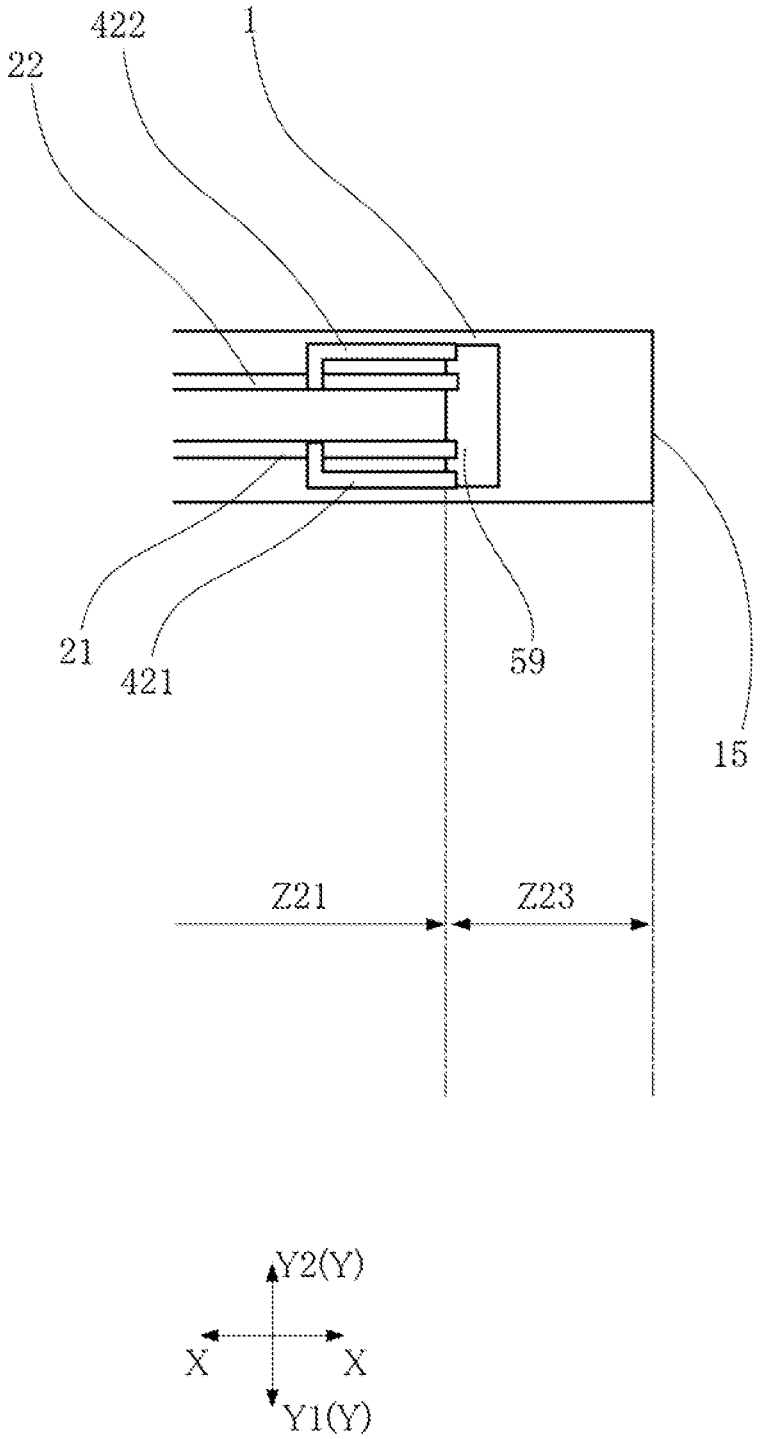
FIG. 34 is a partial enlarged diagram showing an enlargement of a portion of FIG. 24.

FIG. 34 is a partial enlarged diagram showing an enlargement of a portion of FIG. 24.

The first auxiliary resistance element 421 has a portion that is located in a different region from the region occupied by the heating resistor 2 in the widthwise direction Y of the substrate 1. The first auxiliary resistance element 421 is arranged at a position separated from the first auxiliary resistor 411 in the lengthwise direction X of the substrate 1. The TCR of the material constituting the first auxiliary resistance element 421 is lower than the TCR of the material constituting the heating resistor 2. The sheet resistance value of the material constituting the first auxiliary resistance element 421 at room temperature (27° C.) is higher than the sheet resistance value of the material constituting the heating resistor 2 at room temperature (27° C.). The first auxiliary resistance element 421 has a portion that is located in one end portion of the first section Z21 in the lengthwise direction X of the substrate 1. The first auxiliary resistance element 421 reaches the boundary between the first section Z21 and the third section Z23. The first auxiliary resistance element 421 has a portion that is in contact with the heating resistor 2. In the present embodiment, the first auxiliary resistance element 421 is in contact with the first elongated portion 21. The first auxiliary resistance element 421 is separated from the heating resistor 2 via a gap. One end of the first auxiliary resistance element 421 is in contact with the heating resistor 2, and the other end of the first auxiliary resistance element 421 is in contact with the connecting electrode 59. Also, the first auxiliary resistance element 421 is electrically connected to the heating resistor 2 in parallel. The first auxiliary resistance element 421 is formed on an end portion of the substrate 1 in the widthwise direction Y of the substrate 1 (end portion on the first widthwise direction Y1 side).

The second auxiliary resistance element 422 has a portion that is located in a different region from the region occupied by the heating resistor 2 in the widthwise direction Y of the substrate 1. The second auxiliary resistance element 422 is arranged at a position separated from the second auxiliary resistor 412 in the lengthwise direction X of the substrate 1. The TCR of the material constituting the second auxiliary resistance element 422 is lower than the TCR of the material constituting the heating resistor 2. The sheet resistance value of the material constituting the second auxiliary resistance element 422 at room temperature (27° C.) is higher than the sheet resistance value of the material constituting the heating resistor 2 at room temperature (27° C.). The second auxiliary resistance element 422 has a portion that is located in one end portion of the first section Z21 in the lengthwise direction X of the substrate 1. The second auxiliary resistance element 422 reaches the boundary between the first section Z21 and the third section Z23. The second auxiliary resistance element 422 has a portion that is in contact with the heating resistor 2. In the present embodiment, the second auxiliary resistance element 422 is in contact with the second elongated portion 22. The second auxiliary resistance element 422 is separated from the heating resistor 2 via a gap. One end of the second auxiliary resistance element 422 is in contact with the heating resistor 2, and the other end of the second auxiliary resistance element 422 is in contact with the connecting electrode 59. Also, the second auxiliary resistance element 422 is electrically connected to the heating resistor 2 in parallel. The second auxiliary resistance element 422 is formed on an end portion of the substrate 1 in the widthwise direction Y of the substrate 1 (end portion on the second widthwise direction Y2 side).

Note that the first auxiliary resistor 411 may be provided between the substrate 1 and the heating resistor 2 in the portion in which the first auxiliary resistor 411 and the heating resistor 2 are stacked. Alternatively, the heating resistor 2 may be provided between the first auxiliary resistor 411 and the substrate 1 in the portion in which the first auxiliary resistor 411 and the heating resistor 2 are stacked. The same follows for the second auxiliary resistor 412, the first auxiliary resistance element 421, and the second auxiliary resistance element 422 as well. AgPd is one example of the resistor material constituting the first auxiliary resistor 411, the second auxiliary resistor 412, the first auxiliary resistance element 421, and the second auxiliary resistance element 422. Nichrome and ruthenium oxide are other examples of the resistor material constituting the first auxiliary resistor 411, the second auxiliary resistor 412, the first auxiliary resistance element 421, and the second auxiliary resistance element 422.

The resistance values of the heating resistor 2, the first auxiliary resistor 411, the second auxiliary resistor 412, the first auxiliary resistance element 421, and the second auxiliary resistance element 422 can be set differently by changing the amount of an additive, for example.

Figure 35A:
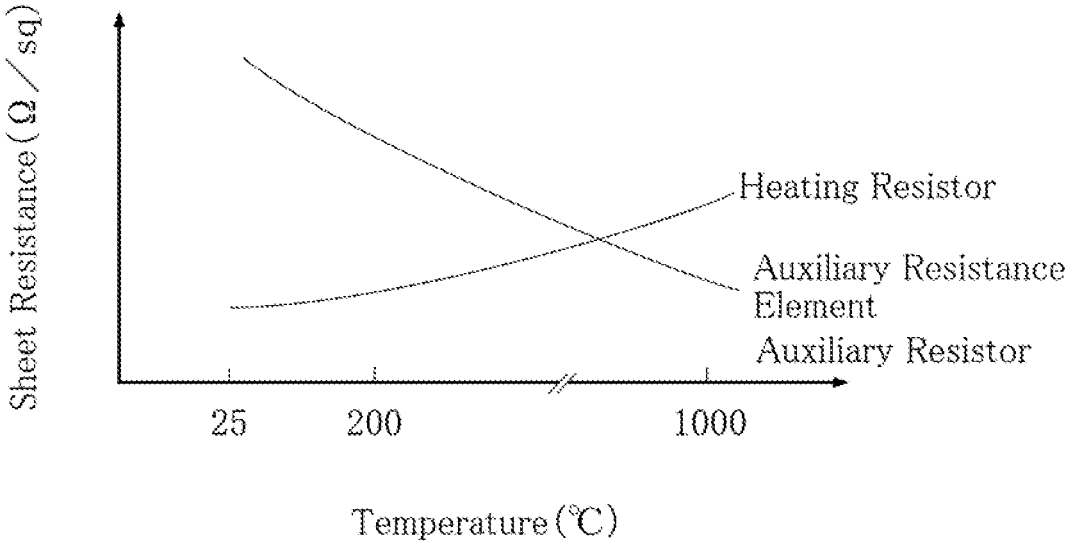
FIG. 35A is a graph showing a relationship between the sheet resistance value and the temperature of a heating resistor, an auxiliary resistor, and an auxiliary resistance element.
Figure 35B:
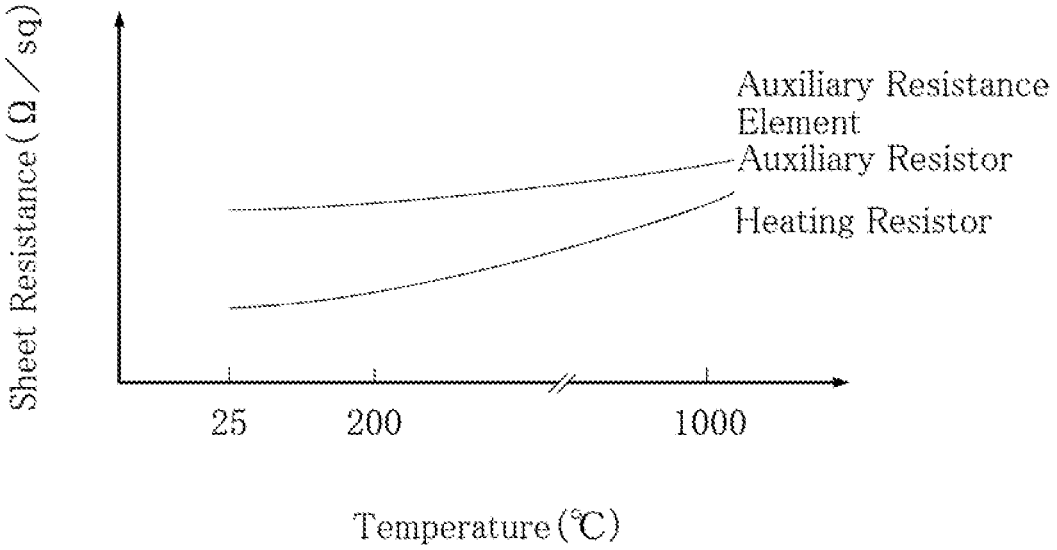
FIG. 35B is a graph showing a relationship between the sheet resistance value and the temperature of a heating resistor, an auxiliary resistor, and an auxiliary resistance element.

The sheet resistance value of the first auxiliary resistor 411, the second auxiliary resistor 412, the first auxiliary resistance element 421, and the second auxiliary resistance element 422 at 27° C. is in the range of 1 Ω/sq to 10 Ω/sq, for example. The sheet resistance value of the heating resistor 2 at 27° C. is in the range of 0.1 Ω/sq to 1 Ω/sq, for example. The ratio between the resistance value of the first auxiliary resistor 411, the second auxiliary resistor 412, the first auxiliary resistance element 421, and the second auxiliary resistance element 422 at 27° C. to the sheet resistance value of the heating resistor 2 at 27° C. is in the range of 5:1 to 14:1, and preferably 8:1 to 12:1, for example. Also, the ratio between the sheet resistance value of the first auxiliary resistor 411, the second auxiliary resistor 412, the first auxiliary resistance element 421, and the second auxiliary resistance element 422 at 1000° C. to the sheet resistance value of the heating resistor 2 at 1000° C. is in the range of 2.5:1 to 1:2.5, for example. Note that FIGS. 35A and 35B show two examples of the relationship between the sheet resistance value and the temperature of the heating resistor, the auxiliary resistor, and the auxiliary resistance element.

The protective layer 7 shown in FIGS. 22, 23, 25 to 28, and the like covers the heating resistor 2, the first auxiliary resistor 411, the second auxiliary resistor 412, the first auxiliary resistance element 421, and the second auxiliary resistance element 422. Also, the protective layer 7 is in contact with the heating resistor 2, the first auxiliary resistor 411, the second auxiliary resistor 412, the first auxiliary resistance element 421, and the second auxiliary resistance element 422. Furthermore, the protective layer 7 covers the connecting electrode 59 and a portion of the resistor electrode 5. In the case of the resistor electrode 5, the protective layer 7 specifically covers the first resistor connection portion 512 and the second resistor connection portion 517. The resistor electrode 5 is partially exposed from the protective layer 7. Specifically, the first resistor pad 511 and the second resistor pad 516 are exposed from the protective layer 7. The protective layer 7 is made of a glass or a polyimide, for example.

As shown in FIG. 22, in the apparatus 800, the substrate upper surface 11 side of the substrate 1 is located adjacent to the platen roller 801. For this reason, the heating resistor 2 is located between the substrate 1 and the platen roller 801. On the other hand, the thermistor 861 is arranged on the substrate lower surface 12, and detects the temperature of the substrate 1.

Next, operation effects of the present embodiment will be described.

In the present embodiment, the heater 106 includes the first auxiliary resistor 411. The first auxiliary resistor 411 has a portion that is located in a different region from the region occupied by the heating resistor 2 in the widthwise direction Y of the substrate 1. According to this configuration, electrical power can be applied to the first auxiliary resistor 411 so as to cause the first auxiliary resistor 411 to generate heat during use of the heater 106. This makes it possible to raise the temperature of the region of the substrate 1 in which the heating resistor 2 is not formed. This reduces the temperature gradient between the region of the substrate 1 in which the heating resistor 2 is formed and the region of the substrate 1 in which the heating resistor 2 is not formed. Accordingly, it is possible to prevent cracking of the substrate 1 during use of the heater 106.

In the present embodiment, the TCR of the material constituting the first auxiliary resistor 411 is lower than the TCR of the material constituting the heating resistor 2. This configuration is suitable to further increasing the resistance value of the first auxiliary resistor 411 as the temperature of the substrate 1 rises during use of the heater 106. This makes it possible to cause the first auxiliary resistor 411 to generate more heat as the temperature of the substrate 1 rises. This makes it possible to reduce the temperature gradient between the region of the substrate 1 in which the heating resistor 2 is formed and the region of the substrate 1 in which the heating resistor 2 is not formed as the temperature of the substrate 1 rises. Accordingly, it is possible to prevent cracking of the substrate 1 during use of the heater 106.

In the present embodiment, the sheet resistance value of the material constituting the first auxiliary resistor 411 at room temperature (27° C.) is higher than the sheet resistance value of the material constituting the heating resistor 2 at room temperature (27° C.). According to this configuration, when the temperature of the substrate 1 is not very high, it is possible to cause the heating resistor 2 to generate more heat, without causing the first auxiliary resistor 411 to generate very much heat. Accordingly, even if the first auxiliary resistor 411 is formed, it is possible to appropriately cause the heating resistor 2 to generate heat when the temperature of the substrate 1 is not very high.

Conventionally, there has been a risk of the substrate 1 cracking in the vicinity of the boundary between the first section Z21 and the second section Z22 due to the influence of the temperature gradient between the first section Z21 and the second section Z22. In the present embodiment, the first auxiliary resistor 411 has a portion that is located in one end portion of the first section Z21 in the lengthwise direction X of the substrate 1. According to this configuration, the temperature gradient between the first section Z21 and the second section Z22 can be reduced in comparison to conventional heaters. Reducing the temperature gradient between the first section Z21 and the second section Z22 in this way reduces the difference between the thermal expansion of the first section Z21 in the widthwise direction Y and the thermal expansion of the second section Z22 in the widthwise direction Y. This makes it possible to prevent cracking of the substrate 1 in the vicinity of the boundary between the first section Z21 and the second section Z22.

In particular, in the case where the substrate 1 is made of a material that has a low thermal conductivity (e.g., alumina), the temperature gradient between the first section Z21 and the second section Z22 tends to be high if the first auxiliary resistor 411 and the like are not formed. For this reason, the configuration of the present embodiment is particularly useful in the case where the substrate 1 is made of a material that has a low thermal conductivity (e.g., alumina).

Also, in the present embodiment, the first auxiliary resistor 411 is electrically connected to the heating resistor 2 in parallel. According to this configuration, there is no need to separately form a current pathway for the first auxiliary resistor 411, separately from the current pathway for the heating resistor 2. This is very favorable in the realization of the heater 106.

When the heater 106 is used, the end portions of the substrate 1 in the widthwise direction Y are easily influenced by thermal expansion. In the present embodiment, the first auxiliary resistor 411 is formed on an end portion of the substrate 1 in the widthwise direction Y of the substrate 1. This configuration enables more effectively preventing cracking of the substrate 1.

The above-described advantages regarding the first auxiliary resistor 411 are applicable to the second auxiliary resistor 412 as well.

In the present embodiment, the heater 106 includes the first auxiliary resistance element 421. The first auxiliary resistance element 421 has a portion that is located in a different region from the region occupied by the heating resistor 2 in the widthwise direction Y of the substrate 1. According to this configuration, electrical power can be applied to the first auxiliary resistance element 421 so as to cause the first auxiliary resistance element 421 to generate heat during use of the heater 106. This makes it possible to raise the temperature of the region of the substrate 1 in which the heating resistor 2 is not formed. This reduces the temperature gradient between the region of the substrate 1 in which the heating resistor 2 is formed and the region of the substrate 1 in which the heating resistor 2 is not formed.

Accordingly, it is possible to prevent cracking of the substrate 1 during use of the heater 106.

In the present embodiment, the TCR of the material constituting the first auxiliary resistance element 421 is lower than the TCR of the material constituting the heating resistor 2. This configuration is suitable to further increasing the resistance value of the first auxiliary resistance element 421 as the temperature of the substrate 1 rises during use of the heater 106. This makes it possible to cause the first auxiliary resistance element 421 to generate more heat as the temperature of the substrate 1 rises. This makes it possible to reduce the temperature gradient between the region of the substrate 1 in which the heating resistor 2 is formed and the region of the substrate 1 in which the heating resistor 2 is not formed as the temperature of the substrate 1 rises. Accordingly, it is possible to prevent cracking of the substrate 1 during use of the heater 106.

In the present embodiment, the sheet resistance value of the material constituting the first auxiliary resistance element 421 at room temperature (27° C.) is higher than the sheet resistance value of the material constituting the heating resistor 2 at room temperature (27° C.). According to this configuration, when the temperature of the substrate 1 is not very high, it is possible to cause the heating resistor 2 to generate more heat, without causing the first auxiliary resistance element 421 to generate very much heat. Accordingly, even if the first auxiliary resistance element 421 is formed, it is possible to appropriately cause the heating resistor 2 to generate heat when the temperature of the substrate 1 is not very high.

Conventionally, there has been a risk of the substrate 1 cracking in the vicinity of the boundary between the first section Z21 and the third section Z23 due to the influence of the temperature gradient between the first section Z21 and the third section Z23. In the present embodiment, the first auxiliary resistance element 421 has a portion that is located in one end portion of the first section Z21 in the lengthwise direction X of the substrate 1. According to this configuration, the temperature gradient between the first section Z21 and the third section Z23 can be reduced, in comparison to conventional heaters. Reducing the temperature gradient between the first section Z21 and the third section Z23 in this way reduces the difference between the thermal expansion of the first section Z21 in the widthwise direction Y and the thermal expansion of the third section Z23 in the widthwise direction Y. This makes it possible to prevent cracking of the substrate 1 in the vicinity of the boundary between the first section Z21 and the third section Z23.

In particular, in the case where the substrate 1 is made of a material that has a low thermal conductivity (e.g., alumina), the temperature gradient between the first section Z21 and the third section Z23 tends to be high if the first auxiliary resistance element 421 and the like are not formed. For this reason, the configuration of the present embodiment is particularly useful in the case where the substrate 1 is made of a material, that has a low thermal conductivity (e.g., alumina).

Also, in the present embodiment, the first auxiliary resistance element 421 is electrically connected to the heating resistor 2 in parallel. According to this configuration, there is no need to separately form a current pathway for the first auxiliary resistance element 421, separately from the current pathway for the heating resistor 2. This is very favorable in the realization of the heater 106.

When the heater 106 is used, the end portions of the substrate 1 in the widthwise direction Y are easily influenced by thermal expansion. In the present embodiment, the first auxiliary resistance element 421 is formed on an end portion of the substrate 1 in the widthwise direction Y of the substrate 1. This configuration enables more effectively preventing cracking of the substrate 1.

The above-described advantages regarding the first auxiliary resistance element 421 are applicable to the second auxiliary resistance element 422 as well.

In the present embodiment, the diameters R3 to R6 of the semicircles constituting the cutouts 131, 141, 151, and 161 at the substrate lower surface 12 are in the range of 40 to 70 μm, which is very small. This configuration is obtained as a result of cutting the substrate 1 with a YAG laser. According to this configuration, reducing the size of the groove formed by laser processing makes it possible to disperse thermal stress that arises during high-temperature heating, and thus resistance to heat is improved. Also, cracking of the substrate 1 can be prevented with this configuration as well.

When the heater 106 is used, the heating resistor 2 undergoes thermal expansion in addition to the substrate 1. The resistance to stress is low at the locations where cutouts (the cutouts 131 and the cutouts 141) are formed. For this reason, if the heating resistor 2 is formed on the substrate lower surface 12, there is a risk of formation of a crack in the substrate 1, starting at a cutout, due to stress arising from thermal expansion. However, in the present embodiment, the heating resistor 2 is formed on the substrate upper surface 11. According to this configuration, the heating resistor 2 can be separated a farther distance from cutouts (the cutouts 131 and the cutouts 141), thus making it possible to prevent cracking of the substrate 1 caused by thermal expansion.

Although the platen roller 801 is arranged on the substrate upper surface 11 side of the substrate 1 in the apparatus 800 in the above description, the platen roller 801 may be arranged on the substrate lower surface 12 side. In other words, the heater 106 may be used in the state of being turned upside down relative to the state shown in FIG. 22. In this case, it is sufficient for the thermistor 861 to be arranged on the protective layer 7, for example.

First Variation of Sixth Embodiment

Figure 36:
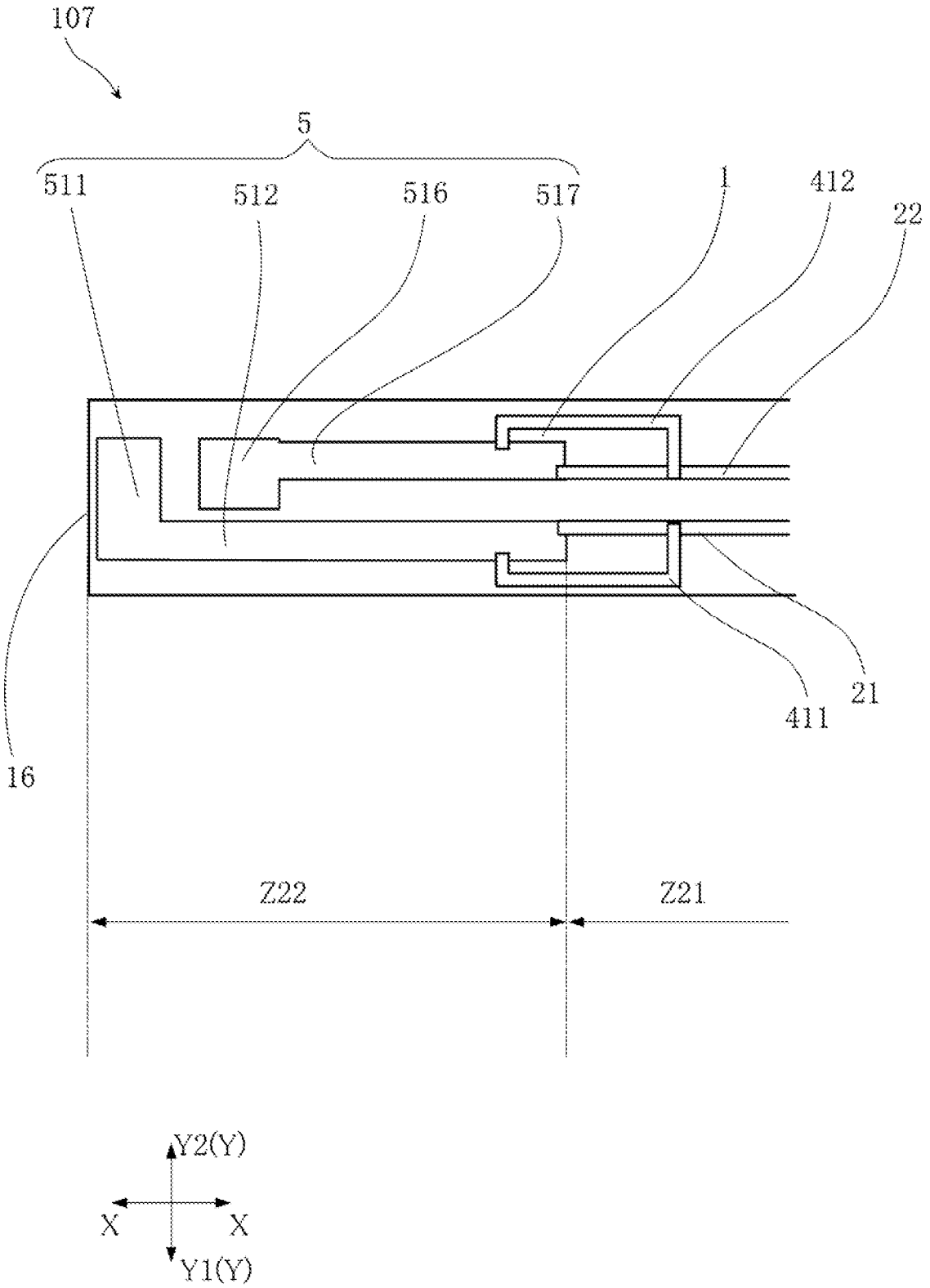
FIG. 36 is a partial enlarged plan view of a heater according to a first variation of the sixth embodiment of the present invention.

The following describes a first variation of the sixth embodiment of the present invention with reference to FIG. 36.

FIG. 36 is a partial enlarged plan view of a heater according to the first variation of the sixth embodiment of the present invention.

Note that in the following description, configurations that are the same as or similar to configurations in the above description will be denoted by the same reference numbers as above, and descriptions thereof will be omitted as appropriate.

The shapes of the first auxiliary resistor 411 and the second auxiliary resistor 412 in a heater 107 of the present variation are different from those in the heater 106. Operation effects similar to the operation effects of the heater 106 are achieved with this configuration as well.

The present invention is not limited to the embodiments described above. Various design modifications can be made to the specific configurations of the units of the present invention.

In contrast with the above-described embodiments, the two ends of the auxiliary resistor may be in contact with the heating resistor.

The invention claimed is:

1. A heater comprising:

an elongated substrate;

a heating resistor formed on the substrate;

a resistor-connected conductor formed on the substrate and in contact with the heating resistor;

a first auxiliary resistor having a first end, a second end opposite to the first end, and an intermediate portion extending between the first end and the second end; and a second auxiliary resistor having a third end, a fourth end opposite to the third end, and an intermediate portion extending between the third end and the fourth end, wherein the substrate includes a first region and a second region, the first region is overlapped with the heating resistor in a lengthwise direction of the substrate, and is not overlapped with the resistor-connected conductor in the lengthwise direction of the substrate, the second region is adjacent to the first region in the lengthwise direction of the substrate, wherein the heating resistor includes a first elongated portion and a second elongated portion that each extend along the lengthwise direction of the substrate, the first elongated portion and the second elongated portion being separated from each other in a widthwise direction of the substrate that is orthogonal to the lengthwise direction and a thickness direction of the substrate, the first end of the first auxiliary resistor is in contact with the first elongated portion, and the second end of the first auxiliary resistor is in contact with the resistor-connected conductor, the intermediate portion of the first auxiliary resistor is spaced apart via a gap from the first elongated portion and disposed opposite to the second elongated portion with respect to the first elongated portion, the third end of the second auxiliary resistor is in contact with the second elongated portion, and the fourth end of the second auxiliary resistor is in contact with the resistor-connected conductor, and the intermediate portion of the second auxiliary resistor is spaced apart via a gap from the second elongated portion and disposed opposite to the first elongated portion with respect to the second elongated portion.

2. The heater according to claim 1 further comprising a heat conducting film extending from the first region into the second region, wherein the substrate has a substrate upper surface and a substrate lower surface, the substrate upper surface and the substrate lower surface are located on mutually opposite sides in the thickness direction of the substrate, the heating resistor is formed on the substrate upper surface side of the substrate, the heat conducting film includes a plurality of elements that each extend from the first region into the second region such that a first part of each element is disposed in the first region and a second part of said each element is disposed in the second region, the plurality of elements of the heat conducting film including a first heat conductor and a second heat conductor, the resistor-connected conductor includes a first electrical conductor and a second electrical conductor, each of the first and second electrical conductors being disposed between the first and second heat conductors of the heat conducting film in the widthwise direction of the substrate, the heating resistor includes a first contact that is in contact with the first electrical conductor of the resistor-connected conductor, and a second contact that is in contact with the second electrical conductor of the resistor-connected conductor, at a location in the lengthwise direction, the first electrical conductor and the second electrical conductor of the resistor-connected conductor are separated in the widthwise direction of the substrate from the first heat conductor and the second heat conductor of the heat conducting film, and at the location in the lengthwise direction, the first contact and the second contact of the heating resistor are separated in the widthwise direction of the substrate from the first heat conductor and the second heat conductor of the heat conducting film.

3. The heater according to claim 2, wherein the heat conducting film is formed on end portions, in the widthwise direction of the substrate, of the substrate.

4. The heater according to claim 2, wherein the heat conducting film has portions that are formed more toward widthwise direction end portions of the substrate than the heating resistor is, in a view along the thickness direction of the substrate.

5. The heater according to claim 2, wherein the substrate has a first substrate side surface and a second substrate side surface, the first substrate side surface and the second substrate side surface are located on mutually opposite sides in the widthwise direction of the substrate, the first substrate side surface and the second substrate side surface facing in mutually opposite sides in the widthwise direction of the substrate, and the resistor-connected conductor is formed on the substrate upper surface side.

6. The heater according to claim 5, wherein a plurality of cutouts are formed in the first substrate side surface and the substrate lower surface, and each of the plurality of cutouts has a semicircular cross-sectional shape taken along a plane orthogonal to the thickness direction of the substrate, and a diameter of the semicircle gradually decreases from the substrate lower surface toward the substrate upper surface.

7. The heater according to claim 6, wherein each of the plurality of cutouts is semi-conical.

8. The heater according to claim 6, wherein the diameter of the semicircle constituting each of the cutouts at the substrate lower surface is in a range of 40 to 70 μm.

9. The heater according to claim 6, wherein the plurality of cutouts are formed by a laser.

10. The heater according to claim 5, wherein the heat conducting film includes a lower surface portion formed on the substrate lower surface.

11. The heater according to claim 5, wherein the plurality of the elements of the heat conducting film include a first side surface portion formed on the first substrate side surface, and a second side surface portion formed on the second substrate side surface.

12. The heater according to claim 5, wherein the heat conducting film includes an upper surface portion formed on the substrate upper surface.

13. The heater according to claim 12, wherein the upper surface portion, the heating resistor, and the resistor-connected conductor are in contact with the substrate upper surface.

14. The heater according to claim 12, wherein the upper surface portion is in contact with the substrate upper surface, and the upper surface portion has a portion that is overlapped with the heating resistor in a view along the thickness direction of the substrate.

15. The heater according to claim 14, further comprising an insulating layer interposed between the upper surface portion and the heating resistor.

16. The heater according to claim 2, wherein a dimension, in the lengthwise direction of the substrate, of a portion of the heat conducting film formed in the second region is greater than or equal to 5 mm.

17. The heater according to claim 2, wherein a dimension, in the lengthwise direction of the substrate, of a portion of the heat conducting film formed in the first region is greater than or equal to 5 mm.

18. The heater according to claim 10, wherein a dimension of the lower surface portion in the widthwise direction of the substrate is greater than or equal to half of a dimension of the substrate in the widthwise direction.

19. The heater according to claim 10, wherein the plurality of the elements of the heat conducting film include a plurality of lower surface elements that are formed by the lower surface portion and that are separated from each other.

20. The heater according to claim 12, wherein the plurality of the elements of the heat conducting film include a plurality of upper surface elements that are formed by the upper surface portion and that are separated from each other.

21. The heater according to claim 2, wherein the heat conducting film is made of a material that has a higher thermal conductivity than the thermal conductivity of a material constituting the substrate.

22. The heater according to claim 2, wherein the heat conducting film is made of a metal.

23. The heater according to claim 22, wherein the metal is one of Ag, AgPt, Au, and Cu.

24. The heater according to claim 2, wherein a thickness of the heat conducting film is in a range of 10 to 20 μm.

25. The heater according to claim 1, wherein the first elongated portion is located on a first widthwise direction side that is on one side in the widthwise direction of the substrate, a ratio of a separation dimension between the first elongated portion and an edge of the substrate in the first widthwise direction to a dimension of the substrate in the widthwise direction is in a range of 0.054 to 0.109, the second elongated portion is located on a second widthwise direction side that is on another side in the widthwise direction of the substrate, and a ratio of a separation dimension between the second elongated portion and an edge of the substrate in the second widthwise direction to the dimension of the substrate in the widthwise direction is in a range of 0.054 to 0.109.

26. The heater according to claim 25, wherein a thickness of the substrate is in a range of 0.5 to 1.0 mm.

27. The heater according to claim 2, wherein the first elongated portion is located on a first widthwise direction side that is on one side in the widthwise direction of the substrate, a separation dimension between the first elongated portion and an edge of the substrate in the first widthwise direction is in a range of 0.5 to 1.0 mm, the second elongated portion is located on a second widthwise direction side that is on another side in the widthwise direction of the substrate, and a separation dimension between the second elongated portion and an edge of the substrate in the second widthwise direction is in a range of 0.5 to 1.0 mm.

28. The heater according to claim 1, wherein the first elongated portion has a first wide portion and a first narrow portion, a dimension of the first wide portion in the widthwise direction is greater than a dimension of the first narrow portion in the widthwise direction, and the first wide portion is located between the first narrow portion and the resistor-connected conductor.

29. The heater according to claim 28, wherein the second elongated portion has a second wide portion and a second narrow portion, a dimension of the second wide portion in the widthwise direction is greater than a dimension of the second narrow portion in the widthwise direction, and the second wide portion is located between the second narrow portion and the resistor-connected conductor.

30. The heater according to claim 27, further comprising a protective layer that covers the heating resistor.

31. The heater according to claim 30, wherein the protective layer covers the first elongated portion, the second elongated portion, and the resistor-connected conductor.

32. The heater according to claim 31, wherein the first electrical conductor and the second electrical conductor of the resistor-connected conductor include a first resistor pad and a second resistor pad, respectively, and the first resistor pad and the second resistor pad are exposed from the protective layer.

33. The heater according to claim 32, wherein the first electrical conductor and the second electrical conductor of the resistor-connected conductor include a first resistor connection portion and a second resistor connection portion, respectively, the first resistor connection portion is connected to the first resistor pad and is in contact with the first elongated portion, the second resistor connection portion is connected to the second resistor pad and is in contact with the second elongated portion, and the first resistor connection portion and the second resistor connection portion are covered by the protective layer.

34. The heater according to claim 1, wherein the heating resistor is made of one of AgPd, nichrome, and ruthenium oxide.

35. The heater according to claim 1, wherein the substrate is made of a ceramic.

36. The heater according to claim 35, wherein the ceramic is one of alumina, zirconia, and aluminum nitride.

37. The heater according to claim 1, wherein a thickness of the substrate is in a range of 0.4 to 1.1 mm.

38. The heater according to claim 1, wherein a thickness of the substrate is in a range of 0.4 to 0.6 mm.

39. The heater according to claim 30, wherein the protective layer is made of a glass.

40. The heater according to claim 19, wherein the heating resistor is disposed between two of the plurality of upper surface elements of the upper surface portion.

41. The heater according to claim 1, wherein a temperature coefficient of resistance of the first auxiliary resistor is smaller than a temperature coefficient of resistance of the first elongated portion, and a temperature coefficient of resistance of the second auxiliary resistor is smaller than a temperature coefficient of resistance of the second elongated portion.

42. The heater according to claim 1, wherein the resistor-connected conductor comprises a single connecting electrode connected to the first elongated portion and the second elongated portion, and the second end of the first auxiliary resistor and the fourth end of the second auxiliary resistor are in contact with the single connecting electrode.

* * * * *